US006030755A

United States Patent [19]

Matsumoto et al.

[11] Patent Number: 6,030,755

[45] Date of Patent: Feb. 29, 2000

[54] IMAGE FORMING METHOD

[75] Inventors: Kazuhiko Matsumoto; Masakazu Morigaki, both of Kanagawa, Japan

[73] Assignee: Fuji Photo Film Co., Ltd., Kanagawa, Japan

[21] Appl. No.: 09/022,523

[22] Filed: Feb. 12, 1998

[30] Foreign Application Priority Data

Feb. 12, 1997 [JP] Japan ..... 9-044666

[51] Int. Cl.[7] ..... G03C 8/32; G03C 7/407

[52] U.S. Cl. ..... 430/351; 430/350; 430/203; 430/391; 430/405

[58] Field of Search ..... 430/351, 350, 430/370, 203, 216, 239, 490, 352, 391, 405

[56] References Cited

U.S. PATENT DOCUMENTS

| | | | |
|---|---|---|---|
| 4,696,887 | 9/1987 | Sato et al. | 430/203 |
| 4,921,779 | 5/1990 | Cullinan et al. . | |
| 4,975,356 | 12/1990 | Cullinan et al. . | |
| 5,217,852 | 6/1993 | Morigaki et al. . | |
| 5,334,493 | 8/1994 | Fujita et al. . | |
| 5,449,593 | 9/1995 | Morigaki et al. . | |
| 5,756,269 | 5/1998 | Ishikawa et al. | 430/351 |

FOREIGN PATENT DOCUMENTS

| | | |
|---|---|---|
| 62-190529 | 8/1987 | Japan . |
| 2220052 | 9/1990 | Japan . |
| 451237 | 2/1992 | Japan . |
| 4214556 | 8/1992 | Japan . |
| 4313753 | 11/1992 | Japan . |
| 534889 | 2/1993 | Japan . |

*Primary Examiner*—Thorl Chea

*Attorney, Agent, or Firm*—Sughrue, Mion, Zinn, Macpeak & Seas, PLLC

[57] ABSTRACT

Disclosed is an image forming method in which a light-sensitive element having at least three light-sensitive layers on a support is imagewisely exposed and the light-sensitive element is superposed on a processing element in the presence of water in an amount of from 0.1 to 1.0 times of the amount necessary for maximally swelling the total coated layers of the light-sensitive element and the processing element, and the both elements are heated to develop an image on the light-sensitive element. The formed image is outputted to a separate recording material. The developed light-sensitive element is superposed on a dye forming reaction inhibiting sheet and heated to stabilize the light-sensitive element.

17 Claims, No Drawings

IMAGE FORMING METHOD

BACKGROUND OF THE INVENTION

1. Field of the Invention

The present invention relates to a new image forming method for obtaining color images on separate materials by using light-sensitive elements for photographing by a heat developing process. More particularly, in this new image forming method for obtaining color images on simple heat developing process, an image forming method in which a light-sensitive element exhibits an excellent preservablity after heat-development.

2. Description of the Related Art

In a method regarded as conventional color photography, what is known as a color negative contains a layer in which a yellow dye image is formed by recording blue light, a layer in which a magenta dye image is formed by recording green light, and a layer in which a cyan dye image is formed by recording red light. During the development step, a dye image is formed by the reaction (known as "coupling") of a coupler and an oxidized product which has been formed by oxidizing a developing agent in a process of reducing silver halide grains containing a latent image to silver. Both the undeveloped silver halide and the developed silver are removed in the subsequent bleaching and fixing processes. Color paper is then exposed through the negative dye image thus obtained and a color print is acquired through developing, bleaching, and fixing processes similar to the above processes.

Further, a method for forming a color image is also known in which image information contained in the above-described color negative is photoelectrically read, then image processing is performed to give image information for recording, and a color image is formed on other print material by using this image information. In particular, digital photo printers have been developed in which a light-sensitive element such as a color paper is exposed by scanning with recording light modulated by digital signals modulated in accordance with the above-described image information to obtain a finished print. An example of this technique is described in Japanese Patent Application Laid-Open (JP-A) No. 7-15593.

The above-described method requires normal wet developing, bleaching and fixing, and the process is complicated. Moreover, the developing solution used for wet developing is a strong base, therefore it is a dangerous chemical. Further, this developing solution degrades markedly, and control to keep the activity of the developing solution constant is complicated. This control method has been recently improved, however, it is still insufficient.

On the other hand, a simple and rapid method utilizing heat developing has been developed as a processing method for light-sensitive elements using silver halide. "Pictorography" and "Pictorostat" manufactured by Fuji Photo FilmCo., Ltd. are well known examples thereof. However, these are color print materials, and a color light-sensitive element for photographing using heat developing method has not yet been known.

As a heat developing method, there has been known a method in which heat developing is conducted in the presence of a small amount of water and a base and/or base precursor. An example of this method is described in Japanese Patent Application Publication (JP-B) No. 2-51494. However, in the image forming method as described therein, a dye donating material is used which manifests reducing properties for light-sensitive silver halide and reacts with the light-sensitive silver halide when heated to release a hydrophilic dye, and the dye released in heat development is transferred on an image receiving material which is used as a color print.

It has been found that when a light-sensitive element containing a color developing agent (hereinafter, sometimes referred to as simply "developing agent") which is highly stable in the absence of a base and a coupler is used in combination with a processing element containing a base and/or base precursor, and heat developing is conducted in the presence of a small amount of water, to form an image based on non-diffusive dye on the light-sensitive element, an image having excellent granularity and sharpness is obtained, and when the image information thus obtained is outputted onto another recording material such as color paper, heat developing color print material and the like, an excellent color image can be obtained. In this case, it is possible to conduct rapid processing with satisfying high preserving stability required for material for photographing, since the light-sensitive element and the base are separated before development. Further, the method in which a colorless color developing agent and a coupler are used is advantageous from the point of sensitivity which is extremely important for materials for photographing, in comparison with the method in which a dye releasing type compound is used.

However, in such a structure, problems of insufficient storability such as occurrence of unintended fogging and staining after heat development arise when a light-sensitive element is allowed to stand after heat development.

SUMMARY OF THE INVENTION

As a result of intensive studies by the present inventors, it has become apparent that the above-described fogging and staining are not sufficiently improved even if the heat developed photosensitive element is additionally treated by bleaching or fixing steps for conventional silver halide light-sensitive element, and that this fogging and staining is mainly caused by a dye forming reaction of the coupler with the unreacted developing agent remaining in the light-sensitive element after heat development. Therefore, in the present invention, this problem is resolved by inhibiting the above-described dye forming reaction.

Namely, the present invention is an image forming method comprising the steps of:

image-wise exposing a photosensitive element having on a transparent support at least three light-sensitive layers, which each comprise a light-sensitive tabular grain silver halide emulsion, a color developing agent, a coupler and a binder, and which have their sensitivities in different wavelength regions, the absorption wavelength region of each dye formed by reaction of the coupler with the oxidized product of the color developing agent being different from each other;

providing said photosensitive element or a processing element with water in an amount corresponding to the amount of from 0.1 to 1 times the amount required for maximally swelling the total coated layers of said light-sensitive element and said processing element excluding a back layer of said light-sensitive element and said processing element, wherein said processing element comprises on a support a processing layer containing at least a base and/or base precursor;

superposing said photosensitive element on said processing element such that the light-sensitive layer faces the processing layer;

heating the elements to a temperature of from 60° C. to 100° C. for a time of from 5 seconds to 60 seconds to form an image based on at least three-color non-diffusible dyes on said photosensitive element; and forming a color image in a separate recording material based on the image information obtained in the heat-developed photosensitive element, wherein, processing the heat-developed light-sensitive element for inhibiting a dye forming reaction.

DESCRIPTION OF THE PREFERRED EMBODIMENTS

The present invention is an image forming method comprising the steps of:

imagewise exposing a light-sensitive element having on a transparent support at least three light-sensitive layers, which each comprise a light-sensitive tabular grain silver halide emulsion, a color developing agent, a coupler and a binder, and which have their sensitivities in different wavelength regions, the absorption wavelength region of each dye formed by reaction of the coupler with the oxidized product of the color developing agent being different from each other;

providing said photosensitive element or a processing element with water in an amount corresponding to the amount of from 0.1 to 1 times the amount required for maximally swelling the total coated layers of said light-sensitive element and said processing element excluding a back layer of said light-sensitive element and said processing element, wherein said processing element comprises on a support a processing layer containing at least a base and/or base precursor;

superposing said photosensitive element on said processing element such that the light-sensitive layer faces the processing layer;

heating the elements to a temperature of from 60° C. to 100° C. for a time of from 5 seconds to 60 seconds to form an image based on at least three-color non-diffusible dyes on said photosensitive element; and forming a color image in a separate recording material based on the image information obtained in the heat-developed photosensitive element, wherein, processing the heat-developed light-sensitive element for inhibiting a dye forming reaction.

Further, it is preferable that the processed light-sensitive element after heat development is subjected to either a stabilization processing or bleaching processing of the silver halide, or a processing combination thereof arbitrarily.

The stabilization processing of a silver halide as herein described may be a processing which prevents printout of the silver halide, or a fixing process in which a part or all of the silver halide is dissolved with a silver complex-forming agent and a part or all of the dissolved salt of silver complex-forming agent is removed from the light-sensitive element.

It is preferable that the above-described color developing agent is at least one compound selected from compounds represented by the following general formulae (1) to (5).

General formula (1)

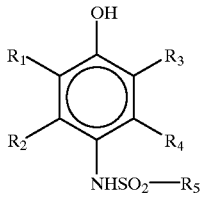

General formula (2)

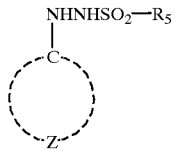

General formula (3)

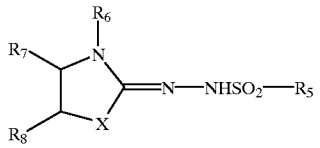

General formula (4)

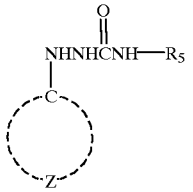

General formula (5)

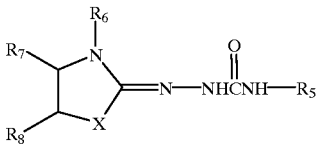

In the above-described general formulae, each of $R_1$ to $R_4$ represents a hydrogen atom, a halogen atom, an alkyl group, an aryl group, an alkyl carbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group, and $R_5$ represents a substituted or unsubstituted alkyl group, aryl group or heterocyclic group. Z represents anatomic group forming an aromatic ring (including a heteroaromatic ring), and when Z is a benzene ring, the total value of Hammett's constants (σ) of substituents thereof is not less than 1. $R_6$ is a substituted or unsubstituted alkyl group. X is selected from the groups consisting of an oxygen atom, a sulfur atom, a selenium atom or an alkyl-substituted or an aryl-substituted tertiary nitrogen atom. $R_7$and $R_8$are selected from the groups consisting of a hydrogen atom or a substituent, and $R_7$ and $R_8$ may bond each other to form a double bond or a ring.

(Explanation for means of inhibiting a dye forming reaction)

A dye forming reaction can be inhibited by removing one of or both a coupler and a developing agent which form a dye or by neutralizing an alkaline which promotes the dye forming reaction. Further, a compound which inhibits a dye forming reaction or precursor may be applied to a heat-developed light-sensitive element (in this case by creating a state wherein the compound can react with ingredients (coupler, developing agent and the like) in the light-sensitive element).

The inhibition of the dye forming reaction can be conducted in the heat developing processing in such a manner that a compound capable of inhibiting a dye forming reaction or a precursor thereof is introduced in the processing element for heat development, and the compound is allowed to act on the light-sensitive element after development so that the inhibition of the dye forming reaction is retarded from the development reaction.

Further, when the inhibition of the dye forming reaction is conducted in a step other than the heat developing step, a processing step which inhibits the dye forming reaction (hereinafter, sometimes referred to simply as "inhibiting process") may be conducted subsequent to the heat development step, or may be conducted even after image information formed on a light-sensitive element has been read subsequent to the heat development step.

Example of the compound which inhibits the dye forming reaction include compounds which are capable of reacting with the coupler at the coupling position and inactivating a dye forming reaction activity of the coupler, and compounds which are capable of reacting with the color developing agent to inactivate a developing activity or coupling activity of the color developing agent. Concretely, these compounds include N-methylol compounds, hexamethylenetetramine adducts or sulfite adducts of aldehydes such as formalin, glutaraldehyde and the like. For example, an aldehyde-sulfite acid adduct described in Japanese Patent Application Laid-Open (JP-A) No. 2-220052, a hexamethylenetetramine adduct, N-methylol compound and hexahydrotriazine adduct of aldehydes described in Japanese Patent Application Laid-Open (JP-A) No. 4-51237, a compound described in Japanese Patent Application Laid-Open (JP-A) No. 4-313753, and the like can be used. In addition, compounds and processing methods described in U.S. Pat. No. 5,270,148, British Patent No. 1350296, Japanese Patent Application Laid-Open (JP-A) No. 48-47338, Japanese Patent Application Laid-Open (JP-A) Nos. 4-214556, 5-34889, and the like can be used.

Further, a nucleophilic reaction reagent such as sulfonic acid, acid anhydride, active ester, epoxy compound and the like can also be used. Moreover, an acid precursor which releases an acid upon heating, and an electrophilic compound which reacts with a coexisting base upon heating can also be used, and the details thereof are described in Japanese Patent Application Laid-Open (JP-A) No. 62-190529 pp.31 to 32.

When the inhibition of a dye forming reaction is conducted in a step other than the heat development, a heat-developed light-sensitive element may be immersed in a processing solution for inhibiting dye forming reaction containing the above-described compound which can inhibit the dye forming reaction, or a processing sheet (hereinafter, sometimes referred to as an "inhibiting process sheet") for inhibiting dye reaction containing a compound capable of inhibiting the dye forming reaction may be laminated onto a light-sensitive element after the heat development so that the compound is allowed to act on the heat-developed light-sensitive element. From the view point of prevention of environmental pollution from processed waste solution, a processing method using the inhibiting sheet is preferable.

Into the inhibiting process solution containing the compound which inhibits a dye forming reaction, a surfactant, chelating agent and bacteriocide can be added as an anti-bacterial and antifungus agent. The concentration of the compound which inhibits a dye forming reaction is preferably from $10^{-1}$ to 1 M.

When the inhibiting process solution containing the compound which inhibits a dye forming reaction is used, the same stabilizing process steps as those used in the usual development step for a silver halide color light-sensitive element can be used in the same way.

The stabilizing process steps used for a development step of a usual silver halide color light-sensitive element is described, for example, in Japanese Patent Application Laid-Open (JP-A) No. 7-152129, paragraph No. 0285. The temperature of the inhibiting process solution is preferably from room temperature to 60° C. The processing time is in the range of 5 seconds to 5 minutes, and preferably in the range of 10 seconds to 1 minute.

The pH value of the inhibiting process solution is not required to be regulated. Depending on the dye formed in the light-sensitive element used in the present invention, the hue may sometimes change due to the solution turning acidic, and in this case, it is preferable that the pH value of the inhibiting process solution is regulated from neutral to weak alkaline, specifically from 7 to 9.

The light-sensitive element after immersion into the inhibiting process solution may be washed with water, however, the water-washing is not always necessary.

When the inhibiting process sheet containing the compound which inhibits a dye forming reaction is produced, the compound which inhibits a dye forming reaction can be added as a solution in a solvent such as water, methanol, ethanol, acetone, dimethylformaldehyde, methylpropyl glycol and the like or an alkaline or acidic aqueous solution to a coating solution for the inhibiting process sheet. The compound which inhibits a dye forming reaction may also be dispersed as a solid fine particle and added to the coating solution. The coating amount of the compound which inhibits a dye forming reaction in the inhibiting process sheet is preferably from 0.1 to 20-times based on the total amount of developing agent and coupler contained in the light-sensitive element to be processed with the inhibiting process sheet. The coating amount of the compound which inhibits a dye forming reaction in the inhibiting process sheet is preferably from 0.1 to 100 mmol/$m^2$. In the coating solution for the inhibiting process she et , the same hydrophilic polymer as in the light-sensitive element can be used as a binder, and the inhibiting process sheet used in the present invention can be produced by coating the above-described coating solution on a support as described later and drying the same for forming an inhibiting process layer.

It is preferable that the inhibiting process sheet is made as a hardened layer by using a hardener, in the same way as the light-sensitive element. As the hardener, the same agent as used for the light-sensitive element described below can be used.

The inhibiting process sheet may have various auxiliary layers such as a protective layer, a subbing layer, backing layer and others in the same way as the light-sensitive element. These layers can be formed in the same manner as for light-sensitive element described below.

It is preferable that a processing layer is formed on a continuous web in the inhibiting process sheet. Regarding this continuous web, the length of the inhibiting process sheet is fully longer than the long edge of the corresponding light-sensitive element in inhibiting processing, the web is used without any part being cut when used in the inhibiting process and is long enough for a plurality of light-sensitive elements to be processed continuously. In general, the length of the inhibiting process sheet is from 5-times to 10000-times of the width. The width of the inhibiting process sheet is not restricted, however, it is preferably not less than the width of the corresponding light-sensitive element.

Further, an embodiment is also preferable in which a plurality of light-sensitive elements are arranged side by side for inhibiting processing. In this case, the width of the inhibiting process sheet is preferably not less than the product of the width of the inhibiting sheet multiplied by the number of simultaneously processed light-sensitive elements.

Such a continuous web is preferably supplied from a feeding roll and wound on a winding roll to be discarded. When the light-sensitive elements are particularly large, the discarding is easy.

As described above, by making the inhibiting process sheet in the form of a continuous web, handling ability improves markedly.

The thickness of the support used for the above-described inhibiting process sheet is not restricted, however, thinner is preferable, and from 4 μm to 120 μm is particularly preferred. It is most preferable that the thickness of the support is not more than 40 μm, as in this case, since the amount of the inhibiting process sheet per unit volume is large, the above-described roll of the inhibiting process sheet can made compact.

The raw material of the support is not particularly restricted, and materials which can endure processing temperature are used. In general, there are listed supports for photograph use such as the paper described in "Fundamentals of Photographic Engineering—Edition for Silver Salt Photography—" Edited by Photographic society of Japan, published by Corona K. K. (1979) (pp. 223 to 240), synthetic polymers (films) and the like.

The raw material for the support may be used alone, or material which is coated or laminated on one or both surfaces with a synthetic polymer such as polyethylene and the like can also be used.

In addition, support described in Japanese Patent Application Laid-Open (JP-A) Nos. 62-253159, pp. (29) to (31), 1-161236, pp. (14) to (17), 63-316848, 2-22651, 3-56955, U.S. Pat. No. 5,001,033 and the like can be used.

Preferably, a support composed of a styrene-based polymer having a mainly syndiotactic structure can be used.

On the surface of the support, a hydrophilic binder and a semi-conductive metal oxide such as alumina sol and tin oxide, carbon black and another antistatic agent may be coated. Preferably a support on which aluminum is vapor-deposited can be used.

To accelerate the diffusion and reaction of the compound which inhibits a dye forming reaction, a thermal solvent may be added. The examples thereof are described in U.S. Pat. Nos. 3,347,675 and 3,667,959, Japanese Patent Application Publication (JP-B) Nos. 1-40974 and 4-13701. Specifically, amide derivatives (benzamide and the like), urea derivatives (methylurea, ethyleneurea and the like), sulfoneamide derivatives, polyols, saccharides and ethylene glycols are listed. The above-described thermal solvent may be used alone or in combination. The thermal solvent may be added either to the light-sensitive element or the inhibiting process sheet. The amount added of the thermal solvent is from 10% by weight to 500% by weight based on the weight of the layer to which the solvent is added.

In the process to inhibit a dye forming reaction, the processing temperature is from room temperature to 200° C., and the processing time is from 5 seconds to 60 seconds.

Further, to accelerate diffusion and reaction of the compound which inhibits a dye forming reaction, it is preferable to conduct the processing in the presence of a solvent. The specific examples thereof are described in U.S. Pat. Nos. 4,704,245 and 4,470,445 and Japanese Patent Application Laid-Open (JP-A) No. 61-238056. In this method, the heating temperature is preferably not more than the boiling point of the solvent used.

As this solvent, a basic aqueous solution containing water, an inorganic base and an organic base (which is described in the paragraph below on processing elements for heat developing), a low boiling point organic solvent, or a mixture of a low boiling solvent and either water or the above-described basic aqueous solution is used.

As this solvent used in the processing which inhibits a dye forming reaction, water is preferably used. It is also possible that the processing step which inhibits a dye forming reaction is conducted directly after the heat development, and water remaining in the light-sensitive element is utilized, however, it is preferable that water is supplied directlybefore the inhibiting processing, and the light-sensitive element the inhibiting process element are laminated such that the light-sensitive layer faces processing layer and the elements are heated, in the presence of water in an amount corresponding to 0.1 to 1-times the amount which is required for maximally swelling the total coated layers of the light-sensitive element and the processing element excluding the backing layers of the photosensitive element and the inhibiting process sheet.

There is a method for the supplying water, in which the light-sensitive element or the inhibiting process sheet is immersed in water, and then excess water is removed by a squeeze roller. However, it is preferable that water in just the amount required for coating is supplied to the light-sensitive element or the inhibiting process sheet. A method is particularly preferable in which water is sprayed by a water spraying apparatus which has a plurality of nozzles, which are arranged in straight line along a direction perpendicular to the transporting direction of the light-sensitive element or inhibiting process sheet, so that the nozzle ejects spray water at a constant distance, and an actuator which defects the above-described nozzle toward the light-sensitive element or the inhibiting process sheet on the transporting path. A simple apparatus which coats water by sponge and the like is preferably used. The same method as that described below in the heat developing processing can be used as the water supplying method. Further, the same method as that of the heat development may be repeated, and a different water supplying method may be used. The temperature of the water to be supplied is preferably from 30° C. to 60° C.

As examples of the method for laminating the light-sensitive element and the inhibiting process sheet after heat-development are the methods described in Japanese Patent Application Laid-Open (JP-A) Nos. 62-253159 and 61-147244.

(Explanation of silver halide stabilization processing)

The light-sensitive element after development step may also be subjected to silver halide stabilization processing. The above-described inhibiting processing which inhibits a dye forming reaction and the silver halide stabilization processing can be conducted in any order or may be conducted simultaneously. When the silver halide stabilization processing is conducted prior to the processing which inhibits a dye forming reaction after heat development, the silver halide stabilization processing can be conducted simultaneously with the heat development.

The silver halide stabilization processing may be a process which prevents printout of the silver halide or a process in which a developing stopper acts, and a part or all of a dissolved salt of the silver halide may be dissolved in a silver halide solvent, and further, it maybe a fixing process in which a part or all of the dissolved salt of a silver complexing agent salt is removed from the light-sensitive element. A combination of these processes may also be possible.

The developing stopper is a compound which quickly neutralizes a base or reacts with a base, after the light-sensitive element has properly been developed, for lowering base concentration in a layer to stop developing, or a compound which react mutually with silver or a silver salt to inhibit development. Specifically, an acid precursor which releases an acid upon heating, an electrophilic compound which reacts with a existing base upon heating, or a nitrogen-containing heterocyclic compound, mercapto compound and precursor thereof are listed. More particularly descriptions are found in Japanese Patent Application Laid-Open (JP-A) No. 62-190529 pp. 31 to 32.

Examples of the printout preventing agent include halogen compounds described in Japanese Patent Application Publication (JP-B) No. 54-164, Japanese Patent Application Laid-Open (JP-A) Nos. 53-46020 and 48-45228 and Japanese Patent Application Publication (JP-B) No. 57-8454, 1-phenyl-5-mercaptotetrazole compounds described in British Patent No. 1,005,144, viologen compounds described in Japanese Patent Application Laid-Open (JP-A) No. 8-184936.

As the silver halide solvent, a known agent can be used. Examples thereof which are preferably used include thiosulfates, sulfites, thiocyanates, thioether compounds described Japanese Patent Application Publication (JP-B) No. 47-11386, 5 or 6-membered compounds having an imide group such as uracil, hydantoin described in Japanese Patent Application Laid-Open (JP-A) No. 8-179458, compounds having a carbon-sulfur double bond described in Japanese Patent Application Laid-Open (JP-A) No. 53-144319, and mesoion thiolate compounds such as trimethyltriazolium thiolate and the like described in Analytica Chimica Acta vol. 248, pp. 604 to 614 (1991). As the silver halide solvent, there can also be used a compound which can fix a silver halide for stabilization described in Japanese Patent Application Laid-Open (JP-A) No. 8-69097.

The silver halide solvent may be used alone, and it is also preferable to use a plurality of silver halide solvents in combination.

In the silver halide stabilization processing, a light-sensitive element after heat-development may be immersed in a processing solution containing a stabilizing agent for a silver halide, however, a processing method in which a processing sheet (hereinafter, referred to as "silver halide stabilization process sheet") containing a stabilizing agent for a silver halide is laminated on a light-sensitive element after a heat development is preferred from the view point of prevention of environmental pollution from processed waste solution. The former method using a processing solution can be applied as the fixing solution processing step used in the heat development step of a usual silver halide color light-sensitive element. Regarding the latter processing method, the same method as that described in the process which inhibits a dye forming reaction can be applied.

The silver halide stabilization process sheet can be produced in the same manner as that for the production of a inhibiting process sheet described in the process for inhibiting a dye forming reaction.

When a developing stopper is used, the amount used of the developing stopper used in the processing layer is from $10^{-4}$ to 10 mol/l mol of Ag, and preferably from $10^{-3}$ to 1 mol/1 mol of Ag based on the amount of coated silver on the light-sensitive element.

When the printout preventing agent is used, the amount used of the printout preventing agent used in the processing layer is from $10^{-4}$ to 1 mol/1 mol of Ag, and preferably from $10^{-3}$ to $10^{-2}$ mol/1 mol of Ag based on the amount of coated silver on the light-sensitive element.

The content of the total silver halide solvents in a processing layer is from 0.01 to 100 mmol/$m^2$, and preferably from 0.1 to 50 mmol/$m^2$. It is from 1/20 to 20-times, preferably from 1/10 to 10-times, and more preferably from 1/4 to 4-times in terms of molar ratio, based on the amount of coated silver on a light-sensitive element.

The developing stopper, printout preventing agent and silver halide solvent may be added as a solution in a solvent such as water, methanol, ethanol, acetone, dimethylformaldehyde, methylpropyl glycol and the like or an alkaline or acidic aqueous solution, or may be dispersed as a solid fine particle and added to a coating solution.

Further, it may be possible that a physical developing nucleus and a silver halide solvent are contained in the silver halide stabilization process sheet and a silver halide of a light-sensitive element is solubilized and fixed on a silver halide stabilization process sheet processing layer.

As the reducing agent required for physical development, any which is known in the field of light-sensitive element can be used. Further, a reducing agent precursor, which manifests reducing properties by the action of a nucleophilic reagent or heat, although it has no reducing properties itself can also be used. As the reducing agent, a developing agent diffused from a light-sensitive element and which has not been used for developing in the light-sensitive element, or else a reducing agent previously contained in the silver halide stabilization process sheet can be utilized. In the latter case, the reducing agent which is previously contained in the silver halide stabilization process sheet may be the same agent as that contained in the light-sensitive element or may be different.

As examples of the reducing agent used in the present invention, reducing agents and reducing agent precursors described in U.S. Pat. No. 4,500,626, columns 49 to 50, U.S. Pat. No. 4,483,914, columns 30 to 31, U.S. Pat. Nos. 4,330,617 and 4,590,152, Japanese Patent Application Laid-Open (JP-A) Nos. 60-140335, pp. 17 to 18, 57-40245, 56-138736, 59-178458, 59-53831, 59-182449, 59-182450, 60-119555, 60-128436 to 60-128439, 60-198540, 60-181742, 61-259253, 62-244044, 62-131253 to 62-131256, European Patent No. 220746A2, pp. 78 to 96, and the like can be used.

Further, a combination of various reducing agents described in U.S. Pat. No. 3,039,869 can also be used.

When a nondiffusing type agent is used, an electron transfer agent and/or a precursor of an electron transfer agent may be optionally used in combination where necessary. The electron transfer agent or precursor thereof can be selected from the above-described reducing agents or precursors thereof.

The amount added of the reducing agent when added to the silver halide stabilization processing sheet is from 0.01 to 10 g/$m^2$, and preferably from 1/10 to 5-times of the mole of silver in the light-sensitive element.

The physical development nucleus is a material which reduces a soluble silver salt diffused from a light-sensitive element to convert it to physical development silver, and fixes this onto a processing layer of the silver halide stabilization processing sheet. As this physical development nucleus, there can be used all known materials such as colloid particle and the like of heavy metal such as zinc, mercury, lead, cadmium, iron, chromium, nickel, tin, cobalt, copper, ruthenium and the like, noble metal such as palladium, platinum, gold, silver and the like, and chalcogen compounds of these heavy meals and noble metals with sulfur, selenium, tellurium and the like.

The size of these physical development nuclei are preferably from 2 to 200 nm in particle diameter.

These physical development nuclei are contained in the silver halide stabilization process sheet in an amount from $10^{-3}$ mg to 10 g/m$^2$.

(Explanation of the silver halide bleaching process)

The light-sensitive element after the development step may be subjected to a bleaching process. The bleaching process may be conducted simultaneously with the inhibiting process, or may be conducted simultaneously with the fixing during heat developing (bleach-fering fixing process), or may be conducted simultaneously with the inhibiting process and the fixing process, or may be conducted separately. These process can be conducted in any order, and the combination of the processes conducted simultaneously can be optionally selected and can be conducted in any order. For example, in order to increase the speed of the processing, a method whereby the bleach-fixing processing is carried out after the bleaching processing, and then the inhibiting processing is carried out, can be used, or a method whereby both the inhibiting and fixing processing are carried out after the bleaching processing can be used.

For the bleaching process, the light-sensitive element may be immersed into a bleaching solution containing a bleaching agent after heat-development, however, the processing method, in which a processing sheet (hereinafter, referred to as "bleaching process sheet") containing a bleaching agent is laminated onto a light-sensitive element after heat development, is preferred from the view point of prevention of environmental pollution from the processed waste solution. In the case of the processing method using a bleaching agent, the method described in Japanese Patent Application Laid-Open (JP-A) No. 7-152129, pp. 86 to 87, paragraph Nos. 0281 to 0284 can be used.

The bleaching process sheet can be produced in the same manner as the inhibiting process sheet described in the inhibiting process of a dye forming reaction, and can be used in the same manner.

As the bleaching agent, for example, a polyvalent metal compound such as iron (III), peracids, quinones, nitro compounds and the like are used. As the typical bleaching agent, an organic complex salt of iron (III) can be used, for example, a complex salt of aminopolycarboxylic acids such as ethylenediamine tetraacetic acid, diethylenetriamine pentaacetic acid, cyclohexanediamine tetraacetic acid, methylimino diacetic acid, 1,3-diaminopropane tetraacetic acid, glycol ether diamine tetraacetic acid and the like, or complex salts of citric acid, tartaric acid, malic acid and the like. Among these, an iron (III) aminopolycarboxylate complex salt such as iron (III) complex salt of ethylenediamine tetraacetic acid, iron (III) complex salt of 1,3-diaminopropane tetraacetic acid and the like is preferable from the viewpoint of quick processing. The iron (III) complex salt of aminopolycarboxylic acid complex salt is particularly useful also in a bleaching process and bleach-fixing process.

The pH value in the bleaching process and bleaching fixing process using the iron (III) complex salt of aminopolycarboxylic acid is usually from 4 to 8, however, the process can be conducted at an even lower pH from the viewpoint of quick processing.

As the bleaching accelerator and/or bleaching stain preventing agent, compounds described in Japanese Patent Application Laid-Open (JP-A) No.7-152129, pp. 86 to 87 can also be used. The bleaching accelerator may also be added into a light-sensitive element and heat development process sheet, and may be used for a processing solution or processing element used for the bleaching process and the bleaching fixing process.

In the present invention, the method for outputting on other material based on the image information may be that used in normal projection exposure, or the image information based on the density obtained by measuring transmitted light and may be outputted according to the signal thereof. The material to which the signals are outputted may be material other than the light-sensitive element, and for example, may also be a sublimation-type heat-sensitive recording material, ink jet material, electrophotographic material, full color direct heat sensitive recording material and the like.

It may also be permissible that image information is read photoelectrically by measuring the transmission density using a CCD image sensor and diffuse light, that information being then converted to a digital signal, then the image photographed is freely modified, deformed and processed by optional processing and editing of the digital signal.

The silver halide which can be used in the present invention may be any of silver iodobromide, silver chloroiodobromide, silver bromide, silver chlorobromide, silver iodo chloride and silver chloride. The composition of these compounds is selected according to the properties to be imparted to the light-sensitive silver halide. For example, when high sensitivity is required as is the case for photographing materials, a silver iodo bromide emulsion is mainly used. Further, in a print material in which rapidness and simplicity of the development step are regarded as important, silver chloride is often used. However, recently, trials have been reported in which the use of silver chloride has been investigated for the purpose of rapid processing of the photographing material.

The size of the silver halide grains making up the light-sensitive emulsion is from 0.1 to 2 $\mu$m, particularly preferred are from 0.2 to 1.5 $\mu$m in terms of the diameter of spheres having the same volume. The form of the silver halide grains can be optionally selected from a normal crystal form such as cube, octahedron or tetradecahedron, irregular form such as sphere, or hexagonal or rectangular form and the like. In photographing materials, it is preferable to use tabular grains having what is called a high aspect ratio in which the ratio of the projection area diameter to the grain thickness is large in order to impart a high sensitivity to the grains. The aspect ratio represents a quotient obtained by dividing the diameter of a circle having an equivalent area to the projected area of a grain by the thickness of the grain. The silver halide emulsion used for photographing materials is a tabular grain having an aspect ratio of preferably not less than 2, more preferably not less than 5, further preferably not less than 8, and most preferably not less than 20, and occupies not less than 50%, preferably not less than 80%, and further preferably not less than 90% of the projected area of the total grains in the emulsion. A grain of small size (not more than about 0.5$\mu$ in terms of the diameter of a sphere of corresponding volume) preferably has a tabularity degree, which is obtained by dividing the aspect ratio by the thickness of the grain, of not less than 25.

The spectral sensitivity rate can be increased by raising the aspect ratio, since then a larger projection area can be obtained at the same volume. Further, when photographic sensitivity is in proportion to the grain projection area, the amount of silver halide required to obtain the same sensitivity can be reduced. On the other hand, when the grains are prepared while keeping the grain projection area constant, it becomes possible to increase the number of grains by raising the aspect ratio even if the same amount of silver halide is used, and in addition, granularity can be improved. When grains having an even higher aspect ratio are used, sharpness can be enhanced since the amount of the scattered light component having a higher scattering angle to the incident light path decreases.

The techniques for use and properties of these tabular grains having a high aspect ratio are disclosed in U.S. Pat. Nos. 4,433,048, 4,434,226, 4,439,520 and the like. Further, techniques regarding ultra high aspect ratio tabular grains having a thickness of less than 0.07 $\mu$m are described in U.S. Pat. Nos. 5,494,789, 5,503,970, 5,503,971 and 5,536,632, European Patent Nos. 0699945, 0699950, 0699948, 0699944, 0701165 and 0699946. The high aspect ratio tabular grains described in these publications are composed mainly of silver bromide and silver iodo bromide, and contain a large proportion of hexagonal tabular grains in which the main plane constitutes a (111) surface. Grains having such a configuration usually contain two twin crystal surfaces parallel to the (111) surface in the interior of the grains. To prepare high aspect ratio tabular grains having a thin grain thickness, it is a technical point to make the clearance between these two twin crystal surfaces narrow. Therefore, it is important to control the binder concentration, temperature, pH, types of excess halogen ion and ion concentrations thereof, and the supplying rate of the reaction solution and the like when forming the nucleus of the grain. It is also an important point in forming a high aspect ratio tabular grain that growth of the tabular nucleus thus formed occurs not in the direction of thickness of the grain but preferentially in the direction of its circumference. Therefore, it is also important to select the optimum compound as the binder used during the period from grain formation to the growth process, and at the same time to control the rate of addition of reaction solution for grain growth. There is a description in the above-described publications of how gelatin, having a low methionine content, increases the high aspect ratio.

On the other hand, there is also disclosed a technique to form tabular grains using silver halide having high silver chloride content. For example, techniques concerning tabular grains having a high silver chloride content having a (111) surface as the main plane are described in U.S. Pat. Nos. 4,400,463, 4,713,323 and 5,217,858, European Patent Nos. 0423840 and 0647877, and the like.

On the other hand, techniques concerning a high silver tabular grain having a high silver chloride content having a (100) surface as the main plane ar e described in U.S. Pat. Nos. 5,264,337, 5,292,632, 5,310,635 and 5,275,932, European Patent Nos. 0534395 and 0617320, WO 94/22054, and the like. Any of these techniques is a useful technique for preparing a high sensitive emulsion using silver chloride with excellent developing speed and optical properties.

The silver halide grains are prepared s o that they contain various structures in the grain a s well being devised with the configuration as described above. The method usually used is one in which the grains are made so that a plurality of layers each having a different halogen composition are formed. In the case of silver iodobromide grains used for photographing materials, it is preferable that layers each having a different iodine content are formed. A so-called inner high iodine type core-shell grain is known in which a nucleus having a high iodine content core is covered with a shell having a low iodine content in order to control the developing properties. Further, a outer high iodine type core-shell grain, having the opposite structure to the above, in which the nucleus is covered with a shell having a higher iodine content is also known. This structure is effective at enhancing the stability of the configuration when the grain thickness of the tabular grains decreases. A technique is also known for imparting high sensitivity by covering a nucleus, having a low iodine content, with a first shell having a high iodine content, and by depositing a second shell, also having a low iodine content, thereon. In this type of silver halide grain, a dislocation, based on a crystalline disorder, is formed on the shell (corresponding to the fringe part of the grain outer periphery in a tabular grain) deposited on the layer having a high iodine content, allowing high sensitivity.

Further, to obtain high sensitivity, there is also preferably used a technique in which crystals, having different halogen compositions, are grown in epitaxial fashion, in a localized part of the formed host grain. For example, a technique is known in which crystals, having a high iodine content, are grown in epitaxial fashion at apart (vertex, ridge, or surface of the grain) of the surface of host grains having a high silver bromide content. In opposite fashion to this, the technique whereby a crystal (for example, a crystal containing a high level of silver chloride), is made to grow epitaxially on a silver bromide or silver iodiobromide host grain, with a lower solubility level than the crystal, is also known. The latter technique is preferably used for imparting high sensitivity to tabular grains having a particularly thin grain thickness.

Additionally, in a high silver chloride content tabular grain, which contain a high level of silver chloride, it is preferable that a localized layer, containing a high level of silver bromide and silver iodide is formed inside and on the outer surface of the grains. In particular, it is preferable that these localized layers are grown epitaxially on the vertices and ridges of the gain surfaces. These epitaxial crystal portions work as an effective light-sensitive nucleus forming site, giving high sensitivity.

It is also preferable that doping of a metal salt or a metal complex salt into a grain for the purpose of improving photographic properties of the light-sensitive silver halide emulsion is carried out. These compounds act as a transient or permanent trap for an electron or hole in a silver halide crystal, and are effective for obtaining high sensitivity and high contrast, for improving illuminance dependence in exposure, suppressing environmental (temperature, humidity) dependence in exposure, and for controlling the changes in performance caused by the application of pressure before and after exposure. For these dopants, various methods can be selected according to the objective, such as uniform doping into the silver halide grains, localized doping into a specific part inside a grain, localized doping on the sub-surface or surface, localized doping into the above-described epitaxial crystal part, and the like.

Examples of preferable metals include the first to third group transition metal elements such as iron, ruthenium, rhodium, palladium, cadmium, rhenium, osmium, iridium, platinum and the like, and amphoteric metal elements such as thallium, lead and the like. These metal ions are doped in the form of a suitable salt or complex salt. Among these, preferably a 6-coordinated halogen complex and cyano complex in which a halide ion or cyanide ion as a ligand is used. Further, complexes having an organic ligand such as a nitrosyl ligand, carbonyl ligand, thiocarbonyl ligand, dinitrogen ligand, bipyridyl ligand, cyclopentadienyl ligand, 1,2-dithiolenyl ligand and the like can also be used. The techniques are described in Japanese Patent Application Laid-Open (JP-A) Nos. 2-236542 and 1-116637, Japanese Patent Application Laid-Open (JP-A) No. 5-181246 and the like.

Further, preferably doping of a divalent anion of what are called the chalcogen elements, such as sulfur, selenium and tellurium, is carried out. These dopants are also useful for obtaining high sensitivity and improving exposure condition dependence.

Regarding the preparation method of the silver halide gains which can be used in the present invention, known methods, namely methods described in P. Glafkides, Chimie et Phisique Photographique, Paul Montel, 1967, G. F. Duffin, Photographic Emulsion Chemistry, Focal Press, 1966, V. L. Zelikman et al., Making and Coating of Photographic Emulsion, Focal Press, 1964, and the like can be used as a basic method. Namely, the grain can be prepared in various pH regions such as by the acidic process, the neutral process, the ammonia process and the like. As a means of supplying a reaction solution of a water-soluble silver salt and a reaction solution of a water-soluble halogen salt, a single jet method, a double jet method and the like can be used alone or in combination. Further, it is also preferable that a controlled double jet method, in which the addition of a reaction solution is controlled so as to keep the pAg at the intended value during the reaction is used. Further, a method is also used in which the pH value during the reaction is kept constant. In forming grains, a method in which the solubility of the silver halide is controlled by changing the system temperature, the pH or the pAg can be used, however, thioether, thioureas, rhodan salt and the like can also be used as a solvent. The examples thereof are described in Japanese Patent Application Publication (JP-B) No. 47-11386 and Japanese Patent Application Laid-Open (JP-A) No. 53-144319.

The preparation of the silver halide grains which can be used in the present invention is usually conducted by supplying a solution of water-soluble silver salt such as silver nitrate and a solution of a water-soluble halogen salt such as an alkali halide into a solution in which a water-soluble binder such as gelatin is dissolved, under controlled conditions. After the silver halide grain is formed, it is preferable to remove excess water-soluble salts. This process is called a desalting process or water-washing process, and various means are used. For example, a Noodle water-washing method may also be used in which a gelatin solution containing silver halide grains is gelled, cut into the shape of string, and the water-soluble salts then washed away by cold water. There is also a flocculation method in which inorganic salts (for example, sodium sulfate), anionic surfactants, anionic polymers (for example, sodium polystyrenesulfonate) comprising a polyvalent anion, or a gelatin derivative (for example, aliphatic acylated gelatin, aromatic acylated gelatin, aromatic carbamoylated gelatin and the like) are added to flocculate the gelatin and remove excess salts. The flocculation method is preferred as the removal of excess salts is carried out quickly.

In the present invention, it is usually preferable to use a silver halide emulsion which is subjected to chemical sensitization. The chemical sensitization contributes to imparting the prepared silver halide grains to high sensitivity, and to exposure condition stability and preservation stability. For the chemical sensitization, sensitizing methods which are generally known can be used alone or in various combinations.

As the chemical sensitizing method, a chalcogen sensitizing method using a sulfur, selenium or tellurium compound is preferably used. As the sensitizing agent for these methods, a compound, which releases the above-described chalcogen element to form a silver chalcogenide when added to the silver halide emulsion, is used. Further, it is also preferable to use these compounds together to obtain high sensitivity and to keep fogging to low levels.

Further, a noble metal sensitizing method using gold, platinum, iridium and the like is also preferable. In particular, a gold sensitizing method in which chloroauric acid is used alone, or together with a thiocyanate ion which is a ligand of gold, gives high sensitivity. When the gold sensitizing and chalcogen sensitizing are used together, even high sensitivity can be obtained.

Further, a so-called reduction sensitizating method, in which a reduction silver nucleus is introduced by using a compound having suitable reducing properties during grain formation, to obtain high sensitivity is also preferably used. A reduction sensitizing method, in which an alkenylamine compound having an aromatic ring is added during chemical sensitization is also preferable.

Control of reactivity, using various compounds having adsorptivity to the silver halide grains, is preferably conducted during chemical sensitization. In particular, a method in which a nitrogen-containing heterocyclic compound and mercapto compound, sensitizing dyes of cyanines and merocyanines are added prior to the chalcogen sensitization or gold sensitization, is particularly preferable.

Although the reaction conditions when the chemical sensitization is performed differ depending on the objective, the temperature is between 30° C. and 95° C., and preferably between 40° C. and 75° C., the pH is between 5.0 and 11.0, and preferably between 5.5 and 8.5, and the pAg is between 6.0 and 10.5, and preferably between 6.5 and 9.8.

The chemical sensitizing technique is described in Japanese Patent Application Laid-Open (JP-A) No. 3-110555, Japanese Patent Application Laid-Open (JP-A) No. 5-241267, Japanese Patent Application Laid-Open (JP-A) Nos. 62-253159, 5-45833, 62-40446 and the like.

In the present invention, it is preferable to perform so-called spectral sensitization, which gives sensitivity in the desired light wavelength region to the light-sensitive silver halide emulsion. In particular, in color photographic light-sensitive elements, light-sensitive layers having light-sensitivity in blue, green and red regions, respectively, are introduced to perform exact color reproduction corresponding to the original. This light-sensitivity is provided by spectral sensitization of the silver halide. In the spectral sensitization, a so-called spectral sensitizing dye, which is absorbed by the silver halide grains gives sensitivity in its own absorption wavelength region.

Examples of these dyes include a cyanine dye, merocyanine dye, complex cyanine dye, complex merocyanine dye, holopolar dye, hemicyanine dye, styryl dye, hemioxonol dye and the like. The examples thereof are described in U.S. Pat. No. 4617257, Japanese Patent Application Laid-Open (JP-A) Nos. 59-180550, 64-13546, 5-45828, 5-45834 and the like.

The spectral sensitizing dyes are used in combination as well as alone. These dyes are used for controlling the wavelength distribution of the spectral sensitivity and for supersensitization. By a combination of dyes exhibiting supersensitization effect, sensitivity markedly greater than the sum of the sensitivities attained when the dyes are used alone, can be obtained.

Further, it is also preferable to use together dyes having no spectral sensitizing effect themselves or compounds which do not substantially absorb visible light and exhibit supersensitizing effect. Diaminostilbene compounds and the like are listed as examples of a supersensitizing dye. The examples thereof are described in U.S. Pat. No. 3615641, Japanese Patent Application Laid-Open (JP-A) No. 63-23145 and the like.

The addition of these spectral sensitizing dyes and supersentizing dyes to the silver halide emulsion may be conducted in any period of time in emulsion preparation. various methods such as addition while preparing a coating solution for an emulsion which has completed chemical sensitization, addition when chemical sensitization is completed, addition during chemical sensitization, addition prior to chemical sensitization, addition before desalting after completion of grain formation, addition during grain formation, addition prior to grain formation and the like can be used alone or in combination. It is preferable, to obtain high sensitivity, to conduct addition in a process before chemical sensitization.

The amounts added of the spectral sensitizing dye and supersensitizing dye differ depending on the form and size of the grains, and on the photographic characteristics to be imparted, however, in general, the amounts range from $10^{-8}$ to $10^{-1}$ mol, and preferably from $10^{-5}$ to $10^{-2}$ mol per one mol of a silver halide. These compounds can be added in the form of a solution in an organic solvent such as methanol, fluorinated alcohol and the like, or in the form of a dispersion in water together with a surfactant and gelatin.

It is preferable to add various stabilizing agents to the silver halide emulsion to prevent fogging and increase stability in preservation. Examples of preferable stabilizing agents include nitrogen-containing heterocyclic compounds such as azaindenes, triazols, tetrazols, purines and the like, mercapto compounds such as mercapto tetrazols, mercapto triazols, mercapto imidazols, mercapto thiodiazols, and the like. The details thereof are described in T. H. James, The Theory of the Photographic Process, Macmillan, 1977, pp. 396 to 399 and cited references therein.

The addition of these anti-fogging agent agents and stabilizers to the silver halide emulsion may be conducted at any period of time in emulsion preparation. Various methods such as addition while preparing a coating solution for an emulsion which has completed chemical sensitization, addition when chemical sensitization is completed, addition during chemical sensitization, addition prior to chemical sensitization, addition before desalting after completion of grain formation, addition during grain formation, addition prior to grain formation and the like can be used alone or in combination.

The amount added of the anti-fogging agent or stabilizer differs depending on the halide composition of the silver halide emulsion and the objectives, however, in general the range from $10^{-6}$ to $10^{-1}$ mol, and preferably from $10^{-5}$ to $10^{-2}$ mol per one mol of a silver halide.

The photographic additives used in light-sensitive elements which can be used in the present invention as described above are described in Research Disclosure (hereinafter, abbreviated as RD) No. 17643 (December, 1978), No. 18716 (November, 1979) and No. 307105 (November, 1989), and the corresponding parts thereof are summarized below.

| Kind of additive | RD17643. Page No. | RD18716. Page No | RD307105 Page No |
|---|---|---|---|
| 1) Chemical sensitizing dye | 23 | 648 right column | 866 |
| 2) Sensitivity improving agent | | 648 right column | |
| Spectral sensitizing dye | 23 to 24 | 648 right column | 866 to 868 |

-continued

| Kind of additive | RD17643. Page No. | RD18716. Page No | RD307105 Page No |
|---|---|---|---|
| 3) Supersensitizing dye | | to 649 right column | |
| 4) Bleaching agent | 24 | 648 right column | 868 |
| 5) Anti-fogging agent | 24 to 26 | 649 right column | 868 to 870 |
| 6) Light absorbing agent Filter dye Ultraviolet-ray absorber | 25 to 26 | 649 right column to 650 left column | 873 |
| 7) Dye image stabilizer | 25 | 650 left column | 872 |
| 8) hardener | 26 | 651 left column | 874 to 875 |
| 9) Binder | 26 | 651 left column | 873 to 874 |
| 10) Plasticizer, lubricant | 27 | 650 right column | 876 |
| 11) Coating aid Surfactant | 26 to 27 | 650 right column | 875 to 876 |
| 12) Artistatic agent | 27 | 650 right column | 876 to 877 |
| 13) Matting agent | | | 878 to 879 |

The amount of silver in the light-sensitive silver halide used in the light-sensitive element is from 0.05 to 20 g/m$^2$, and preferably from 0.1 to 10 g/m$^2$.

In the present invention, an organic metal salt can also be used as the oxidizing agent together with the light-sensitive silver halide. In these organic metal salts, an organic silver salt is particularly preferably used.

As an organic compound which can be used for forming the aforementioned organic silver salt oxidizing agent, benzotriazols, fatty acids and other compounds described in U.S. Pat. No. 4,500,626, columns 52 to 53 and the like may be used. Further, silver acetylide described in U.S. Pat. No. 4,775,613 is also useful. The organic silver salt may be used in a combination of two or more kinds.

The aforementioned organic silver salts can be used in an amount from 0.01 to 10 mol, and preferably from 0.01 to 1 mol per one mol of the light-sensitive silver halide.

A hydrophilic binder is preferably used as the binder for the structural layers of the light-sensitive elements. Examples thereof include those described in the aforementioned RD and Japanese Patent Application Laid-Open (JP-A) No. 64-13546, pp. 71 to 75. Specifically, a transparent or translucent hydrophilic binder is preferred, and the examples thereof include natural compounds such as proteins such as gelatin, gelatin derivative and the like or polysaccharides such as cellulose derivative, starch, gum arabic, dextran, pullulan and the like, and synthetic polymer compounds such as polyvinyl alcohol, modified polyvinyl alcohol (for example, terminal alkyl modified Poval MP103, MP 203 and the like manufactured by Kuraray Co., Ltd.), polyvinylpyrrolidone, acrylamide polymer and the like. Further, high water-absorbing polymers described in U.S. Pat. No. 4,960,681, Japanese Patent Application Laid-Open (JP-A) No. 62-245260 and the like, namely, homopolymers of a vinyl monomer having —COOM or —$SO_3$M (M represents a hydrogen atom or alkali metal), or copolymers of this vinyl monomer, or copolymers of this monomer with other vinyl monomers (for example, sodium methacrylate, ammonium methacrylate, Sumika Gel L-5H manufactured by Sumitomo Chemical Co., Ltd.) are also used. These binders can be used in combination of two or more. In particular, the combination of gelatin with the above-described binder is preferable. The gelatin may be selected from lime-processed gelatin, acid-processed gelatin, and so-called delimed gelatin in which the content of calcium and the like is reduced, depending on the objective, and it is also preferable to use them in combination.

In the present invention, it is appropriate that the amount coated of the binder is from 1 to 20 g/m$^2$, preferably from 2 to 15 g/m$^2$, and more preferably from 3 to 12 g/m$^2$. In this binder, the gelatin is used in a proportion from 50% to 100%, and preferably from 70% to 100%.

As the color developing agent, p-phenylenediamines or p-aminophenols may be used, however, preferably, the compounds represented by the aforementioned general formulae (1) to (5) are used.

The compounds represented by the general formula (1) are generically called sulfoneamidophenol.

In the general formula, $R_1$ to $R_4$ each represents independently a hydrogen atom, a halogen atom (e.g., chlorine atom and bromine atom), an alkyl group (e.g., methyl group, ethyl group, isopropyl group , n-butyl group and t-butyl group) an aryl group (e.g., phenyl group, tolyl group and xylyl group), an alkylcarbonamido group (e.g., acetylamino group, propionylamino group, and butyloylamino group), an arylcarbonamide group (e.g., benzoylamino group), an alkylsulfonamido group (e.g., methanesulfonylamino group and ethanesulfonylamino group), an arylsulfonamide group (e.g., benzenesulfonylamino group and toluenesulfonylamino group), an alkoxy group (e.g., methoxy group, ethoxy group and butoxy group), an aryloxy group (e.g., phenoxy group), an alkylthio group (e.g., methylthio group, ethylthio group and butylthio group), an arylthio group (e.g., phenylthio group and tolylthio group), an alkylcarbamoyl group (e.g., methylcarbamoyl group, dimethylcarbamoyl group, ethylcarbamoyl group, diethylcarbamoyl group, dibutylcarbamoyl group, piperidylcarbamoyl group and morpholylcarbamoyl group), an arylcarbamoyl group (e.g., phenylcarbamoyl group, methylphenylcarbamoyl group, ethylphenylcarbamoyl group and benzylphenylcarbamoyl group), a carbamoyl group, alkylsulfamoyl group (e.g., methylsulfamoyl dimethylsulfamoyl, ethylsulfamoyl, diethylsulfamoyl, dibutylsulfamoyl, piperidylsulfamoyl and morpholylsulfamoyl group), an arylsulfamoyl group (e.g., phenylsulfamoyl group, methylphenylsulfamoyl group, ethylphenylsulfamoyl group and benzylphenylsulfamoyl group), a sulfamoyl group, a cyano group, an alkylsulfonyl group (e.g., methanesulfonyl group and ethanesulfonyl group), an arylsulfonyl group (e.g., phenylsulfonyl group, 4-chlorophenylsulfonyl group and p-toluenesulfonyl group), an alkoxycarbonyl group (e.g., methoxycarbonyl group, ethoxycarbonyl group and butoxycarbonyl group), an aryloxycarbonyl group (e.g., phenoxycarbobyl group), an alkylcarbonyl group (e.g., acetyl group, propionyl group and butyloyl group), an arylcarbonyl group (e.g., benzoyl and alkylbenzoyl group), or an acyloxy group (e.g., acetyloxy group, propionyloxy groupand butyloyloxy group). Among $R_1$ to $R_4$, $R_2$ and $R_4$ preferably represent a hydrogen atom. It is preferable that the total value of Hammett's constants ($\sigma p$) of substituents thereof is not less than 0.

$R_5$ represents an alkyl group (e.g., methyl ethyl, butyl, octyl group, lauryl group, cetyl group and stearyl group), an aryl group (e.g., phenyl group, tolyl group, xylyl group, 4-methoxyphenyl group, dodecylphenyl group, chlorophenyl group, trichlorophneyl group, nitrochlorophenyl group, triisopropyphenyl group, 4-dodecyloxyphenyl groupand 3,5-di-(methoxycarbonyl) group) or a heterocyclic group (e.g., pyridyl group).

The compounds represented by the general formula (2) are generically called sulfonylhydrazine. And the compounds represented by the general formula (4) are generically called carbamoylhydrazine.

In the general formulae (2) and (4), $R_5$ represents an alkyl group (for example, methyl group, ethyl group, butyl group, octyl group, lauryl group, cetyl group, stearyl group), an aryl group (e.g., phenyl group, tolyl group, xylyl group, 4-methoxyphenyl group , dodecylphenyl group, chlorophenyl group, dichlorophenyl group, trichlorophneyl group, nitrochlorophenyl , triisopropyphenyl, 4-dodecyloxyphenyl group and 3,5-di(methoxy)carbonyl group) or a heterocyclic group (e.g., pyridyl group). Z represents an atom group forming an aromatic ring. The aromatic ring formed by Z is required to be fully electron attractive to impart silver developing activity to the compound. Therefore, preferably an aromatic ring which forms a nitrogen-containing aromatic ring or an aromatic ring obtained by introducing an electron attractive group in a benzene ring are used. A pyridine ring, a pyradine ring, a pyrimidine ring, a quinoline ring, a quinoxaline ring, and the like are preferred as these types of rings.

When Z represents a benzene ring, examples of substituent thereof include an alkylsulfonyl group (e.g., methanesulfonyl group and ethanesulfonyl group), a halogen atom (e.g., chlorine atom and bromine atom), an alkylcarbamoyl group (e.g., methylcarbamoyl group, dimethylcarbamoyl group, ethylcarbamoyl group, diethylcarbamoyl group, dibutylcarbamoyl group, piperidylcarbamoyl group and morpholylcarbamoyl group), an arylcarmaboyl group (e.g., phenylcarbamoyl group, methylphenylcarbamoyl group, ethylphenylcarbamoyl group and benzylphenylcarbamoyl group), a carbamoyl group, an alkylsulfamoyl group (e.g., methylsulfamoyl group, dimethylsulfamoyl group, ethylsulfamoyl group, diethylsulfamoyl group, dibutylsulfamoyl group, piperidylsulfamoyl group and morpholylsulfamoyl group), an arylsulfamoyl group (e.g., phenylsulfamoyl group, methylphenylsulfamoyl group, ethylphenylsulfamoyl group and benzylphenylsulfamoyl group), a sulfamoyl group, a cyano group, an alkylsulfonyl group (e.g., methanesulfonyl group and ethanesulfonyl group), an arylsulfonyl group (e.g., phenylsulfonyl group, 4-chlorophenylsulfonyl group and p-toluenesulfonyl group), an alkoxycarbonyl group (e.g., methoxycarbonyl group, ethoxycarbonyl group and butoxycarbonyl group), an aryloxycarbonyl group (e.g., an phenoxycarbobyl group), an alkylcarbonyl group (e.g., acetyl group, propionyl group and butyloyl group), or an arylcarbonyl group (e.g., benzoyl group and alkylbenzoyl group). The total value of Hammett's constants ($\sigma$) of the above-described substituents is not less than 1.

The compounds represented by the general formula (3) are generically called sulfonylhydrazone. And the compounds represented by the general formula (5) are generically called carbamoylhydrazone.

In the general formulae (3) and (5), $R_5$ represents an alkyl group (e.g., methyl group, ethyl group, butyl group, octyl group, lauryl group, cetyl group and stearyl group), an aryl group (e.g., phenyl group, tolyl group, xylyl group, 4-methoxyphenyl group, dodecylphenyl group, chlorophenyl group, dichlorophenyl group, trichlorophneyl group, nitrochlorophenyl group, triisopropyphenyl group, 4-dodecyloxyphenyl group and 3,5-di(methoxy)carbonyl group) or a heterocyclic group (e.g., pyridyl group). $R_6$ represents a substituted or unsubstituted alkyl group (e.g., methyl group and ethyl group). X represents an oxygen atom, a sulfur atom, a selenium atom or a tertiary nitrogen atom substituted by an alkyl group or aryl group, and a tertiary nitrogen atom substituted by an alkyl group is preferable. $R_7$and $R_8$represent a hydrogen atom or substituent, $R_7$ and $R_8$ may bond each other to form a double bond or ring.

The specific examples of the compounds represented by the general formulae (1) to (5) are shown below, however, the compound of the present invention is not limited to them.

D-1
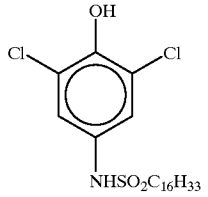
D-2
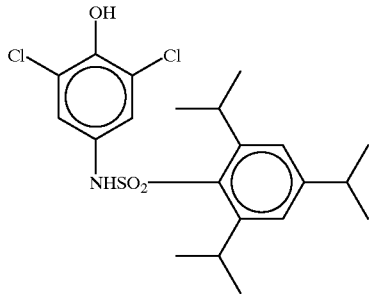
D-3
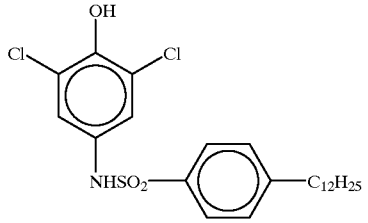
D-4
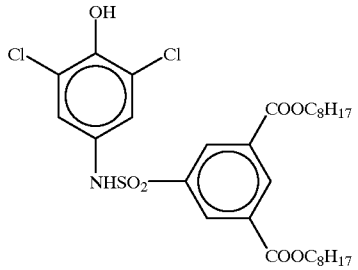
D-5
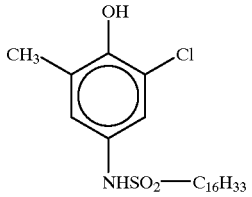
D-6
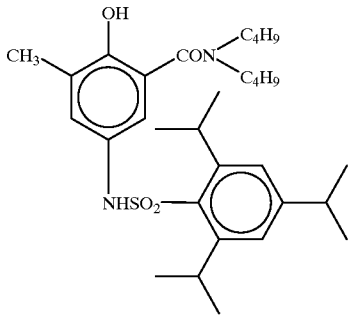

-continued
D-7
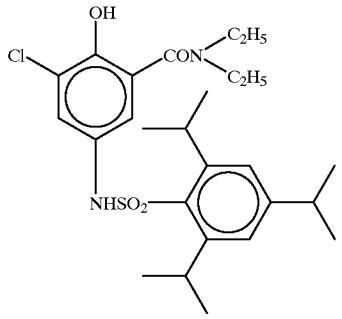
D-8
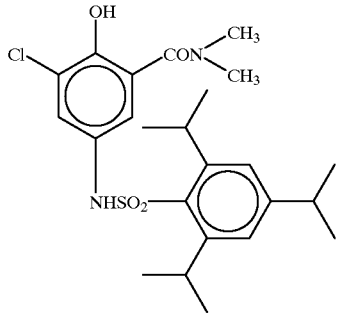
D-9
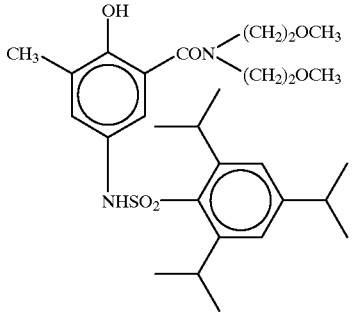
D-10
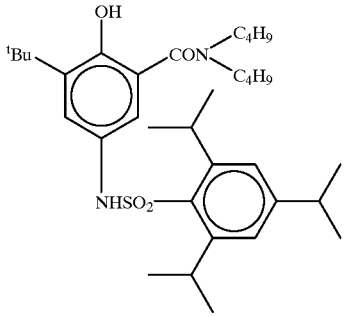
D-11
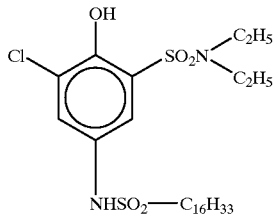

-continued
D-12
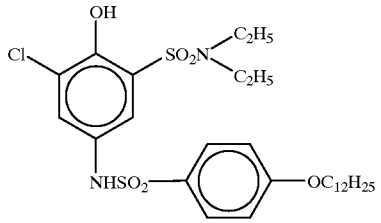
D-13
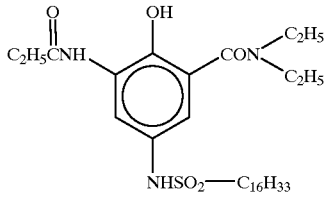
D-14
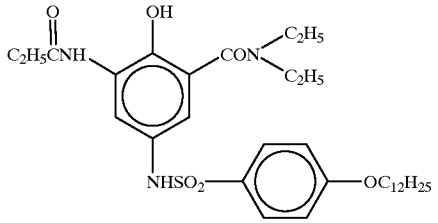
D-15
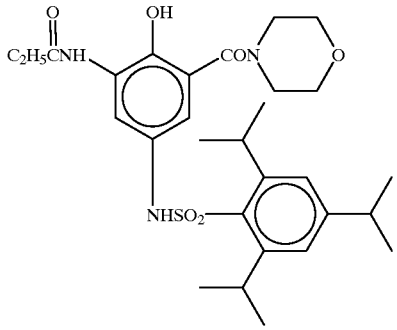
D-16
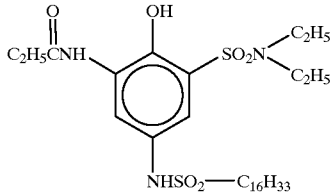
D-17
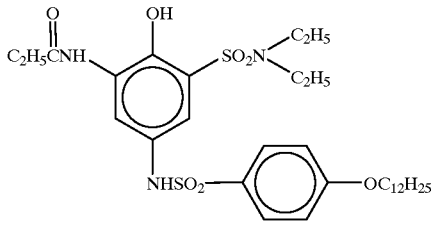

-continued
D-18
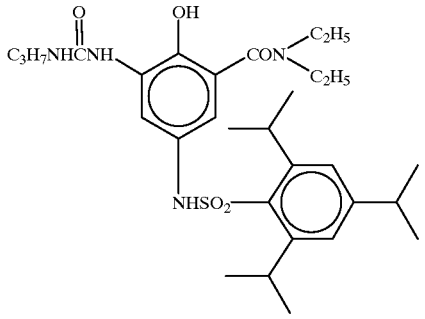
D-19
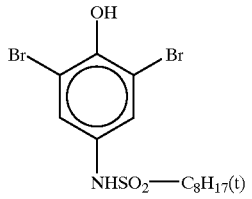
D-20
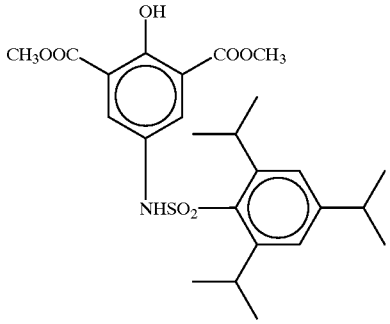
D-21
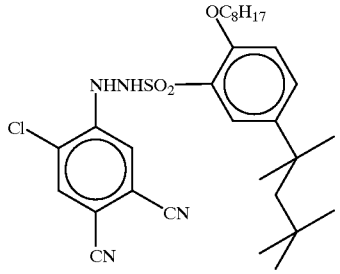
D-22
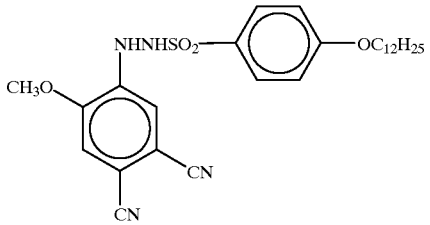

-continued
D-23
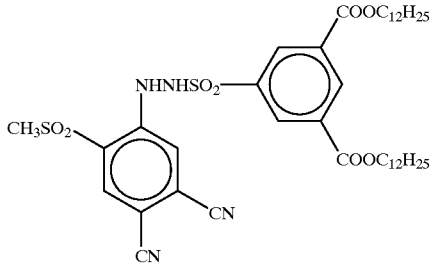
D-24
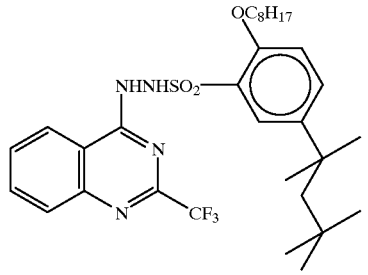
D-25
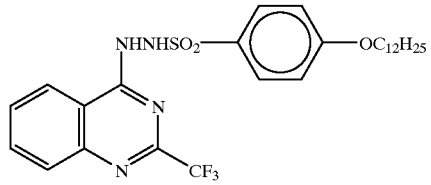
D-26
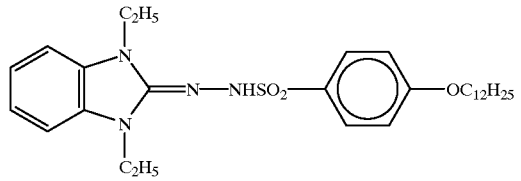
D-27
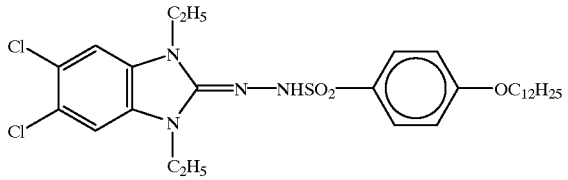
D-28
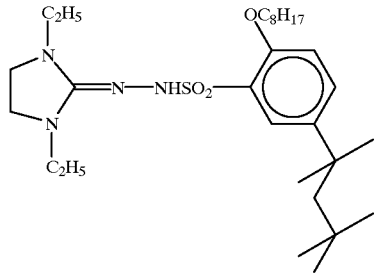

-continued
D-29
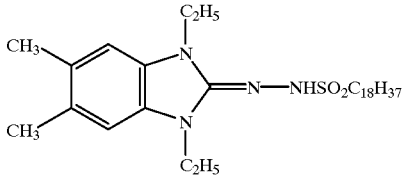
D-30
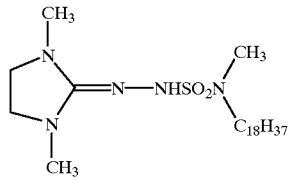
D-31
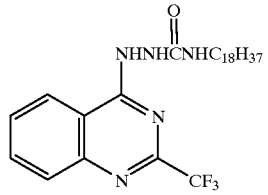
D-32
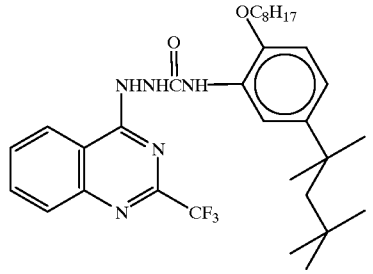
D-33
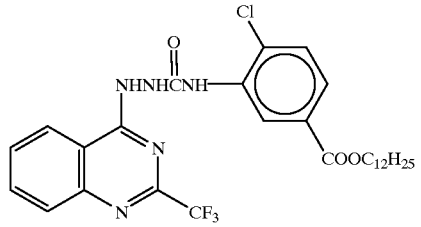
D-34
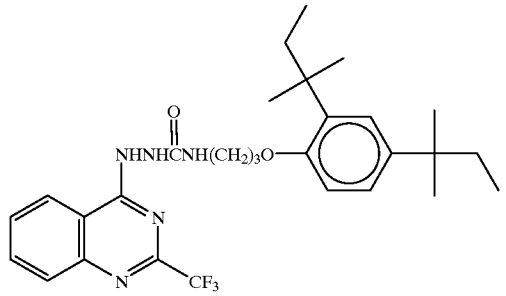

-continued
D-35
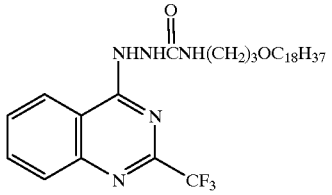
D-36
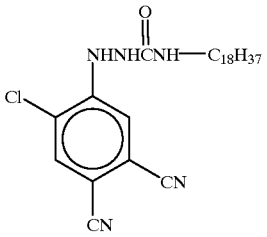
D-37
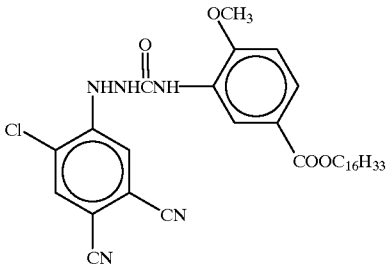
D-38
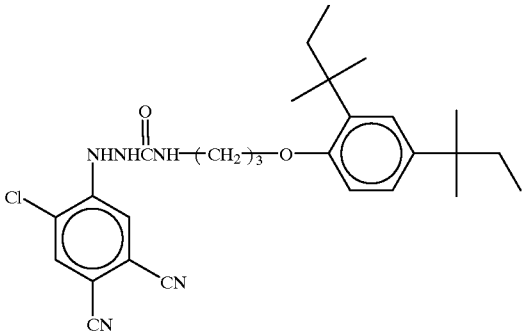
D-39
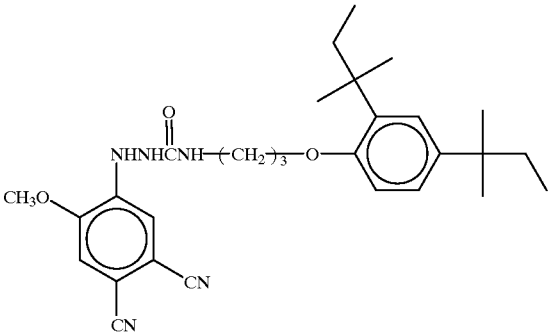

-continued
D-40
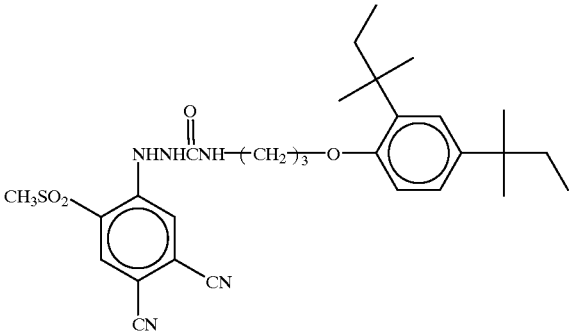
D-41
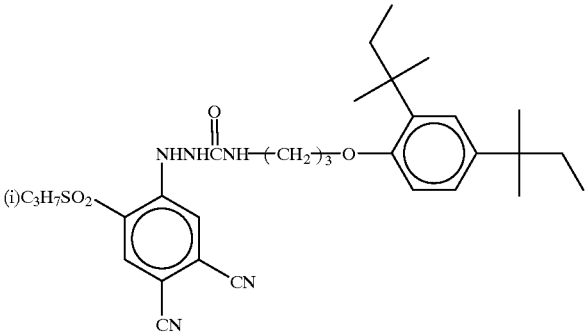
D-42
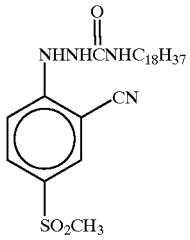
D-43
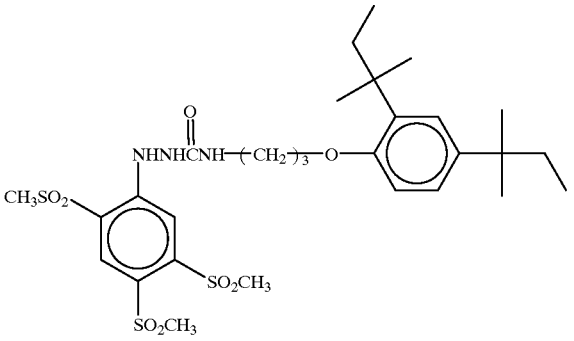
D-44
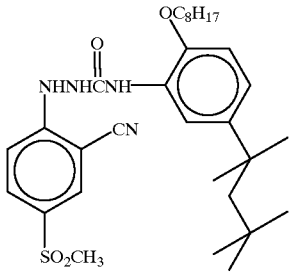

-continued
D-45
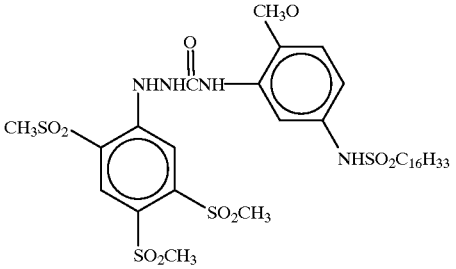
D-46
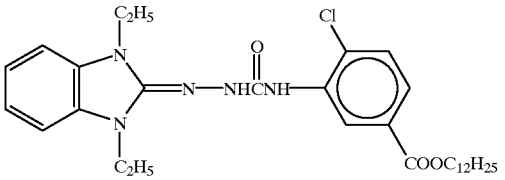
D-47
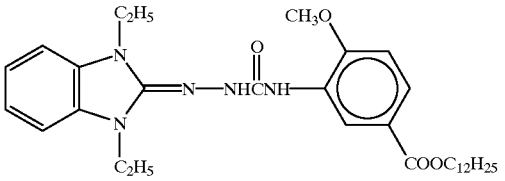
D-48
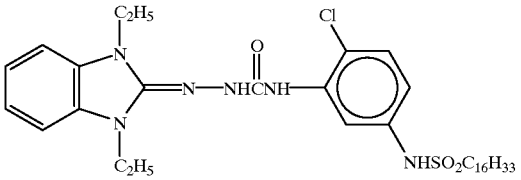
D-49
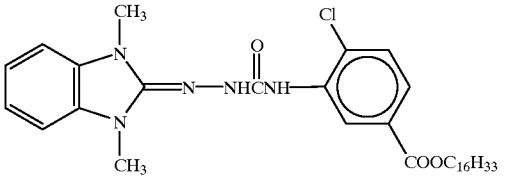
D-50
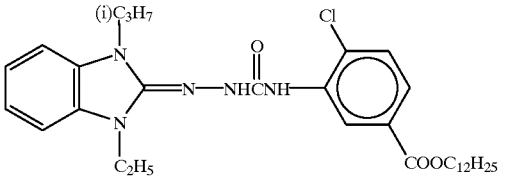
D-51
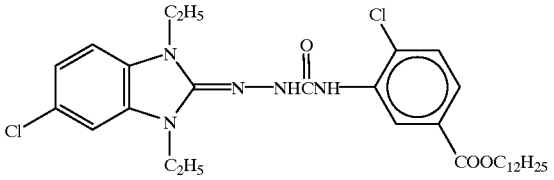

-continued
D-52
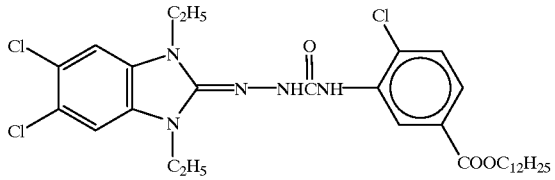
D-53
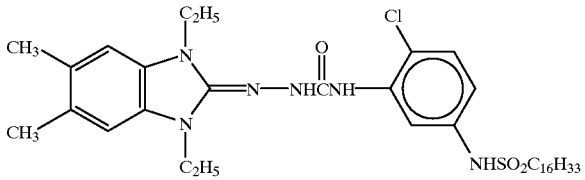
D-54
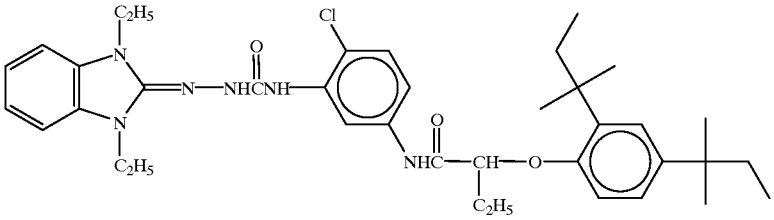
D-55
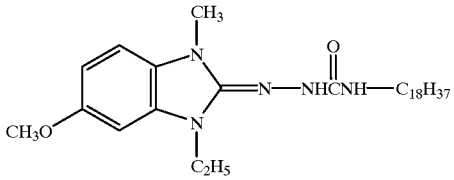
D-56
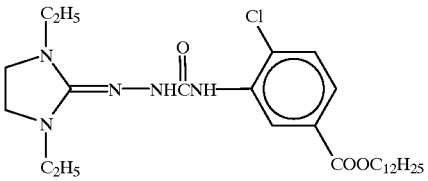
D-57
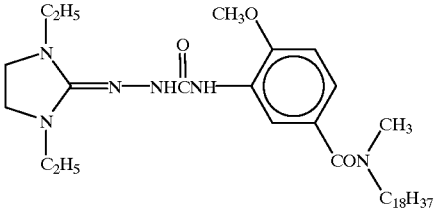
D-58
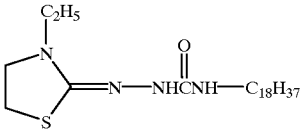
D-59
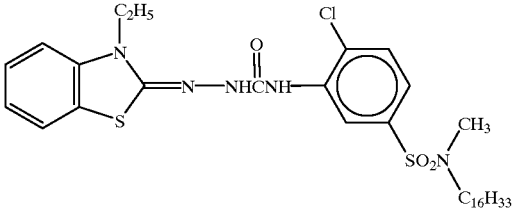

-continued

D-60

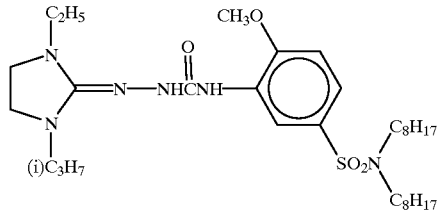

As the color developing agent, the above-described compounds are used alone or in combination of two or more. Different developing agent may be used in each layer. The total amount used of these developing agent is from 0.05 to 20 mmol/$m^2$, and preferably from 0.1 to 10 mmol/$m^2$.

Next, the coupler is explained. The coupler used in the present invention is a compound which causes a coupling reaction with an oxidized product of the above-described color developing agent to form a dye.

The coupler which is preferably used in the present invention, is selected from compounds generically called active methylene, 5-pyrazolone, pyrazoloazol, phenol, naphthol, pyrrolotriazole. As this coupler, compounds described in RD No. 38957 (September, 1996), pp. 616 to 624, "x. Dye image formers and modifiers" can be preferably used.

These couplers can be classified as what are known as two equivalent couplers, and four equivalent couplers. Examples of a group which can act as an anionic releasing group of the two equivalent coupler include a halogen atom (e.g., chlorine atom and bromine atom), an alkoxy group (e.g., methoxy group and ethoxy group), an aryloxy group (e.g., phenoxy group, 4-cyanophenoxy group and 4-alkoxycarbonylphenyl group), an alkylthio group (e.g., methylthio group, ethylthio group and butylthio group), an arylthio group (e.g., phenylthio group and tolylthio group), an alkylcarbamoyl group (e.g., methylcarbamoyl group, dimethylcarbamoyl group, ethylcarbamoyl group, diethylcarbamoyl group, dibutylcarbamoyl group, piperidylcarbamoyl group and morpholylcarbamoyl group), an arylcarmaboyl group (e.g., phenylcarbamoyl group, methylphenylcarbamoyl group, ethylphenylcarbamoyl group and benzylphenylcarbamoyl group), a carbamoyl group, an alkylsulfamoyl group (e.g., methylsulfamoyl group, dimethylsulfamoyl group, ethylsulfamoyl group, diethylsulfamoyl group, dibutylsulfamoyl group, piperidylsulfamoyl group and morpholylsulfamoyl group), an arylsulfamoyl group (e.g., phenylsulfamoyl group, methylphenylsulfamoyl group, ethylphenylsulfamoyl group and benzylphenylsulfamoyl group), a sulfamoyl group, a cyano group, an alkylsulfonyl group (e.g., methanesulfonyl group and ethanesulfonyl group), an arylsulfonyl group (e.g., phenylsulfonyl group, 4-chlorophenylsulfonyl group and p-toluenesulfonyl group), an alkylcarbonyloxy group (e.g., acetyloxy group, propionyloxy group and butyloyloxy group), an arylcarbonyloxy group (e.g., benzoyloxy group, toluyloxy group and anisyloxy group), a nitrogen-containing heterocyclic group (e.g., imidazolyl group and benzotriazolyl group), and the like.

Examples of a group which can act as an cationic releasing group of the four equivalent coupler include a hydrogen atom, a formyl group, a carbamoyl group, a methylene group having a substituent (examples of the substituent include an aryl group, a sulfamoyl group, a carbamoyl group, an alkoxy group, an amino group, a hydroxyl group and the like), an acyl group, a sulfonyl group and the like.

In addition to the aforementioned compounds described in RD No. 38957, the couplers described below can be preferably used.

As the active methylene type coupler, couplers represented by the formulae (I) and (II) described in European Patent Application No. 502,424A; couplers represented by the formulae (1) and (2) described in European Patent Application No. 513,496A; coupler represented by the formula (I) in claim 1 described in European Patent Application No. 568, 037A; coupler represented by the general formula (I) in lines 45 to 55 in column 1 described in U.S. Pat. No. 5,066,576; coupler represented by the general formula (I) in paragraph No. 0008 described in Japanese Patent Application Laid-Open (JP-A) No. 4-274425; coupler described in claim 1 in 40 page in European Patent Application No. 498,381A1; coupler represented by the formula (Y) in 4 page in European Patent Application No. 447,969A1; couplers represented by the formulae (II) to (IV) described in lines 36 to 58 in column 7 in U.S. Pat. No. 4,476,219 can be used.

As the 5-pyrazolone type magenta coupler, compounds described in Japanese Patent Application Laid-Open (JP-A)-Nos. 57-35858 and 51-20826 are preferred.

As the pyrazoloazole type coupler, imidazo [1,2-b] pyrazoles described in U.S. Pat. No. 4,500,630, pyrazolo [1,5-b] [1,2,4] triazoles described in U.S. Pat. No. 4,540,654 and pyrazolo [5,1-c] [1,2,4] triazoles described in U.S. Pat. No. 3,725,067 are preferred, and among them, the pyrazolo [1,5-b] [1,2,4] triazoles are preferred from the viewpoint of light fastness.

Further, a pyrazoloazole coupler in which a branched alkyl group is directly bonded to the 2, 3 or 6 position of a pyrazolo triazole group, described in Japanese Patent Application Laid-Open (JP-A) No. 61-65245, a pyrazoloazole coupler containing a sulfoneamido group in the molecule, described in Japanese Patent Application Laid-Open (JP-A) No. 61-65245, a pyrazoloazole coupler containing an alkoxyphenylsulfoneamido ballast group, described in Japanese Patent Application Laid-Open (JP-A) No. 61-147254, a pyrazolotriazole coupler having an alkoxy group or aryloxy group in 6-position, described in Japanese Patent Application Laid-Open (JP-A) Nos. 62-209457 and 63-307453, and a pyrazolotriazole coupler having a carbonomido group in the molecule, described in Japanese Patent Application Laid-Open (JP-A) No. 2-201443 can also be preferably used.

Preferable examples of the phenol type coupler include 2-alkylamino-5-alkylphenol type couplers described in U.S. Pat. Nos. 2,369,929, 2,801,171, 2,772,162, 2,895,826, 3,772,002 and the like, 2,5-diacylaminophenol-based couplers described in U.S. Pat. Nos. 2,772,162, 3,758,308, 4,126,396, 4,334,011, 4,327,173, OLS 3,329,729, Japanese Patent Application Laid-Open (JP-A) No. 59-166956 and the like, and 2-phenylureid-5-acylaminophenol-based couplers described in U.S. Pat. Nos. 3,446,622, 4,333,999, 4,451,559, 4,427,767, and the like.

Preferable examples of the naphthol coupler include 2-carbamoyl-1-naphtol type couplers described in U.S. Pat. Nos. 2,474,293, 4,052,212, 4,146,396, 4,228,233, 4,296,200 and the like, and 2-carbamoyl-5-amido-1-naphtol type couplers described in U.S. Pat. No. 4,690,889.

Preferable examples of pyrrolotriazole-based coupler include couplers described in European Patent Application Nos. 488,248A1, 491,197A1 and 545,300.

In addition, couplers having a structure such as condensed phenols, imidazoles, pyrroles, 3-hydroxypyridines, active methines, 5,5-condensed heterocyclic rings or 5,6-condensed heterocyclic rings can be used.

As the condensed phenol type coupler, couplers described in U.S. Pat. Nos. 4,327,173, 4,564,586,4,904,575 and the like can be used.

As the imidazole type coupler, couplers described in U.S. Pat. Nos. 4,818,672; 5,051,347 and the like can be used.

As the pyrrole type coupler, couplers described in Japanese Patent Application Laid-Open (JP-A) Nos. 4-188137; 4-190347 and the like can be used.

As the 3-hydroxypyridine type coupler, couplers described in Japanese Patent Application Laid-Open (JP-A) Nos. 1-315736 and the like can be used.

As the active methine type coupler, couplers described in U.S. Pat. Nos. 5,104,783; 5,162,196 and the like can be used.

As the 5,5-condensed heterocyclic ring type coupler, pyrrolopyrazole type couplers described in U.S. Pat. No. 5,164,289, pyrroloimidazole type couplers described in Japanese Patent Application Laid-Open (JP-A) No. 4-174429 can be used.

As the 5,6-condensed heterocycle is ring type coupler, pyrazolopyrimidine-type couplers described in U.S. Pat. No. 4,950,585, pyrrolotriazine-type couplers described in Japanese Patent Application Laid-Open (JP-A) No. 4-204730, couplers described in European Patent Application No. 556,700 and the like can be used.

In addition to the above-described couplers, couplers described in German Patent Nos. 3,819,051A, 3,823,049, U.S. Pat. Nos. 4,840,883, 5,024,930, 5,051,347, 4,481,268, European Patent Application Nos. 304,856A2, 329,036, 354,549A2, 374,781A2, 379,110A2, 386,930A1, Japanese Patent Application Laid-Open (JP-A) Nos. 63-141055, 64-32260, 32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731, 4-204732 and the like can also be used.

These couplers are used in an amount of from 0.05 to 10 mmol/$m^2$, and preferably from 0.1 to 5 mmol/$m^2$ for each color.

Further, functional couplers described below may also be contained in the light-sensitive element.

As the coupler in which a developed color dye has suitable diffusion properties, couplers described in U.S. Pat. No. 4,366,237, British Patent No. 2,125,570, European Patent No. 96,873B and German Patent No. 3,234,533 are preferable.

As the coupler to correct unnecessary absorption of a developed color dye, yellow colored cyan dye-forming couplers described in European Patent Applicaiton No. 456, 257A1, yellow colored magenta dye-forming couplers described in the above-described European Patent Application, magenta colored cyan dye-forming couplers described in U.S. Pat. No. 4,833,069, colorless masking couplers represented by (2) of U.S. Pat. No. 4,837,136 and formula (A) in claim 1 of U.S. Pat. No. 4,837,136, WO 92/11575 (particularly, the example compound on pp. 36 to 45) are listed.

As the compound (including coupler) which releases a photographically useful moiety by reacting with an oxidized product of an developing agent, the following compounds are listed.

Development inihibitor releasing compound: compounds represented by the formulae (I) to (IV) described on page 11 of European Patent Application No. 378,236A1, compounds represented by the formula (I) described on page 7 of European Patent Application No. 436, 938A2, compounds represented by the formula (I) in European Patent Application No. 568,037A, compounds represented by the formulae (I), (II) and (III) described on pp. 5 to 6 of European Patent Application No. 440,195A2.

Bleaching accelerator releasing compound: compounds represented by the formulae (I) and (I') described on page 5 of European Patent Application No. 310,125A2 and compound represented by the formula (I) in claim 1 of Japanese Patent Application Laid-Open (JP-A) No. 6-59411.

Ligand releasing compounds: compounds represented by LIG-X described in claim 1 of U.S. Pat. No. 4,555,478.

Lueco dye releasing compounds: compounds 1 to 6 in columns 3 to 8 of U.S. Pat. No. 4,749,641.

Fluorescent dye releasing compounds: compounds represented by COUP-DYE described in claim 1 of U.S. Pat. No. 4,774,181.

Development accelerator or fogging agent releasing compound: compounds represented by the formulae (1), (2) and (3) described in column 3 of U.S. Pat. No. 4,656,123 and ExZK-2 described in lines 36 to 38 of page 75 of European Patent Application No. 450,637A2.

Compounds releasing a group which becomes dye after being released: compounds represented by the formula (I) described in claim 1 of U.S. Pat. No. 4,857,447, compounds represented by the formula (1) in Japanese Patent Application No. 4-134523, compounds represented by the formulae (I), (II) and (III) described on pp. 5 and 6 of European Patent Application No. 440,195A2, compounds (ligand releasing compounds) represented by the formula (I) described in claim 1 of Japanese Patent Application Laid-Open (JP-A) No. 6-59411, and compounds represented by LIG-X described in claim 1 of U.S. Pat. No. 4,555,478.

It is preferable that these functional couplers are used in an amount from 0.05 to 10-times moles, and preferably from 0.1 to 5-times moles, based on the above-described coupler which contributes to color development.

The hydrophobic additives such as couplers, color developing agents and the like can be introduced in the layer of a light-sensitive element by known methods such as the method described in U.S. Pat. No. 2,322,027 and the like. In this case, organic solvents having high boiling point, such as those described in U.S. Pat. Nos. 4,555,470, 4, 536,466, 4,536,467, 4,587,206, 4,555,476, 4,599,296, Japanese Patent Application Publication (JP-B) No. 3-62256 and the like can be used, together if necessary, with an organic solvent having a low boiling point of from 50° C. to 160° C. Further, these dye-donating couplers, high boiling point organic solvents and the like can be used in combination of two or more.

The amount of the high boiling point organic solvent is not more than 10 g, preferably not more than 5 g, and more preferably from 1 g to 0.1 g, per 1 g of the hydrophobic additive. Further, the amount is suitably not more than 1 cc, more preferably not more than 0.5 cc, and particularly preferably not more than 0.3 cc, per 1 g of the binder.

Dispersion methods using a polymerized compound described in Japanese Patent Application Publication (JP-B) No. 51-39853 and Japanese Patent Application Laid-Open (JP-A) No. 51-59943 and a method in which a fine particle dispersion is made before addition, as described in Japanese Patent Application Laid-Open (JP-A) No. 62-30242, can also be used.

In the case of a compound which is substantially insoluble in water, the compound can be dispersed as fine particles in a binder using a method other than that described above.

Various surfactants can be used when dispersing a hydrophobic compound in a hydrophilic colloid. For example, compounds which are listed as a surfactant on pp. 37 to 38 of Japanese PatentApplicationLaid-Open (JP-A) No.59-157636, and the above-described RD can be used. Further, phosphate type surfactants described in Japanese Patent Application Nos. 5-204325, 6-19247 and OLS No.1,932, 299A can also be used.

The light-sensitive element of the present invention has at least three light-sensitive layers on a support. These layers have light-sensitive wavelength regions which are different from each other and the absorption wavelengths of the dyes, formed from the oxidized product of a color developing agent and couples contained in the layer, are also different from each other. The light-sensitive layer is a unit light-sensitive layer having colorsensitivity to one of blue light, green light and red light. In a multilayer silver halide color photographic light-sensitive element, the layer arrangement of the unit light-sensitive layers is generally in the order of a red light-sensitive layer, a green light-sensitive layer and a blue light-sensitive layer from the support. However, the above-described order can be reversed according to objective, or two layers having the same color sensitivity can interpose a light-sensitive layer having a different color sensitivity therebetween. A non-light-sensitive layer may be disposed between the above-described silver halide light-sensitive layers, as well as on the top layer and bottom layer. These layers may contain the above-described coupler, a developing agent, a DIR compound, a color mixing prevention agent, a dye and the like. Regarding a plurality of silver halide emulsion layers constituting each unit light-sensitive layer, a high sensitive emulsion layer and low sensitive emulsion layer are preferably arranged so that photosensitivity lowers sequentially approaching the support, as described in German Patent No. 1,121,470 and British Patent No. 923,045. Further, as described in Japanese Patent Application Laid-Open (JP-A) Nos. 57-112751, 62-200350, 62-206541 and 62-206543, a low light-sensitive emulsion layer may be disposed on the side further from the support, and a high light-sensitive emulsion layer may be disposed on the side near the support.

Specific examples thereof include a sequence consisting of a low sensitive blue light-sensitive layer (BL)/a high sensitive blue light-sensitive layer (BH)/a high sensitive green light-sensitive layer (GH)/a low sensitive green light-sensitive layer (GL)/a high sensitive red light-sensitive layer (RH)/a low sensitive red light-sensitive layer (RL), or alternately in a sequence consisting of BH/BL/GL/GH/RH/RL, or alternately again in a sequence consisting of BH/BL/GH/GL/RL/RH, and the like, respectively moving from the side furthest from the support back towards the support.

Further, as described in Japanese Patent Application Publication (JP-B) No.55-34932, a sequence consisting of a blue light-sensitive layer/GH/RH/GL/RL from the side furthest from the support is also possible. Further, as described in Japanese Patent Application Laid-Open (JP-A) Nos. 56-25738 and 62-63936, a sequence consisting of a blue light-sensitive layer/GL/RL/GH/RH from the side furthest from the support is also possible.

Japanese Patent Application Publication (JP-B) No. 49-15495discloses a structure formed from three layers each having different light-sensitivity in which the upper layer is a silver halide emulsion layer having the highest light-sensitivity, the intermediate layer is a silver halide emulsion layer having light-sensitivity lower than that of the upper layer, and the lower layer is a silver halide emulsion layer having light-sensitivity still lower than that of the intermediate layer. Namely, a structure in which the light-sensitivity decreases sequentially approaching the support. Even in cases like this in which a structure is formed from three layers each having different light-sensitivity, a sequence consisting of a medium sensitive emulsion layer/a high sensitive emulsion layer/a low sensitive emulsion layer moving inwards from side furthest from the support, in layers having the same color sensitivity, is permissible as described in Japanese Patent Application Laid-Open (JP-A) No. 59-202464.

In addition, a sequence consisting of a high sensitive emulsion layer/a low sensitivity emulsion layer/a medium sensitivity emulsion layer, or a sequence consisting a low sensitivity emulsion layer/a medium sensitivity emulsion layer/a high sensitivity emulsion layer may also be permissible.

Further, in the case of four or more layers, the arrangement may be changed as described above.

For improving color reproduction, it is preferable that a donor layer (CL), having an interimage effect, having a different spectral sensitivity distribution from the main light-sensitive layer such as BL, GL, RL and the like, is arranged adjacent to or near the main light-sensitive layers as described in U.S. Pat. Nos. 4,663,271, 4,705,744 and 4,707,436, and Japanese Patent Application Laid-Open (JP-A) Nos. 62-160448 and 63-89850.

In the present invention, a silver halide and a dye donating coupler, as well as a color developing agent may be contained in the same layer, however, they may also be divided and added to different layers when there is a possibility that they will react each other. For example, when the layer containing the color developing agent is different from a layer containing the silver halide, storability before actual use of the sensitive material can be improved.

The relation between the spectral sensitivity of each layer and the hue of the dye formed by a coupler is not restricted, and direct projection exposure can be performed on conventional color printing paper and the like when a cyan dye-forming coupler is used in the red light-sensitive layer, a magenta dye-forming coupler is used in the green light-sensitive layer and a yellow dye-forming coupler is used in the blue light-sensitive layer.

In the light-sensitive element, various non-light-sensitive layers such as a protective layer, a subbing layer, an intermediate layer, a yellow filter layer, an anti-halation layer and the like may be provided between the above-described silver halide emulsion layers, and on the most upper layer and lowest layer, and various auxiliary layers such as a backing layer can be provided on the opposite side of the support. Specifically, layer structures such as those described in the above-described publications, a subbing layer described in U.S. Pat. No. 5,051,335, intermediate layers containing a solid pigment described in Japanese Patent Application Laid-Open (JP-A) Nos. 1-167838 and 61-20943, intermediate layers containing a reducing agent or a DIR compound described in Japanese Patent Application Laid-Open (JP-A) Nos. 1-120553, 5-34884 and 2-64634, intermediate layers containing an electron transfer agent described in U.S. Pat. Nos. 5,017,454 and 5,139,919 and Japanese Patent Application Laid-Open (JP-A) No. 2-235044, a protective layer containing a reducing agent described in Japanese Patent Application Laid-Open (JP-A) No. 4-249245, or a layer obtained by combination thereof can be provided.

As the dye which can be used in the yellow filter layer and anti-halation layer, a dye which is decolored or removed in developing step and does not affect the density after heat-development is preferable.

The decoloring or removal of the dye which can be used in the yellow filter layer and anti-halation layer in developing step, means that the amount of the dye remaining after heat-development is reduced to not more than ⅓, and preferably not more than 1/10 of the amount directly before coating, and means that components of the dye may transfer from the light-sensitive element to the processing element in developing step and these components may react during developing step to become colorless compounds.

Specifically, dyes described in European Patent Application No. 549,489A and dyes of ExF 2 to 6 of Japanese Patent Application Laid-Open (JP-A) No. 7-152129 are listed. A solid-dispersed dye as described in Japanese Patent Application Laid-Open (JP-A) No. 8-101487 can also be used.

Further, it is also possible to mordant a dye to a binder with a mordant. In this case, any mordant and dye known in the photographic field can be used, and mordants described in U.S. Pat. No. 4,500,626, columns 58 to 59, Japanese Patent Application Laid-Open (JP-A) No. 61-88256, pp. 32 to 41, Japanese Patent Application Laid-Open (JP-A) Nos. 62-244043 and 62-244036 are examplified.

Further, it is also possible to use a reducing agent and a compound which releases a diffusible dye by reaction with the reducing agent, to release a mobile dye by an alkali in developing step, and removing the dye by transferring it onto the processing element. Concretely, details thereof are described in U.S. Pat. Nos. 4,559,290, 4,783,396, EP No. 220,746A2, Laid-Open Technical Journal (Kokai Giho) 87-6119, and further Japanese Patent Application Laid-Open (JP-A) No. 8-101487, paragraph Nos. 0080 to 0081.

A leuco dye which is decolored can also be used, and concretely, Japanese Patent Application Laid-Open (JP-A) No. 1-150132 discloses a silver halide light-sensitive element containing a leuco dye which has been color-developed beforehand by a developer of a metal salt of an organic acid. The complex of the developer with the leuco dye is decolored by heat or by the reaction with an alkali agent.

As the leuco dye, known leuco dyes can be used, and descriptions thereof are found in Moriga, Yoshida, "Dyes and Chemicals" vol. 9, page 84 (Chemical Product Industrial Institute), "New Dye Manual", page 242 (Maruzen, 1970), R. Garner "Reports on the Progress of Appl. Chem", vol. 56, page 199 (1971), "Dyes and Chemicals" vol. 19, page 230 (Chemical Product Industrial Institute, 1974), "Coloring Materials" vol. 62, page 288 (1989), "The Dyeing Industry", vol. 32, page 208, and the like.

As the developer, a metal salt of an organic acid, in addition to a Japanese acid clay type developer and phenol-formaldehyde resin are preferably used. As the metal salt of an organic acid, metal salts of salicylic acids, metal salts of a phenol-salicylic acid-formaldehyde resin, metal salts of a rhodan salt, xanthate and the like are useful, and zinc is particularly preferable as this metal. Among the above-described developers, as the oil-soluble zinc salicylate, those described in U.S. Pat. Nos. 3,864,146 and 4,046,941, Japanese Patent Application Publication (JP-B) No. 52-1327, and the like can be used.

It is preferable that the coating layer of the light-sensitive element in the present invention is hardened by a hardener.

Examples of the hardener include hardeners described in U.S. Pat. No. 4,678,739, column 41, U.S. Pat. No. 4,791,042, Japanese Patent Application Laid-Open (JP-A) No. 59-116655, 62-245261, 61-18942, 4-218044 and the like. More specifically, aldehyde type hardeners (formaldehyde and the like), aziridine type hardeners, epoxy-type hardener, vinylsulfone type hardeners (N,N'-ethylene-bis (vinylsulfonylacetamide)ethane and the like), N-methylol-typehardeners (dimethylolurea and the like), boric acid, metaboric acid or polymer hardeners (compounds described in Japanese Patent Application Laid-Open (JP-A) No. 62-234157) are listed.

These hardeners are used in an amount from 0.001 to 1 g, and preferably from 0.005 to 0.5 g per 1 g of a hydrophilic binder.

In the light-sensitive element, various anti-fogging agents and photographic stabilizing agents and precursors thereof can be used. Specific examples thereof include compounds described in the above-described RD, U.S. Pat. Nos. 5,089,378, 4,500,627 and 4,614,702, Japanese Patent Application Laid-Open (JP-A) No. 64-13564, pp. 7 to 9, 57 to 71 and 81 to 97, U.S. Pat. Nos. 4,775,610, 4,626,500 and 4,983,494, Japanese Patent Application Laid-Open (JP-A) Nos. 62-174747 and 62-239148, 1-150135, 2-110557 and 2-178650, RD No. 17643 (1978), pp. 24 to 25, and the like.

These compounds are used in an amount from $5\times10^{-6}$ to $1\times10^{-1}$ mol, and preferably from $1\times10^{-5}$ to $1\times10^{-2}$ mol per one mol of silver.

In the light-sensitive element, various surfactants can be used for the purpose of improvement in coating, releasability, sliding property, antistatic property, development accelerating property and the like. Specific examples of the surfactants are described in Known Techniques (kochi-Gijutsu) No. 5 (Mar. 22, 1991, published by Aztech limited company), pp. 136 to 138, Japanese Patent Application Laid-Open (JP-A) Nos. 62-173463 and 62-183457, and the like.

In the light-sensitive element, organic fluoro compounds may be included in order to improve sliding, antistatic, releasing properties and the like. Typical examples of the organic fluoro compound include fluorine type surfactants, and hydrophobic fluorine compounds such as oily fluorine type compounds such as a fluorine oil and the like, or solid fluorine compound resins such as a tetrafluoroethylene resin and the like, described in Japanese Patent Application Publication (JP-B) No. 57-9053, pp. 8 to 17, Japanese Patent Application Laid-Open (JP-A) Nos. 61-20944 and 62-135826. A fluorine type surfactant having a hydrophilic group is also preferably used in order to be compatible with both the wettability and the antistatic properties of the light-sensitive element.

It is preferable that the light-sensitive element has sliding properties. It is preferable that a sliding agent-containing layer is used in both the light-sensitive layer surface and the backing surface. The preferred sliding property is not less than 0.01 and not more than 0.25 in terms of coefficient of kinetic friction. This value is a measured value when the light-sensitive element is transported at 60 cm/minute against a stainless ball having a diameter of 5 mm (25° C., RH 60% ). In this evaluation, the same level is obtained even if the stainless ball is replaced by a light-sensitive layer surface.

Examples of the sliding agent which can be used include polyorganosiloxanes, higher fatty acid amides, higher fatty acid metal salts, esters of higher fatty acids with higher alcohols and the like, and as the polyorganosiloxane, polydimethylsiloxane, polydiethylsiloxane, polystyrylmethylsiloxane, polymethylphenylsiloxane and the like can be used. As the layer to be added, the outermost layer of an emulsion layer and a backing layer are preferable. In particular, polydimethylsiloxane and an ester having a log chain alkyl group are preferable. To prevent pressure fogging and desensitization of the silver halide, silicone oil and chlorinated paraffin are preferably used.

Further, in the present invention, an antistatic agent is preferably used. Examples of the antistatic agent include a carboxylic acid and carboxylate, a polymer containing a sulfonate, a cationic polymer, and an ionic surface active compound.

Examples of the most preferable antistatic agent include a fine particle of at least one kind of crystalline metal oxide, having a volume resistivity of not more than $10^7$ Ω·cm, more preferably not more than $10^5$ Ω·cm, and having a particle size from 0.001 to 1. 0 Um selected from ZnO, $TiO_2$, $SnO_2$, $Al_2O_3$, $In_2O_3$, $SiO_2$, MgO, BaO, $MoO_3$, $V_2O_5$ or a complex oxide thereof (Sb, P, B, In, S, Si, C and the like), and a fine particle of a metal oxide in the form of a sol or a complex oxide thereof. The content in the light-sensitive material is preferably from 5 to 500 mg/$m^2$, and particularly preferably from 10 to 350 mg/$m^2$. The ratio of the electroconductive crystalline oxide or complex oxide thereof to the binder is preferably from 1/300 to 100/1, and more preferably from 1/100 to 100/5. It is also preferable that the water resistant polymer described in Japanese Patent Application Laid-Open (JP-A) No. 8-292514 is coated on the back surface of the support of the light-sensitive element.

The structure of the light-sensitive element or the processing element described later (including the backing layer) can contain various polymer latexes, for the purpose of improvement of physical properties of the layers such as dimension stability, curl prevention, adhesion prevention, layer cracking prevention, prevention of pressure-induced sensitization or pressure-induced desensitization, and the like. Specifically, any of the polymer latexes described in Japanese Patent Application Laid-Open (JP-A) Nos. 62-245258, 62-136648, 62-110066 and the like can be used. Especially, when a polymer latex having a low glass transition temperature (not more than 40° C.) is used in a mordanting layer, cracking of the mordanting layer can be prevented, and when a polymer latex having a high glass transition temperature is used in a backing layer, a curl prevention effect is obtained.

It is preferable that the light-sensitive element which can be used in the present invention has a matting agent. The matting agent may be added to either the emulsion surface or the backing surface, but is particularly preferably added to the outermost layer on the emulsion side. Any matting agent soluble in a processing solution, or a matting agent insoluble in a processing solution may be permissible, however, it is preferable to use both of them together. For example, polymethyl methacrylate, poly (methylmethacrylate/methacrylic acid=9/1 or 5/5 (molar ratio)), polystyrene particle and the like are preferable. The particle size thereof is preferably from 0.8 to 10 μm, it is preferable that the particle size distribution thereof is narrow, and it is preferable that not less than 90% of the total number of particles range in size from 0.9 to 1.1-times of the average particle size. Further, it is also preferable to add fine particle having a size of not more than 0.8 μm simultaneously to enhance matting properties, and as examples, polymethylmethacrylate (0.2 μm), poly (methylmethacrylate/methacrylic acid=9/1 (molar ratio)) (0.3 μm), polystyrene particle (0.25 μm), colloidal silica (0.03 μm) and the like are listed.

Specific examples are described in Japanese Patent Application Laid-Open (JP-A) No. 61-88256, on page 29. In addition, benzoguanamine resin bead, a polycarbonate resin beads, an AS resin beads and the like as described in Japanese Patent Application Laid-Open (JP-A) Nos. 63-274944 and 63-274952 are listed. Further, compounds described in the above-described RD can be used.

These matting agents can be dispersed in various binders described in the above-described paragraph on binder, and used as dispersions, as occasion demands. In particular, various gelatins, for example, an acid-processed gelatin dispersion, easily provide a stable coating solution, and at this time, it is preferable that the pH, ionic strength and binder concentration are controlled where necessary to be at optimum values.

Further, the compounds described below can be used.

Dispersion medium of an oil-soluble organic compound: Japanese Patent Application Laid-Open (JP-A) No. 62-215272, p-3, 5, 16, 19, 25, 30, 42, 49, 54, 55, 66, 81, 85, 86, 93 (pp. 140 to 144);

Latex for impregnation of an oil-soluble organic compound: latex described in U.S. Pat. No. 4,199,363;

Scavenger for oxidized product of developing agent: compounds represented by the formula (I) in U.S. Pat. No. 4,978,606, column 2, lines 54 to 62 (particularly, I-, (1), (2) (6), (12) (columns 4 to 5)), compounds represented by the formula in U.S. Pat. No. 4,923,787, column 2, lines 5 to 10 (particularly, compound 1 (column 3));

Stain inhibitor: the formulae (I) to (III) described in European Patent Application No. 298321A, on page 4, lines 30 to 33, in particular, I-47, 72, III-1, 27 (pp. 24 to 48);

Anti-fading agent: European Patent Application No. 298321A, A-6, 7, 20, 21, 23, 24, 25, 26, 30, 37, 40, 42, 48, 63, 90, 92, 94, 164 (pp. 69 to118), U.S. Pat. No. 5,122,444, columns 25 to 38, II-1 to III-23, in particular, III-10, European Patent Application No. 471347A, pp. 8 to 12, I-1 to III-4, in particular, II-2, U.S. Pat. No. 5,139,931, columns 32 to 40, A-1 to 48, in particular, A-39, 42;

Material to reduce the amount used of color development enhancing agent or color mixing inhibitor: European Patent Application No. 411324A, pp. 5 to 24, I-1 to II-15, in particular, I-46;

Formalin scavenger: European Patent Application No. 477932A, pp. 24 to 29, SCV-1 to 28, in particular, SCV-8;

Hardener: Japanese Patent Application Laid-Open (JP-A) No. 1-214845, page 17, H-1, 4, 6, 8, 14, compounds (H-1 to 54) represented by the formulae (VII) to (XII) described in U.S. Pat. No. 4,618,573, columns 13 to 23, compounds (H-1 to 76) represented by the formula (6) described in Japanese Patent Application Laid-Open (JP-A) No. 2-214852, page 8, lower right column, in particular, H-14, compounds described in claim 1 in U.S. Pat. No. 3,325,287;

Developing inhibitor precursor: Japanese Patent Application Laid-Open (JP-A) No. 62-168139, p-24, 37, 39 (pp. 6 to 7); compounds described in claim 1 of U.S. Pat. No. 5,019,492, in particular, column 7, 28,29;

Preservative, Antifungus agent: U.S. Pat. No. 4,923,790, columns 3 to 15, I-1 to III-43, in particular, II-1, 9, 10, 18, III-25;

Stabilizer, anti-fogging agent: U.S. Pat. No. 4,923,793, columns 6 to 16, I-1 to (14), in particular, I-1, 60, (2), (13), U.S. Pat. No. 4,952,483, columns 25 to 32, compounds 1 to 65, in particular, 36;

Chemical sensitizer agent: triphenylphosphine selenide, compounds 50 described in Japanese Patent Application Laid-Open (JP-A) No. 5-40324;

Dyes: Japanese Patent Application Laid-Open (JP-A) No. 3-156450, on pp. 15 to 18, a-1 to b-20, in particular, a-1, 12, 18, 27, 35, 36, b-5, pp. 27 to 29, V-1 to 23, in particular, V-1;

European Patent Application No. 445627A, on pp. 33 to 55, F-I-1 to F-II-43, in particular, F-I-11, F-II-8; European Patent Application No. 457153A, on pp. 17 to 28, III-1 to 36, in particular III-1, 3; WO88/04794, on pp. 8 to 26 of fine particle dispersions, Dye-1 to 124; European Patent Application No. 319999A, on pp. 6 to 11, compounds 1 to 22, in particular, compound 1: compounds D-1 to 87 represented by the formulae (1) to (3) in European Patent Application No. 519306A (pp. 3 to 28); compounds 1 to 22 represented by the formula (1) in U.S. Pat. No. 4,268,622 (columns 3 to 10); compounds (1) to (31) represented by the formula (1) in U.S. Pat. No. 4,923,788 (columns 2 to 9);

Ultraviolet ray absorber: compounds (18b) to (18r) and 101~427 represented by the formula (1) in Japanese Patent Application Laid-Open (JP-A) No. 46-3335 (pp. 6to 9); compounds (3) to (66) represented by the formula (1) (pp. 10 to 44) and compounds HBT-1 to 10 represented by the formula (III) (page 14) in European Patent Application No. 520938A; compounds (1) to (31) represented by the formula (1) in European Patent Application No. 521823A (columns 2 to 9).

The various additives described above, specifically, the hardener, anti-fogging agent, surfactant, sliding agent, anti-static agent, latex, matting agent and the like can be added where necessary to the processing element, or to both the light-sensitive element and the processing element.

As the support of the light-sensitive element in the present invention, a support which is transparent and can tolerate the processing temperature can be used. In general, supports for photographic use such as the paper described in "Fundamentals of Photographic Engineering—Volume of Silver Salt Photography—"edited by Photographic Society of Japan., corona Publishing co. (1979) (pp. 223 to 240), synthetic polymers (films) and the like are listed. Specific examples thereof include polyethylene terephthalate, polyethylenenaphthalate (PEN), polycarbonate, polyvinylchloride, polystyrene, polypropylene, polyimide, celluloses (for example, triacetylcellulose), and the like.

Among them, in particular, a polyester containing polyethylenenaphthalate as a main component is preferred. The phrase "polyethylenenaphthalate as a main component" means that the content of naphthalenedicarboxylic acid contained in the total dicarboxylic acid moieties is not less than 50% by mol, more preferably not less than 60% by mol and further preferably not less than 70% by mol. This may be a copolymer or a polymer blend.

In the case of the copolymer, one with which a unit such as terephthalic acid, bisphenol A, cyclohexane dimethanol and the like is copolymerized in addition to a naphthalene dicarboxylic acid unit and an ethylene glycol unit is preferable. Among them, one with which a terephthalic acid unit is copolymerized is most preferable from the viewpoints of mechanical strength and cost.

Examples of preferred counterpart component for the polymer blend include polyesters such as polyethylene terephthalate (PET), polyarylate (PAr), polycarbonate (PC), polycyclohexanedimethanol terephthalate (PCT) and the like from the viewpoint of compatibility, and among them a polymer blend with PET is preferable from the viewpoints of mechanical strength and cost.

Specific examples of the preferred polyester compounds are listed below.

Examples of polyester copolymer (number in bracket represents weigat ratio)

2,6-naphthalene dicarboxylic acid/terephthalic acid/ethylene glycol (70/30/100). Tg=98° C.

2,6-naphthalene dicarboxylic acid/terephthalic acid/ethylene glycol (80/20/100). Tg=105° C.

Examples of polyester polymer blend (number in bracket represents molar ratio)

PEN/PET (60/40), Tg=95° C.

PEN/PET (80/20), Tg=104° C.

In addition, supports described in Japanese Patent Application Laid-Open (JP-A) No. 62-253159, pp (29) to (31), Japanese Patent Application Laid-Open (JP-A) No. 1-161236, pp. (14) to (17), Japanese Patent Application Laid-Open (JP-A) Nos. 63-316848, 2-22651 and 3-56955, U.S. Pat. No. 5,001,033, and the like can be used. These supports can be subjected to heat treatment (controlling of crystallinity and orientation), monoaxial and biaxial drawing (controlling of orientation), blending of various polymers, surface treatment and the like in order to improve optical and physical properties.

When the requirements regarding heat resistance and curl property are particularly stringent, supports described in Japanese Patent Application Laid-Open (JP-A) Nos. 6-41281, 6-43581, 6-51426, 6-51437, 6-51442, 6-82961, 6-82960, 6-123937, 6-82959, 6-67346, 6-118561, 6-266050, 6-202277, 6-175282, 6-118561, 7-219129 and 7-219144 are preferably used as the support of the light-sensitive element.

Further, a supports composed of a styrene-type polymer mainly having syndiotactic structure can preferably be used. The thickness of the supports is preferably from 5 to 200 $\mu$m, and more preferably from 40 to 120 $\mu$m.

Further, it is preferable to conduct surface treatment in order to adhere the support to the layers constituting the light-sensitive element. Examples thereof include surface activating treatment such as treatment with chemicals, mechanical treatment, corona discharge treatment, flame treatment, ultraviolet-ray treatment, microwave treatment, glow discharge treatment, active plasma treatment, laser treatment, mixed acid treatment, ozone oxidization treatment and the like. The ultraviolet-ray treatment, flame treatment, corona discharge treatment, and glow discharge treatment are most preferable.

The subbing layer of the support may be composed of single layer or two or more layers. As the binder for the subbing layer, polyethyleneimine, epoxy resin, graft gelatin, nitrocellulose, gelatin, polyvinyl alcohol and modified polymer thereof are listed, in addition to copolymers obtained by using, as a starting material, a monomer selected from vinyl chloride, vinylidene chloride, butadiene, methacrylic acid, acrylic acid, itaconic acid, maleic anhydride and the like. As the compound which swells the support, resorcin and p-chlorophenol are used. As the gelatin hardening agent used in the subbing layer, chromium salt (chromium alum and the like), aldehydes (formaldehyde, glutar aldehyde and the like), isocyanates, active halogen compounds (2,4-dichloro-6-hydroxy-s-triazine and the like), epichlorohydrin resin, active vinylsulfone compound and the like can be listed. $SiO_2$, $TiO_2$, inorganic fine particle or polymethyl methacrylate copolymer fine particle (0.01 to 10 $\mu$m) may be contained as the matting agent.

Regarding the dye used for film dyeing, gray dyeing is preferable from the viewpoint of general properties of the light-sensitive element, and a dye which has excellent heat resistance in the film forming temperature region and has excellent compatibility with polyester is preferable. From this point of view, it is possible to attain the desired result by mixing a dye which is commercially available as a polyester dye such as Diaresin, manufactured by Mitsubishi Chemical Co., Ltd., Kayaset manufactured by Nippon Kayaku Co., Ltd. and the like. In particular, from the viewpoint of heat resistance stability, anthraquinone-type dyes are listed. For example, those described in Japanese Patent Application Laid-Open (JP-A) No. 8-122970 can be preferably used.

Further, it is preferable to use as the support, for example, one which has a magnetic recording layer described in Japanese Patent Application Laid-Open (JP-A) Nos. 4-124645, 5-40321, 6-35092, 6-317875 and to record information regarding photographing and the like.

The magnetic recording layer is obtained by coating an aqueous or organic solvent-based coating solution, which is prepared by dispersing a magnetic substance particle in a binder, on the support.

As the magnetic particles, ferromagnetic iron oxides such as $\gamma Fe_2O_3$ and the like, Co deposited $\gamma Fe_2O_3$, Co deposited magnetite, Co-containing magnetite, ferromagnetic chromium dioxide, ferromagnetic metal, ferromagnetic alloy, Ba ferrite, Sr ferrite, Pb ferrite, Ca ferrite and the like having a hexagonal crystal system can be used. Co deposited ferromagnetic iron oxides such as Co deposited $\gamma Fe_2O_3$ and the like are preferred. The form thereof may be any of either a needle form, a rice grain form, a spherical form, a cubic form, a tabular form or the like. The specific surface area thereof is preferably not less than 20 $m^2/g$, and particularly preferably not less than 30 $m^2/g$ in terms of $S_{BET}$. The saturation magnetization ($\sigma s$) of the ferromagnetic substance is preferably from $3.0\times10^4$ to $3.0\times10^5$ A/m, and particularly preferably from $4.0\times10^4$ to $2.5\times10^5$A/m. The ferromagnetic substance particle may be subjected to surface treatment with silica and/or alumina and an organic material. Further, the surface of the magnetic substance particle may be treated with a silane coupling agent or titanium coupling agent as described in Japanese Patent Application Laid-Open (JP-A) No. 6-161032. A magnetic particle of which the surface is coated with an inorganic material or organic material, described in Japanese Patent Application Laid-Open (JP-A) Nos. 4-259911 and 5-81652, can also be used.

As the binder used for the magnetic substance particle, thermoplastic resins, thermosetting resins, radiation curing resins, reactive resins, acids, alkalis, biodegradable polymers, natural polymers (cellulose derivative, saccharide derivative and the like), and a mixture thereof described in Japanese Patent Application Laid-Open (JP-A) No. 4-219569 can be used. The Tg value of the above-described resins is from −40° C. to 300° C., and the weight-average molecular weight is from 2,000 to 1,000,000. For example, vinyl-type copolymers, cellulose derivatives such as cellulose diacetate, cellulose triacetate, cellulose propionate, cellulose acetate butylate, cellulose tripropionate and the like, acrylic resins, polyvinylacetal resins can be exemplified, and gelatin is also preferable. Cellulose di(tri)acetate is particularly preferable. The binder can be subjected to curing treatment by adding epoxy-type, aziridine-type, or isocyanate-type crosslinking agents. Examples of an isocyanate-type crosslinking agent include isocyanates such as tolylene diisocyanate, 4,4'-diphenylmethane diisocyanate, hexamethylene diisocyanate, xylylene diisocyanate and the like, reaction products of these isocyanates with polyalcohols (e.g. a reaction product of 3 mol of tolylene diisocyanate with 1 mol of trimethylolpropane), and polyisocyanates produced by condensation of these isocyanates, and the like, and the examples are described in Japanese Patent Application Laid-Open (JP-A) No. 6-59357.

For dispersing the above-described magnetic substance in the above-described binder, a kneader, a pin-type mill, an annular-type mill and the like are preferably used as described in Japanese Patent Application Laid-Open (JP-A) No. 6-35092, and a combination thereof is also preferable. Dispersing agents described in Japanese Patent Application Laid-Open (JP-A) No. 5-088283, and other known dispersing agents can be used. The thickness of the magnetic recording layer is from 0.1 $\mu$m to 10 $\mu$m, preferably from 0.2 $\mu$m to 5 $\mu$m, and more preferably from 0.3 $\mu$m to 3 $\mu$m. The ratio by weight of the magnetic substance particle to the binder is preferably from 0.5:100 to 60:100, and more preferably from 1:100 to 30:100. The amount coated of the magnetic substance particle is from 0.005 to 3 $g/m^2$, preferably from 0.01 to 2 $g/m^2$, and more preferably from 0.02 to 0.5 $g/m^2$. The yellow transmission density concentration of the magnetic recording layer is preferably from 0.01 to 0.50, more preferably from 0.03 to 0.20, and particularly preferably from 0.04 to 0.15. The magnetic recording layer can be made on the whole surface or in stripe form by coating or printing on the back surface of the support for photographic use. For coating the magnetic recording layer, methods using an air doctor, blade, air knife, squeeze, impregnation, reverse roll, transfer roll, gravure, kiss, cast, spray, dip, bar, extrusion and the like can be utilized, and coating solutions described in Japanese Patent Application Laid-Open (JP-A) No. 5-341436 and the like are preferred.

The magnetic recording layer may be endowed with functions such as lubrication improving, curl controlling, electro static charge prevention, adhesion prevention, head abrasion and the like, or an extra layer endowed with these functions may be created. And an abrasive agent in which at least one type of particles is non-spherical inorganic particles having Mohs hardness of 5 or more is preferable. The composition of the non-spherical inorganic particles preferably includes fine particles of materials such as oxides such as aluminum oxide, chromium oxide, silicon dioxide, titanium dioxide, and like, carbides such as silicon carbide, titanium carbide and the like, diamond, and the like. The surface of this abrasive agent may be treated with a silane coupling agent or titanium coupling agent. These particles may be added to the magnetic recording layer, or may be over-coated (for example, a protective layer, lubricant layer and the like) on the magnetic recording layer. As the binder used in these procedures, those which are described above can be used, and preferably, the same binders as those for the magnetic recording layer may be used. Light-sensitive materials having a magnetic recording layer are described in U.S. Pat. Nos. 5,336,589, 5,250,404, 5,229,259, 5,215,874 and European Patent No. 466,130.

The polyester support preferably used in the sensitive material having the above-described magnetic recording layer, will be described below, and the details thereof, including the light-sensitive material, processing, cartridge and examples are described in Laid-open Technical Journal (Kokai-Giho) No. 94-6023 (JAPIO; 1994. 3. 15). The polyester is formed using, as essential component, a diol and an aromatic dicarboxylic acid, and examples of the aromatic dicarboxylic acid include 2,6-, 1,5-, 1,4- and 2,7-naphthalene dicarboxylic acid, terephthalic acid, isophthalic acid and phthalic acid. Examples of the diol include diethylene glycol, triethylene glycol, cyclohexane dimethanol, bisphenol A and bisphenol. Examples of the polymer obtained by these compounds include homopolymers such as polyethylene terephthalate, polyethylene naphthalate, polycylohexane dimethanol terephthalate and the like. A polyester containing 2,6-naphthalene dicarboxylic acid in an amount from 50% by mol to 100% by mol is particularly preferable. Out of these, polyethylene-2,6-naphthalate is particularly preferable. The average molecular weight is in the range from about 5,000 to 200,000. The Tg value of the polyester is not less than 50° C., and preferably not less than 90° C.

Next, the polyester support is subjected to heat treatment at a temperature of not less than 40° C. and less than Tg, and more preferably not less than a temperature which is 20° C. lower than Tg and less than Tg, so as to avoid curling habit of the support. The heat treatment may be conducted at a constant temperature in this temperature range, and also may be conducted while support is being cooled. This heat treatment time is not shorter than 0.1 hour and not longer than 1500 hours, and more preferably not shorter than 0.5 hours and not longer than 200 hours. The heat treatment of the support may be conducted in roll form, or may also be conducted on a support in web form while the support is being transported. The surface condition may be improved by imparting unevenness to the surface (for example, by coating an electroconductive inorganic fine particle such as $SnO_2$, $Sb_2O_5$ and the like.). Further, it is desirable to prepare some type of device for preventing of transfer of the core section by slightly raising only the edge portions by imparting knurl to the edge portions. This heat treatment may be conducted at any step such as after support formation, after surface treatment, after backing layer coating (antistatic agent, sliding agent and the like) or after subbing layer coating. After antistatic agent coating is preferable.

A ultraviolet ray absorber may be kneaded into this polyester. Further, in order to prevent light piping, a dye or pigment commercially available for polyester, such as Diaresin manufactured by Mitsubishi Chemical Co., Ltd., Kayaset manufactured by Nippon Kayaku Co., Ltd. or the like can be kneaded in resulting in the desired effect being obtained.

Next, the film cartridge into which the light-sensitive element can be accommodated is explained. The main material of the cartridge used in the present invention may be metal or synthetic plastic.

The preferable plastic material is polystyrene, polyethylene, polypropylene, polyphenylether or the like. Further, the cartridge may contain various antistatic agents, such as carbon black, metal oxide particles, nonionic, anionic, cationic and betaine-type surfactants, polymers or the like can preferably be used. These cartridges which is prevented from electro static charge are described in Japanese Patent Application Laid-Open (JP-A) Nos. 1-312537 and 1-312538. In particular, it is preferable that the resistance at 25° C. and 25% RH is not more than $10^{12}$ Ω/□. The plastic cartridge is usually produced by using a plastic into which carbon black or a pigment are kneaded to impart light-shielding property. The size of the cartridge may be 135 size which is the present size. Further, in order to make the camera compact, the diameter of a cartridge which is 25 mm corresponding to the present 135 size can be effectively reduced to 22 mm or less. It is preferable that the capacity of the cartridge is not more than 30 $cm^3$, and preferably not more than 25 $cm^3$. The total weight of plastics which are used for the cartridge and cartridge case is preferably from 5 g to 15 g.

Further, a cartridge which feeds a film by rotating a spool can be used. Also, a structure in which the leading edge of the film is housed in the cartridge main body, and the film leading edge is fed from a port of the cartridge to outside, by rotating the spool shaft in the film feeding direction, is also used. These are disclosed in U.S. Pat. Nos. 4,834,306 and 5,226,613.

The light-sensitive element as described above can also be used in a film unit with a lens described in Japanese Patent Application Publication (JP-B) No. 2-32615 and Japanese Utility Model Application Publication (JP-Y) No. 3-39784.

The film unit with a lens is obtained by pre-loaded in a light-proofing manner an unexposed color or monochrome photographic light-sensitive element, in a production process of a unit main body having an injection molded, for example, plastic body, equipped with a photographing lens and shutter. The unit after photographed by a user is transported as such to a developing laboratory for development. In the laboratory, the photographed film is taken out from this unit, and developing and photographic printing are carried out.

On the outer casing of this film unit with a lens, optical parts required for photographing such as a photographing lens, finder part and the like, and photographing operation parts such as a shutter button, winding knob and the like are exposed. This unit is wrapped for use, in a carton or a plastic envelop on which an explanation for the method of use and design are printed, as described in Japanese Utility Model Application Publication (JP-Y) Nos. 3-6910 and 5-31647, Japanese Patent Application Laid-Open (JP-A) No. 7-225454 and Japanese Utility Model Application Publication (JP-Y) No. 6-43798.

The film unit with a lens wrapped in paper or plastic is further wrapped in a dampproof material, for example, a wrapping article composed of a non-hydroscopic material having a water absorption of 0.1% or lower according to ASTM testing method D-570, for example, an aluminum foil laminated sheet, aluminum foil or metal-deposited transparent and dampproof plastic wrapping article, to be sold as described in Japanese Utility Model Application Publication (JP-Y) No. 4-1546 and Japanese Patent Application Publication (JP-B) No. 7-1380. From the viewpoint of storability of the photographic film loaded inside the film unit with a lens, the humidity of the film unit with a lens in the aforementioned dampproof wrapping article is controlled so that the relative humidity at 25° C. is from 40 to 70%, and preferably from 50 to 65%. Further, there is also a unit endowed with an underwater or water-proof function by housing the film unit with a lens, wrapped in paper or plastic in a transparent water-proof case, allowing shuttering and winding operations to be perfomed, as described in Japanese Utility Model Application Publication (JP-Y) Nos. 6-6346 and 6-8589 and U.S. Pat. No. 5,239,324.

The film unit main body from which the photographic film has been taken out in the laboratory is recycled to a production factory of the unit, examined, and then, parts which are able to be reused are reused, and a partial plastic parts which cannot be reused are melted, and made into pellets again for recycling.

As the photographing lens to be used, a plastic lens composed of one or two spherical or aspherical plastic lens is used as described in Japanese Patent Application Publication (JP-B) No. 7-56363, Japanese Patent Application Laid-Open (JP-A) No. 63-199351, Japanese Utility Model Application Publication (JP-Y) Nos. 3-22746, 3-39784, 5-38353, 7-33237 and 7-50746. It is preferable that the film receiving surface in the exposure area of the back lid, is formed with a curved surface so as to be concave in relation to the photographing lens, along the direction in which the film travels, in order to compensate for curvature aberrations in the lens. The finder may be a free through finder formed only by defining a finder aperture on the body corresponding to the image, as described in Japanese Utility Model Application Publication (JP-Y) Nos. 2-41621, 3-6910 and 3-39784, and also may be a reverse Galileo type or Albert type finder obtained by placing an ocular lens and an objective finder lens on the finder aperture as described in Japanese Utility Model Application Publication (JP-Y) No. 7-10345. Further, as described in Japanese Patent Application Laid-Open (JP-A) Nos. 7-64177, 6-250282 and 7-128732, it may also be possible that an image size switching function is imparted to the finder, and accordingly the photographing aperture can be switched to normal exposure size or panoramic exposure size or optical or magnetic information is recorded on the film to record that photographing has been conducted at standard, panoramic or high vision size according to this switching action of the finder. In addition, there is also a unit which can carry out close up photographing or telephotographing by altering the focal length of the photographing lens and specifying the finder visual field.

As the photographic film used in the film unit with lens, a film in the form of a sheet or roll can be used, and further, the photographic film is directly loaded as described in Dutch Patent (DP) No. 6,708,489, or loaded in a container before being loaded in the film unit with a lens as described in Japanese Patent Application Publication (JP-B) No. 2-32615. After being photographed, in order to take out the photographed film from the film unit with a lens for development, a lid may be made for taking out the photographed film at the bottom of the film unit body with a lens, and the lid may be opened for taking out the film as described in Japanese Patent Application Publication (JP-B) No. 6-16158 and Japanese Utility Model Application Publication (JP-Y) No. 7-15545, or the back lid may be opened or broken to take out the photographed film as described in DP No. 6,708,489. Further, as described in U.S. Pat. No. 5,202,713, an opening which is usually in light-shielded condition may be formed on a part of the film unit body with a lens, and one end of the film then may be clamped and the film may be drawn out by the clamp.

When a photographic film in the form of a roll is used in the film unit with a lens, it is desirable that the photographic film in the form of a roll is loaded in a container and the container is loaded in the film unit with a lens. As the container used, there are advantageously used cartridges for 135 film prescribed by the ISO Standard described in Japanese Patent Application Laid-Open (JP-A) Nos. 54-111822 and 63-194255, U.S. Pat. Nos. 4,832,275 and 4,834,306, Japanese Patent Application Laid-Open (JP-A) Nos. 2-124564, 3-155544, 2-264248, Japanese Utility Model Application Publication (JP-Y) No. 5-40508, Japanese Patent Application Publication (JP-B) Nos. 2-32615 and 7-117707, or cartridges having a narrower diameter than that of the above-described Standard which can accommodate a photographic film prescribed in the ISO standard, or single-shaft cartridges having a spool to which one end of a film is fixed, such as a cartridge for APS (Advanced Photo System) described in Japanese Patent Application Laid-Open (JP-A) Nos. 8-211509, 8-262645 and 8-262639. Further, two-shaft cartridges using a 110 size standard film described in Japanese Utility Model Application Publication (JP-Y) Nos. 4-14748 and 3-22746 can also be used. And optionally, a photographic film having a backing paper can also be used.

When the single-shaft axial cartridge having a spool to which one end of a film is fixed is used, it is possible that prewind loading during the production stages (factory prewind) of the film unit with a lens is conducted in which the cartridge is housed in one compartment of the film unit with a lens, and most of the photographic film, drawn from the cartridge and wound in the form of a roll, is housed in another compartment, and a part of the photographic film drawn out of the compartment after each photograph is taken is wound on the cartridge by rotating the spool of the cartridge using an external winding member, or reversely, that a spool not in the cartridge to which the leading end of the photographic film is fixed, is housed in one accommodation compartment of the film unit with a lens, and the cartridge in which most of the photographic film is loaded is housed in another compartment, and the photographic film is drawn out from the cartridge and wound on the spool not in the cartridge by an external winding member after each photograph is taken.

In the factory prewind method, the photographic film drawn out from the cartridge may be wound on a spool not in the cartridge, and may be loaded in another compartment, or as described in Japanese Patent Application Publication (JP-B) No. 2-32615, may be loaded in another compartment in an empty state. Further, in the above-described factory prewind, it is possible that the photographic film is previously drawn out from the cartridge to be wound in the form of a roll in a dark soon, this cartridge and the photographic film in the form of a roll are loaded in the film unit with a lens, then the back lid of the film unit with a lens is closed to shield from the light as described in Japanese Patent Application Publication (JP-B) No. 7-56564, or the cartridge in which most of the photographic film is loaded is housed in one compartment, and a spool not in the cartridge to which the leading end of the photographic film is fixed, is housed in another compartment, and the back lid is closed to shield from the light, then the film is wound from the first spool to the other spool by rotating it from the outside of the film unit.

As described in Japanese Utility Model Application Publication (JP-Y) Nos. 4-1546 and 7-20667, the film unit with a lens is advantageously equipped with a self cocking mechanism which, from the driving action of the slave sprocket when it is engaged by the film perforations during the winding action after each photograph is taken, charges the shutter mechanism to kick the shutter blades, as well as preventing the film from being wound on any further. The charged shutter mechanism is released from the charged position by the action of depressing the shutter button, kicking the shutter blades to make the exposure and take the photograph and, at the same time, making rewinding of the film possible. Further, the film unit with a lens may build in a flashtube circuit board on the outside of which a switch is made for the flashtube charging, and in this case, a structure may be formed in which the flash output is linked with the photographing operation by the turning on of a flash synchronizing switch in response to the above-described photographing exposure operation by the shutter blades, as described in Japanese Utility Model Application Publication (JP-Y) Nos. 2-34688, 6-41227, Japanese Patent Application Laid-Open (JP-A) No. 7-122389 and Japanese Patent Application Publication (JP-B) No. 6-12371.

On the other hand, as described in Japanese Utility Model Application Publication (JP-Y) No. 4-1546, a counter displaying the number of photographs taken or remaining is provided on the film unit with a lens. Further, this counter has a mechanism which release the above-described shutter charge and the frame by frame winding preventor in response to winding up after photographing of the final frame, and by this mechanism, the photographic film can be wound up continuously to the final winding position by the subsequent winding action.

Next, the processing element (heat development processing sheet) is explained below.

The processing layer of the processing element used in the present invention contains at least a base and/or base precursor.

As the base, an inorganic or organic base can be used. Examples of the inorganic base include hydroxides, phosphates, carbonates, borates and organic acid salts of alkali metal or alkaline earth metal described in Japanese Patent Application Laid-Open (JP-A) No. 62-209448, and acetylides of alkaline metal or alkaline earth metal, and the like described in Japanese Patent Application Laid-Open (JP-A) No. 63-25208.

Examples of the organic base include ammonia, aliphatic or aromatic amines (e.g. primary amines, secondary amines, tertiary amines, polyamines, hydroxylamines, heterocyclic amines), amidines, bis or tris or tetraamidine, guanidines, water-insoluble mono, bis, tris or tetraguanidines, hydroxides of quaternary ammonium, and the like.

As the base precursor, decarboxylated type, decomposition type, reaction type and complex salt-forming type precursors can be used.

In the present invention, as described in European Patent Application No. 210,660 and U.S. Pat. No. 4,740,445, it is effective to adopt a method in which a base is generated by combining, as the base precursor, a basic metal compound poorly soluble in water, and a metal ion constituting the basic metal compound with a compound which can cause a complex forming reaction (referred to as complex forming compound) using water as a medium. In this case, it is desirable that the basic metal compound poorly soluble in water is added to the light-sensitive element and the complex forming compound is added to the processing element, however, the reverse structure is possible.

The amount used of the base or base precursor is from 0.1 to 20 g/m$^2$, and preferably from 1 to 10 g/m$^2$.

As the binder of the processing layer, the same hydrophilic polymer as that for light-sensitive element can be used. It is preferable that the processing element is hardened by a hardener similar to the light-sensitive element. As the hardener, the same compound as that for the light-sensitive element can be used.

The processing element can contain a mordanting agent for the purpose of transferring and removal of a dye used in the yellow filter layer or anti-halation layer of the light-sensitive element described above. As the mordanting agent, a polymer mordant is preferable. Examples thereof include polymers containing a secondary or tertiary amino group, polymers having nitrogen-containing heterocycle portion, polymers containing a quaternary cationic group and the like having a molecular weight from 5000 to 200000, particularly from 10000 to 50000.

Specific examples thereof are described in U.S. Pat. Nos. 2,548,564, 2,484,430, 3,148,061, 3,756,814, 3,625,694, 3,859,096, 4,128,538, 3,958,995, 2,721,852, 2,798,063, 4,168,976, 3,709,690, 3,788,855, 3,642,482, 3,488,706, 3,557,066, 3,271,147, 3,271,148, 2,675,316, 2,882,156, BP Nos. 1277453, Japanese Patent Application Laid-Open (JP-A) Nos. 54-115228, 54-145529, 54-126027, 50-71332, 53-30328, 52-155528, 53-125, 53-1024, and the like.

The amount added of the mordant is from 0.1 g/m$^2$to 10 g/m$^2$, and preferably from 0.5 g/m$^2$ to 5 g/m$^2$.

In the present invention, it may also be possible that a developing stopper or a precursor of a developing stopper is contained in the processing element, and the developing stopper acts simultaneously with the development or at delayed timing.

The developing stopper herein described represents a compound which quickly neutralizes a base or reacts with a base to reduce the base concentration in the layer to stop the development after suitable developing, or a compound which causes interaction with silver or a silver salt to inhibit the development. The specific examples thereof include an acid precursor which releases an acid upon heating, an electrophilic compound which causes substitution reaction with a coexistent base upon heating, a nitrogen-containing heterocyclic compound, a mercapto compound and precursors thereof. The details are described in Japanese Patent Application Laid-Open (JP-A) No. 62-190529, pp. 31 to 32.

The processing element may have a protective layer, subbing layer, backing layer and other various auxiliary layers similar to the light-sensitive element.

In the processing element, it is preferable that a processing layer is provided on a continuous web. The continuous web as herein described represents a configuration in which the length of the processing element is fully longer than the longitudinal length of the corresponding light-sensitive element in processing, no partial cutting thereof is required when used in the processing, and the processing element has a length which enables the processing of a plurality of the light-sensitive elements. In general, the length of the processing element is not less than 5-times and not more than 10000-times of the width. The width of the processing element is not restricted, and preferably not less than the width of the corresponding light-sensitive element.

Further, a configuration in which a plurality of the light-sensitive elements are arranged side by side, namely, a plurality of the light-sensitive elements are arranged to be processed is also preferable. In this case, it is preferable that the width of the processing element is not less than the product of the width of the light-sensitive element×the number of light-sensitive elements to be simultaneously processed.

It is preferable that in continuous web process such as this, the processing element is f ed f rom a f eeding roll and wound on a winding roll to be discharged. In the case of a particularly large light-sensitive element, the discharge is easy.

As described above, the processing element in the continuous web processing method has remarkably increased handling properties as compared with a conventional sheet element.

The thickness of the support used in the processing element of the present invention is not restricted, however, thinner is preferable, and particularly preferably, not less than 4 $\mu$m and not more than 120 $\mu$m. It is particularly preferable to use a processing element in which the thickness of the support is not more than 40 $\mu$m, and in this case, the amount of the processing element per unit volume is high, therefore, the above-described roll for the processing element can be made compact.

The material of the support is not particularly restricted, and any material that can tolerate the processing temperature is used. In general, supports for photography, such as the paper described in "Fundamentals of Photographic Engineering—Volume of Silver Salt Photography" edited by Photographic Society of Japan, Corona Publishing Co. (1979) (pp 223 to 240) synthetic polymers (films) and the like are listed.

The material for the support can be used alone, and further, may be laminated or coated on one surface or both surfaces with a synthetic polymer such as polyethylene and the like to make a support to be used.

In addition, support described in Japanese Patent Application Laid-Open (JP-A) No. 62-253159, pp 29 to 31, Japanese Patent Application Laid-Open (JP-A) No. 1-161236, pp 14 to 17 Japanese Patent Application Laid-Open (JP-A) No. 63-316848, Japanese Patent Application Laid-open (JP-A) Nos. 2-22651 and 3-56955, U. S. Pat. No. 5, 001, 033 and the like can be used.

Further, a support composed of a styrene-based polymer mainly having syndiotactic structure can preferably be used.

On the surface of the support, a hydrophilic binder and a semiconductive metal oxide such as alumina sol and tin oxide, carbon black and other antistatic agent may be coated. A support on which aluminum is vapor-deposited can preferably be used.

In the present invention, for heat development of a light-sensitive element which has been photographed by a camera and the like, in the presence of water in an amount corresponding to the amount of from 0.1 to 1-times the amount required for maximally swelling the total coated layers of the light-sensitive element and the processing element excluding a back layer of the light-sensitive element and the processing element, the light-sensitive element is superposed on the processing element such that the light-sensitive layer faces the processing layer and the both elements are heated to a temperature of from 60° C. to 100° C. for the time of from 5 seconds to 60 seconds.

As the water herein described, any water may be used provided it is normally used. Specific examples thereof to be used include distilled water, ion-exchanged water, tap water, well water, mineral water and the like. A small amount of preservative may be added to these types of water, for the purpose of prevention of scale generation, prevention of corrosion and the like, or else a method in which water is circulated to be filtered by an active carbon filter, an ion exchange resin filter and the like can be preferably used.

In the present invention, the light-sensitive element and/or processing element are laminated in water-swollen conditions and are heated. The condition of the layer in this swelling is unstable, and consequently it is important to limit the amount of water within the above-described range to prevent local uneven color developing.

The amount of water necessary for the maximum swelling can be calculated when a light-sensitive element or processing element having coating layers to be measured is immersed in water to be used, the layer thickness is measured when sufficient swelling is obtained, the maximum swelling amount is calculated and the weight of the coated layers is reduced. Examples of the measuring method for the degree of swelling are also described in Photographic Science Engineering, vol. 16, page 449 (1972).

For providing water, there is a method in which the light-sensitive element or processing element is immersed in water, and excess water is removed by a squeeze roller. However, it is preferable that water in a bare predetermined amount is provided to the light-sensitive element or processing element. Further, a method is particularly preferable in which water is sprayed by a water spraying apparatus which has a plurality of nozzles, which are arranged in a straight line along the direction perpendicular to the transporting direction of the light-sensitive element or processing element, so that the nozzles eject spray water, and also has an actuator which deflects the above-described nozzle toward the light-sensitive element or the processing element on the transporting path. Further, an apparatus which coats water by sponge and the like is simple and preferably used.

The temperature of water to be supplied is preferably from 30° C. to 60° C.

As the examples of the method for laminating the light-sensitive element and processing element, there are methods described in Japanese Patent Application Laid-Open (JP-A) Nos. 62-253159 and 61-147244.

As the heating method in the development step, there are methods in which the element is brought into contact with a heated block or plate, or the element is brought into contact with a heat plate, a hot pressure, a hot press, a heat roller, a heat drum, a halogen lamp heater, an infrared and far-infrared lamp heater, or other methods where the element is passed through a hot atmosphere.

Any of various heat developing apparatuses can be used in the processing of the present invention. For example, apparatuses described in Japanese Patent Application Laid-Open (JP-A) Nos. 59-75247, 59-177547, 59-181353, 60-18951, Japanese Utility Model Application Laid-Open (JP-U) Nos. 62-25944, Japanese Patent Application Nos. 4-277517, 4-243072, 4-244693, 6-164421, 6-164422 and the like are preferably used.

As for commercially available apparatuses, Pictrostat 100, Pictrostat 200, Pictrostat 300, Pictrostat 330, Pictrostat 50, Pictrography 300, Pictrography 2000, and the like manufactured by Fuji Photo film Co., Ltd can be used.

The light-sensitive element and/or processing element used in the present invention may have a structure containing an electroconductive heat generating layer for heat development. As the heat generating element in the present invention, materials described in Japanese Patent Application Laid-Open (JP-A) No. 61-145544 and the like can be used.

The image forming method of the present invention can have a water-washing process after any processing step. There is a method in which the light-sensitive element is immersed in a water-washing solution after the processing, and excess water is removed by a squeeze roller. However, it is preferable that the water in a bare predetermined amount is provided to the light-sensitive element or processing element, and excess water is removed by a squeeze roller or beat roller. Further, a method is particularly preferable in which water is sprayed by a water spraying apparatus which has a plurality of nozzles which are arranged in straight line along the direction perpendicular to the transporting direction of the light-sensitive element or processing element, so that the nozzles eject spray water, and also has an actuator which deflects the above-described nozzles toward the light-sensitive element or the processing element on the transporting path, and in which excess water is removed by a squeeze roll and the like.

The processing temperature is from room temperature to 60° C., and the processing time is from 5 seconds to 60 seconds. The amount of water used for washing in the water-washing step can be optionally determined depending on various conditions such as the washing water temperature, the replenishing method of washing water, the method of providing the washing water and the like, and is preferably from 0.5-times to 1000-times of the maximum swelling volume of the light-sensitive element or the processing element after the processing, and preferably from 2-times to 10-times from the viewpoint of processing the waste washing water.

Any water may be used as the washing water. Specifically, distilled water, ion-exchanged water, tap water, well water, mineral water and the like can be used. A preservative or surfactant may be added in a small amount to these types of water to prevent scale generation, corrosion and the like, or there is preferably used a method in which water is circulated to be filtered by an active carbon filter, an ion exchange resin filter and the like.

It is also possible to control the pH value of the washing water in the water-washing process depending on the pKa of the color developed dye. In this case, as the bases which can be added to the washing water, those which can be added to the processing element used for the heat development of the light-sensitive element can be used. To promote dissociation of the color developed dye, it is preferable that an organic base is used.

In the present invention, after an image is formed on the light-sensitive element, a color image is obtained on other recording materials based on the information thereof. For this, a light-sensitive element such as a color printing paper may be used and usual projection exposure may be conducted, however, it is preferable that image information based on the density obtained by measuring transmitted light is photoelectrically read, converting this to a digital signal, and outputted onto other recording materials according to the signal after image processing. As the material to be outputted, sublimation type heat sensitive recording materials, full color direct heat sensitive recording materials, inkjet materials, electrophotographic material and the like may be used in addition to light-sensitive materials using a silver halide.

EXAMPLE

The following examples further illustrate the effect of the present invention in detail.

Production Example 1

<preparation of a light-sensitive silver halide emulsion>

A preparation method for a blue light-sensitive silver halide emulsion (1) is described below.

Into a reaction vessel was charged 1191 ml of distilled water containing 0.96 g of gelatin having an average molecular weight of 12000, and 0.9 g of potassium bromide, and the solution was heated up to 40° C. To this solution were added 10.5 ml of an aqueous solution (A) containing 0.5 g of silver nitrate, and 10 ml of an aqueous solution (B) containing 0.35 g of potassium bromide, over 150 seconds with vigorous stirring. At 30 seconds after completion of the addition, 12 ml of 10% aqueous potassium bromide solution was added, and after 30 seconds, the temperature of the reaction solution was raised to 75° C. To this were added 35.0 g of a lime-processed gelatin, and 250 ml of distilled water, then 39 ml of an aqueous solution (C) containing 10.0 g of silver nitrate, and 30 ml of an aqueous solution (D) containing 6.7 g of potassium bromide were added while accelerating the addition flow rate over 3 minutes and 15 seconds. Then, 302 ml of an aqueous solution (E) containing 96.7 g of silver nitrate, and an aqueous solution (F) containing potassium iodide at a molar ratio to potassium bromide of 7:93 (concentration of potassium bromide: 26%) were added while accelerating the addition flow rate and with controlling the silver electrode potential of the reaction solution at −20 mV with reference to the saturated calomel electrode over 20 minutes. Further, 97 ml of an aqueous solution (G) containing 24.1 g of silver nitrate, and a 21.9% aqueous solution of potassium bromide (H) were added while controlling the silver electrode potential of the reaction solution at 25 mV with reference to the saturated calomel electrode over 3 minutes. After completion of the addition, the solution was kept at 75° C. for one minute, then, the temperature of the reaction solution was lowered to 55° C. Then, 15 ml of 1 N sodium hydroxide was added. After two minutes, 100 ml of an aqueous solution (I) containing 5 g of silver nitrate, and 200.5 ml of an aqueous solution (J) containing 4.7 g of potassium iodide were added over 5 minutes. After completion of the addition, 7.11 g of potassium bromide was added, and the solution was kept at 55° C. for one minute, then 248 ml of an aqueous solution (K) containing 62 g of silver nitrate, and 231 ml of an aqueous solution (L) containing 48.1 g of potassium bromide were further added over 8 minutes. After 30 seconds, an aqueous solution containing 0.03 g of sodium ethylthiosulfonate was added. The temperature was lowered, and desalting was conducted by flocculating and precipitating emulsion particles using Demol manufactured by Kao Corp. Dispersion was conducted by adding sodium benzenethiosulfonate, phenoxyethanol, water-soluble polymer (10) and lime-processed gelatin.

Chemical sensitization was conducted at a temperature of 60° C. A sensitizing dye (12) was added in the form of a gelatin dispersionbefore chemical sensitization, then a mixed solution of potassium thiocyanate and chloroauric acid was added, then sodium thiosulfate and a selenium sensitizing agent were added, and the chemical sensitization was stopped with a mercapto compound. The amounts of the sensitizing dye, chemical sensitizing agent and mercapto compound were optimized in accordance with sensitivity and fogging.

In the particles in the resulting emulsion, tabular grains occupied a proportion of over 99% of the total projection area of the total grains, and the average equivalent-sphere diameter was 1.07 μm, the average grain thickness was 0.38 μm, the average equivalent circle diameter was 1.47 μm and the average aspect ratio was 3.9.

Sensitizing dye (12)

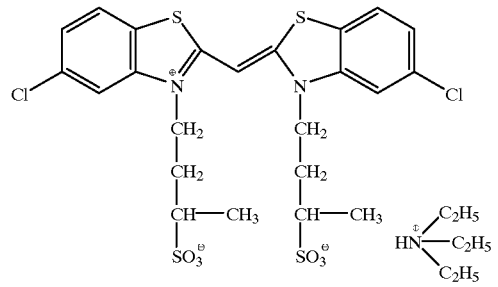

Water-soluble polymer (10)

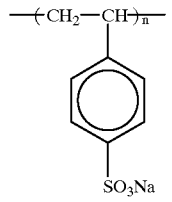

Selenium sensitizing agent

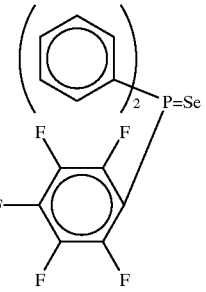

Mercapto compound

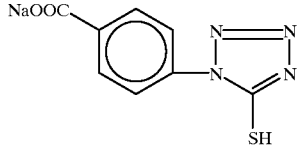

A preparation method for a blue light-sensitive silver halide emulsion (2) is described below.

Into a reaction vessel was charged 1191 ml of distilled water containing 0.96 g of gelatin having an average molecular weight of 12000 and 0.9 g of potassium bromide, and the solution was heated up to 40° C. To this solution were added 37.5 ml of an aqueous solution (A) containing 1.5 g of silver nitrate, and 37.5 ml of an aqueous solution (B) containing 1.051 g of potassium bromide over 90 seconds with vigorous stirring. At 30 seconds after completion of the addition, 12 ml of 10% aqueous potassium bromide solution was added, and after 30 seconds, the temperature of the reaction solution was raised to 75° C. To this solution were added 35.0 g of a lime-processed gelatin, and 250 ml of distilled water, then 116 ml of an aqueous solution (C) containing 29.0 g of silver nitrate, and 91 ml of an aqueous solution (D) containing 20 g of potassium bromide were added while accelerating the addition flow rate over 11 minutes and 35 seconds. Then 302 ml of an aqueous solution (E) containing 96.7 g of silver nitrate, and an aqueous solution (F) containing potassium iodide at a molar ratio to potassium bromide of 3.3 96.7 (concentration of potassium bromide: 26%) were added while accelerating the addition flow rate and controlling the silver electrode potential at 2 mv with reference to the saturated calomel electrode over 20 minutes. Further, 97 ml of an aqueous solution (G) containing 24.1 g of silver nitrate, and a 21.9% aqueous solution of potassium bromide (H) were added while controlling the silver electrode potential of the reaction solution at 0 mV with reference to the saturated calomel electrode over 3 minutes. After completion of the addition, the solution was kept at 75° C. for one minute, then the temperature of the reaction solution was lowered to 55° C. Then, 15 ml of 1 N sodium hydroxide was added. After two minutes, 153 ml of an aqueous solution (I) containing 10.4 g of silver nitrate, and 414.5 ml of an aqueous solution (J) containing 9.35 g of potassium iodide were added over 5 minutes. After completion of the addition, 7.11 g of potassium bromide was added, and the solution was kept at 55° C. for one minute, then 228 ml of an aqueous solution (K) containing 57.1 g of silver nitrate, and 201 ml of an aqueous solution (L) containing 43.9 g of potassium bromide were further added over 8 minutes. After 30 minutes, an aqueous solution containing 0.04 g of sodium ethylthiosulfonate was added. The temperature was lowered, and desalting was conducted in the same manner as for the blue color light-sensitive silver halide emulsion (1). The chemical sensitization was conducted in the same manner, except that the blue light-sensitive silver halide emulsion (1), and the selenium sensitizing agent were not added. The sensitizing dye and the mercapto compound for stopping the chemical sensitizing were approximately in proportion to the surface area of the emulsion grains.

In the grains in the resulting emulsion, tabular grains occupied a proportion of over 99% of the total projection area of the total grains, and the average equivalent-sphere diameter was 0.66 μm, the average thickness was 0.17 μm, the average grain equivalent circle diameter was 1.05 μm and the average aspect ratio was 6.3.

A preparation method for a blue light-sensitive silver halide emulsion (3) is described below.

Into a reaction vessel was charged 1345 ml of distilled water containing 17.8 g of lime-processed gelatin, 6.2 g of potassium bromide, and 0.46 g of potassium iodide, and the solution was heated up to 45° C. To this solution were added 70 ml of an aqueous solution (A) containing 11.8 g of silver nitrate, and 70 ml of an aqueous solution (B) containing 3.8 g of potassium bromide over 45 seconds with vigorous stirring. After keeping the temperature at 45° C. for 4 minutes, the temperature of the reaction solution was raised to 63° C. To this solution were added 24 g of a lime-processed gelatin, and 185 ml of distilled water, then 208 ml of an aqueous solution (C) containing 73 g of silver nitrate, and a 24.8% aqueous solution of potassium bromide (D) were added while accelerating the addition flow rate and controlling the silver electrode potential at 0 mV with reference to the saturated calomel electrode over 13 minutes. After completion of the addition, the temperature of the solution was kept at 63° C. for 2 minutes, then the temperature was lowered to 45° C. Then, 15 ml of 1N sodium hydroxide solution was added. After 2 minutes, 60 ml of an aqueous solution (E) containing 8.4 g of silver nitrate, and 461 ml of an aqueous solution (F) containing 8.3 g of potassium iodide were added over 5 minutes. Further, 496 ml of an aqueous solution (G) containing 148.8 g of silver nitrate and a 25% aqueous solution of potassium bromide (H) were added while controlling the silver electrode potential of the reaction solution at 90 mV with reference to the saturated calomel electrode over 47 minutes. At 30 seconds after completion of the addition, an aqueous solution containing 2 g of potassium bromide, and 0.06 g of sodium ethylthiosulfonate were added. The temperature was lowered, and the desalting, dispersion and chemical sensitization were conducted in the same manners as for the blue color light-sensitive silver halide emulsion (2).

The grains in the resulting emulsion were a hexagonal tabular grains in which the average equivalent-sphere diameter was 0.44 μm, the average grain thickness was 0.2 μm, the average equivalent circle diameter was 0.53 μm and the average aspect ratio was 2.6.

A preparation method for a green light-sensitive silver halide emulsion (4) is described below.

Into a reaction vessel was charged 1191 ml of distilled water containing 0.96 g of gelatin having an average molecular weight of 12000 and 0.9 g of potassium bromide, and the solution was heated up to 40° C. To this solution were added 17.5 ml of an aqueous solution (A) containing 0.7 g of silver nitrate, and 17.5 ml of an aqueous solution (B) containing 1.051 g of potassium bromide over 120 seconds with vigorous stirring. At 30 seconds after completion of the addition, 12 ml of 10% aqueous potassium bromide solution was added, and after 30 seconds, the temperature of the reaction solution was raised to 75° C. To this solution was added 35.0 g of a lime-processed gelatin, together with 250 ml of distilled water, then 56ml of an aqueous solution (C) containing 19.0 g of silver nitrate, and 461 ml of an aqueous solution (D) containing 10 g of potassium bromide were added while accelerating the addition flow rate over 7 minutes and 35 seconds. Then 302 ml of an aqueous solution (E) containing 96.7 g of silver nitrate, and an aqueous solution (F) containing potassium iodide at a molar ratio to potassium bromide of 3.3:96.7 (concentration of potassium bromide: 26%) were added while accelerating the addition flow rate and with controlling the silver electrode potential at 0 mV with reference to the saturated calomel electrode over 20 minutes. Further, 97 ml of an aqueous solution (G) containing 24.1 g of silver nitrate and a 21.9% aqueous solution of potassium bromide (H) were added with controlling the silver electrode potential of the reaction solution at 0 mV with reference to the saturated calomel electrode over 3 minutes. After completion of the addition, the solution was kept at 75° C. for one minute, then, the temperature of the reaction solution was lowered to 55° C. Then, 122 ml of an aqueous solution (I) containing 8.3 g of silver nitrate, and 332 ml of an aqueous solution (J) containing 7.48 g of potassium iodide were added over 5 minutes. After completion of the addition, 7.11 g of potassium bromide was added, and the solution was kept at 55° C. for one minute, then 228 ml of an aqueous solution (K) containing 62.8 g of silver nitrate, and 201 ml of an aqueous solution (L) containing 48.3 g of potassium bromide were further added over 8 minutes. The temperature was lowered, and desalting and dispersion were conducted in the same manners as for the blue light-sensitive silver halide emulsion (1). The chemical sensitization was also conducted in the same manner as for the blue light-sensitive silver halide emulsion (1), except that a gelatin dispersion of a mixture of sensitizing dyes (13), (14) and (15) was used instead of sensitizing dye (12). Here, the mixing ratio of the sensitizing dyes (13), (14) and (15) was 12:2:1 (molar ratio).

In the particle in the resulting emulsion, tabular grains occupied a proportion of over 99% of the total projection area of the total grains, and the average equivalent-sphere diameter was 0.85 μm, the average grain thickness was 0.26 μm, the average equivalent circle diameter was 1.25 μm and the average aspect ratio was 4.8.

Sensitizing dye for green light-sensitive emulsion (13)

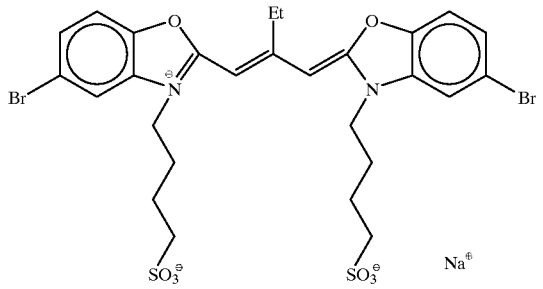

Sensitizing dye for green light-sensitive emulsion (14)

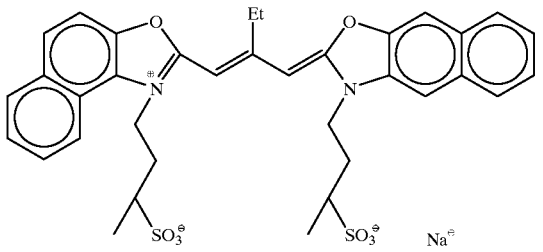

Sensitizing dye for green light-sensitive emulsion (14)

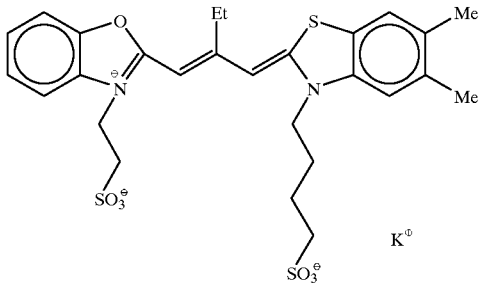

A preparation method for a green light-sensitive silver halide emulsion (5) is described below.

The grain formation, desalting and dispersion were conducted in the same manners as for the blue light-sensitive silver halide emulsion, except that sodium hydroxide and sodium ethylthiosulfonate were not added during the grain formation, and the chemical sensitization was conducted in the same manner as for the green light-sensitive silver halide emulsion (4), to prepare an emulsion.

In the grains in the resulting emulsion, tabular grains occupied a proportion of over 99% of the total projection area of the total grains, and the average equivalent-sphere diameter was 0.66 μm, the average grain thickness was 0.17 μm, the average equivalent circle diameter was 1.05 μm and the average aspect ratio was 6.3.

A preparation method for a green light-sensitive silver halide emulsion (6) is described below.

The grains formation, desalting and dispersion were conducted in the same manners as for the blue light-sensitive silver halide emulsion (3), except that sodium hydroxide was not added during the grain formation and the amount of sodium ethylthiosulfonate was changed to 4 mg, and an emulsion was prepared in the same manner as for the green color light-sensitive silver halide emulsion (4), except that no selenium sensitizing agent was added in the chemical sensitization.

The grains in the resulting emulsion were a hexagonal tabular grains in which the average equivalent-sphere diameter was 0.44 μm, the average grain thickness was 0.2 μm, the average equivalent circle diameter was 0.53 μm and the average aspect ratio was 2.6.

A preparation method for a red light-sensitive silver halide emulsion (7) is described below.

An emulsion was prepared in the same manners as for the green light-sensitive silver halide emulsion (4), except that a gelatin dispersion of a sensitizing dye (16), and a gelatin dispersion of a mixture of sensitizing dyes (17) and (18) were added as the sensitizing dye in the chemical sensitization. Here, the mixing ratio of the sensitizing dyes (16), (17) and (18) was 40:2:58 (molar ratio).

In the resulting grains, tabular grains occupied a proportion of over 99% of the total projection area of the total grains, and the average equivalent-sphere diameter was 0.85 μm, the average grain thickness was 0.26 μm, the average equivalent circle diameter was 1.25 μm and the average grain aspect ratio was 4.8.

A preparation method for a red color light-sensitive silver halide emulsion (8) is described below.

Sensitizing dye for red light-sensitive emulsion (16)

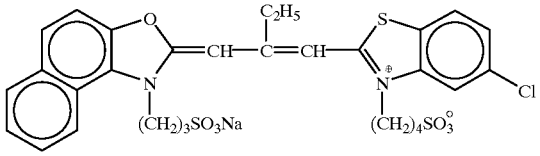

Sensitizing dye for red light-sensitive emulsion (17)

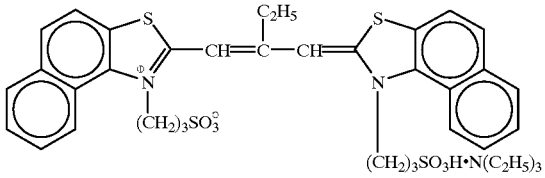

Sensitizing dye for red light-sensitive emulsion (18)

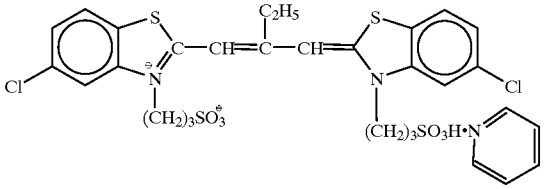

An emulsion was prepared in the same manners as for the green color light-sensitive silver halide emulsion (5), except that a gelatin dispersion of a sensitizing dye (16), and a gelatin dispersion of a mixture of sensitizing dyes (17) and (18) were added as the sensitizing dye in the chemical sensitization. Here, the mixing ratio of the sensitizing dyes (16), (17) and (18) was 40:2:58 (molar ratio).

In the grains in the resulting emulsion, tabular grains occupied a proportion of over 99% of the total projection area of the total grains, and the average equivalent-sphere diameter was 0.66 μm, the average grain thickness was 0.17 μm, the average equivalent circle diameter was 1.05 μm and the average aspect ratio was 6.3.

A preparation method for a red light-sensitive silver halide emulsion (9) is described below.

An emulsion was prepared in the same manners as for the green light-sensitive silver halide emulsion (6), except that a gelatin dispersion of a sensitizing dyes (16), and a gelatin dispersion of a mixture of sensitizing dyes (17) and (18) were added as the sensitizing dye in the chemical sensitization.

The grains in the resulting emulsion were a hexagonal tabular grains, in which the average equivalent-sphere diameter was 0.44 μm, the average grain thickness was 0.2 μm, the average equivalent-circle diameter was 0.53 μm and the average aspect ratio was 2.6.

<Preparation of zinc hydroxide dispersion>

A powder of zinc hydroxide (31 g) having a primary grain size of 0.2 μm, 1.6 g of carboxymethylcellulose and 0.4 g of sodium polyacrylate as a dispersing agent, 8.5 g of lime-processed osein gelatin and 158.5 ml of water were mixed, and this mixture was dispersed for 1 hour with a mill using glass beads. After the dispersion, the glass beads were separated by filtration to obtain 188 g of a dispersion of zinc hydroxide.

<Preparation of emulsified dispersion of color developing agent and coupler>

Oil phase components the following Table 1, and aqueous phase components of which the compositions are shown in the following Table 1, were respectively dissolved, to obtain uniform solutions of 60° C. The oil phase components and aqueous phase components were combined, and dispersed for 20 minutes at 10000 rpm by a dissolver equipped with a disperser, having a diameter of 5 cm in 1 liter stainless vessel. To this was added hot water in an amount shown in Table 1 as later added water, and mixed for 10 minutes at 2000 rpm. In this manner, emulsified dispersions of three couplers of cyan, magenta and yellow were prepared.

TABLE 1

| | | Cyan | Magenta | Yellow |
|---|---|---|---|---|
| Oil phase | Cyan dye-forming coupler (1) | 5.63 g | — | — |
| | Magenta dye-forming coupler (2) | — | 6.87 g | — |
| | Yellow dye-forming coupler (3) | — | — | 7.86 g |
| | Developing agent (4) | 3.57 g | 5.11 g | 5.11 g |
| | Developing agent (5) | 1.53 g | — | — |
| | Anti-fogging agent (5) | 3.0 mg | 1.0 mg | 10.0 mg |
| | Organic solvent having a high boiling point (6) | 8.44 g | 5.27 g | 6.09 g |
| | Ethyl acetate | 24.0 ml | 24.0 ml | 24.0 ml |
| Water phase | Lime-processed gelatin | 12.0 g | 12.0 g | 12.0 g |
| | Surfactant (7) | 0.60 g | 0.60 g | 0.60 g |
| | Water | 138.0 ml | 138.0 ml | 138.0 ml |
| | Later added water | 180.0 ml | 180.0 ml | 180.0 ml |

Cyan dye-forming coupler (1)

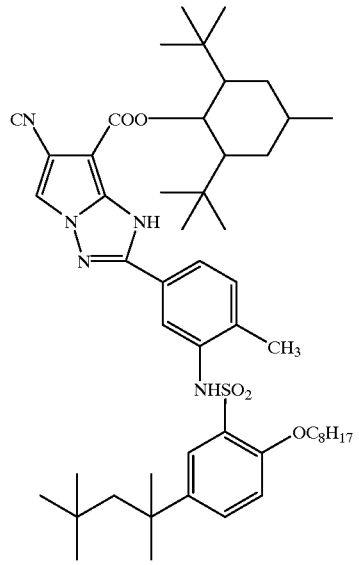

-continued

Magenta dye-forming coupler (2)

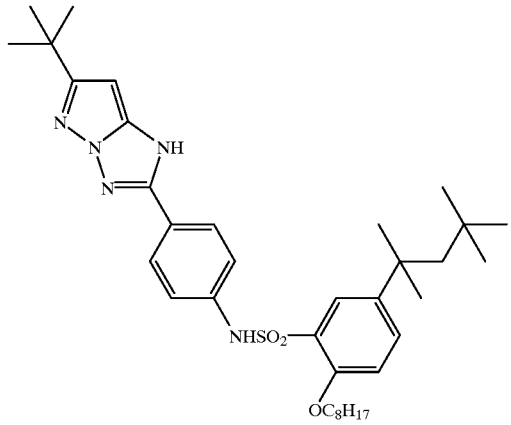

Yellow dye-forming coupler (3)

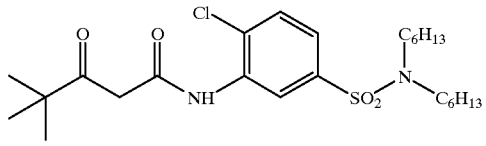

Developing agent (4)

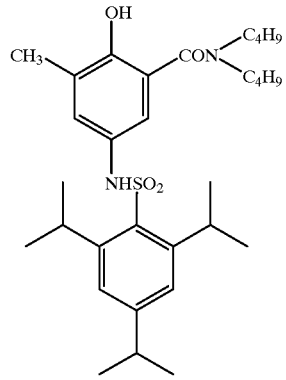

Developing agent (5)

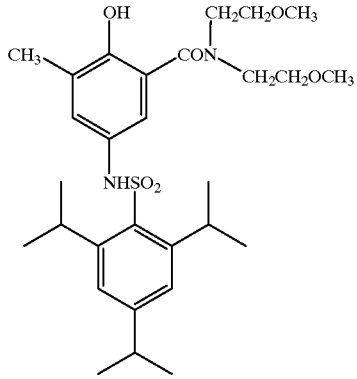

Anti-fogging agent (5)

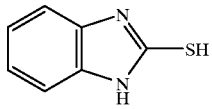

-continued

Organic solvent having a high boiling point (6)

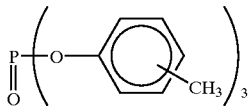

Surfactant (7)

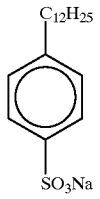

<Preparation of dye compositions for yellow filter layer and anti-halation layer>

Dye compositions were prepared as emulsified dispersions as described below and added.

A leuco dye and developer, and optionally an organic solvent having a high boiling point were weighed, and ethyl acetate was added, and they were dissolved while being heated at about 60° C. to obtain a uniform solution, and to 100 cc of this solution were added 1.0 g of a surfactant (7) and 190 cc of 6.6% aqueous solution of lime-processed gelatin heated at about 60° C., and the mixture was dispersed for 10 minutes at 10000 rpm. In this manner, two kinds of dye dispersions shown in Table 2 were prepared.

TABLE 2

| Compound | Yellow filter dye | Anti-halation dye |
|---|---|---|
| Leuco dye Y | 5.32 g | — |
| Leuco dye B | — | 4.5 g |
| Leuco dye M | — | 0.58 g |
| Developer | 30.2 g | 15.1 g |
| High boiling point organic solvent (1) | — | 10 g |
| Ethyl acetate | 60 ml | 75 ml |

Leuco dye Y

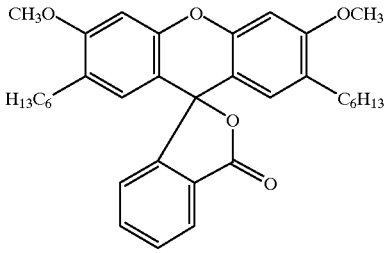

Developer

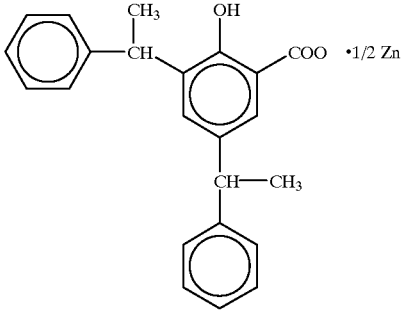

-continued

Leuco dye B

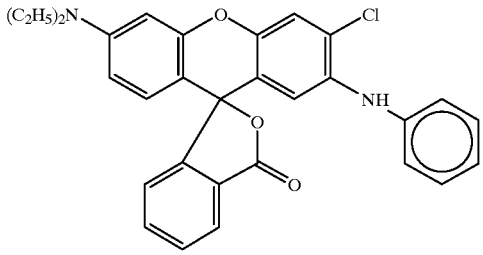

Surfactant (7)

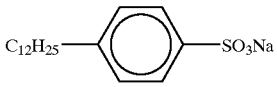

Leuco dye M

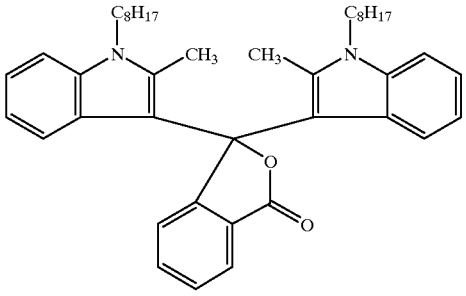

High boiling point organic solvent (1)

$C_{26}H_{46.0}Cl_{7.1}$

<Preparation of support>

Next, a support used in the present invention was prepared in a method described below.

Polyethylene-2,6-naphthalate (PEN) polymer (100 parts by weight), and 2 parts by weight of Tinuvin P.326 (manufactured by Ciba-Geigy Corp.) as an ultraviolet ray absorber were dried, melted at 300° C., then extruded from a T die, and 3.3-magnified longitudinal drawing was conducted at 140° C., subsequently, 3.3-magnified transversal drawing was conducted at 130° C., and the product was thermally fixed for 6 seconds at 250° C. to obtain a PEN film having a thickness of 92 μm. To this PEN film were added a blue dye, a magenta dye and a yellow dye (Laid-open Technical Journal (Kokai Giho): No. 94-6023, I-1, I-4, I-6, I-24, I-26, I-27 or II-5), so that the yellow density was 0.01, the magenta density was 0.08 and the cyan density was 0.09. This film was further wound on a stainless core having a diameter of 20 cm, and subjected to heat treatment at 113° C. for 30 hours, to give a support which was not easily curled.

<Coating of subbing layer>

The above-described support was subjected to corona discharge treatment on both sides, UV irradiation treatment and glow discharge treatment, then a coating solution for a subbing layer composed of gelatin (0.1 g/m$^2$), sodium α-surufo-di-2-ethylhexylsuccinate (0.01 g/m$^2$), salicylic acid (0.025 g/m$^2$), PQ-1 (0.005 g/m$^2$) and PQ-2 (0.006 g/m$^2$) was coated (10 cc/m$^2$, bar coater used)on the surface to be coated with a light-sensitive layer, making a subbing layer. Drying was conducted at 115° C. for 6 minutes (rollers and transporting apparatuses in the drying zone were all maintained at a temperature of 115° C.)

<Coating of backing layer>

1) Coating of antistatic layer

A dispersion of fine particle powder having a specific resistivity of 5 Ω·cm of a tin oxide—antimony oxide complex having an average particle size of 0.005 μm (secondary flocculated particle size about 0.08 μm; 0.027 g/m$^2$), gelatin (0.03 g/m$^2$), $(CH_2{=}CHSO_2CH_2CH_2NHCO)_2CH_2$ (0.02 g/m$^2$) polyoxyethylene-p-nonylphenol (polymerization degree 10) (0.005 g/m$^2$), PQ-3 (0.008 g/m$^2$) and resorcin were coated.

2) Coating of magnetic recording layer

Cobalt-γ-iron oxide (0.06 g/m$^2$) (specific surface area 43 m$^2$/g, long axis 0.14 μm, short axis 0.03 μm, saturated magnetization 89 emu/g, $Fe^{+2}/Fe^{+3}$=6/94, the surface was aluminum oxide silicon oxide treated with iron oxide 2% by weight)coated with 3-polyoxyethylene-propyloxytrimethoxysilane (polymerization degree 15) (15% by weight) was coated by a bar coater using diacetylcellulose (1.15 g/m$^2$) (dispersion of iron oxide was conducted by open kneader and sand mill), PQ-4 (0.075 g/m$^2$) and PQ-5 (0.004 g/m$^2$) as a hardener, and acetone, methyl ethyl ketone, cyclohexanone and dibutylphthalate as a solvent, to obtain a magnetic recording layer having a thickness of 1.2 μm. $C_6H_{13}CH(OH)C_{10}H_{20}COOC_{40}H_{81}$ (50 g/m$^2$) as a lubricant, a silica particle (average particle size 1.0 μm) as a matting agent and aluminum oxide (ERC-DBM manufactured by Reynolds Metal Corp; average particle size 0.44 μm) as an abrasion agent were added respectively to give coating amounts of 5 mg/m$^2$ and 15 mg/m$^2$. Drying was conducted at 115° C. for 6 minutes (rollers and transporting apparatuses in the drying zone were all maintained at a temperature of 115° C.). Color density increment of DB in the magnetic recording layer measured by X-light (blue filter) was approximately 0.1, saturated magnetization moment of the magnetic recording layer was 4.2 emu/g, coersive force was $7.3\times10^4$ A/m, and angle form ratio was 65%.

3) Coating of sliding layer

Hydroxyethylcellulose (25 mg/m$^2$), PQ-6 (7.5 mg/m$^2$), PQ-7 (1.5 mg/m$^2$) and polydimethylsiloxane (1.5 mg/m$^2$) were coated. This mixture was melted at 105° C. in xylene/propylene glycol monomethyl ether (1/1), poured for dispersion into propylene glycolmonomethyl ether (10-times volume) at normal temperature, then made into a dispersion (average particle size 0.01 μm) in acetone and added. Drying was conducted at 115° C. for 6 minutes (rollers and transporting apparatuses in the drying zone were all maintained at a temperature of 115° C.). The sliding layer had excellent properties such as a kinetic friction coefficient of 0.10 (5 mm ø stainless hard ball, load 100 g, speed 6 cm/minute), a static friction coefficient (clip method) 0.09, and a dynamic friction coefficient between the above-described emulsion surface and sliding layer of 0.18.

PQ-1

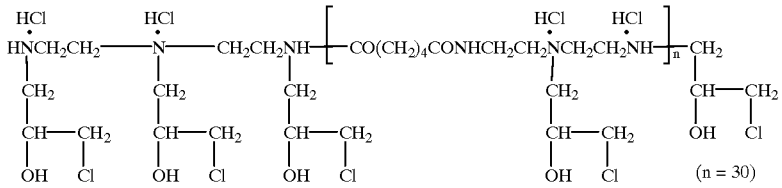

PQ-2

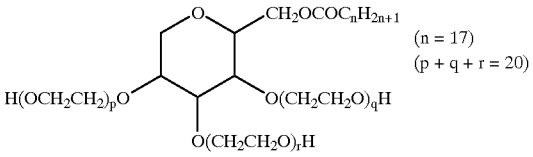

PQ-3

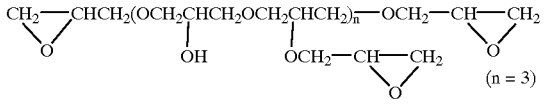

PQ-4

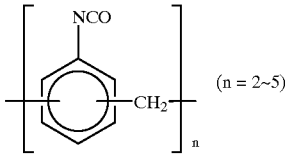

PQ-5

$(CH_3O)_3SiCH_2CH_2CH_2O(CH_2CH_2O)_nCH_3$ (n = 7.3)

PQ-6

$C_{50}H_{101}(CH_2CH_2O)_nH$ (n = 16)

PQ-7

$C_8F_{17}SO_2N(C_3H_7)(CH_2CH_2O)_n(CH_2)_4SO_3Na$ (n = 4)

Light-sensitive elements 101 each having a multilayer structure shown in the following Table 3, were made using the following materials and supports.

TABLE 3

| Constituent layer | Added substance | Amount added (mg/m$^{2}$) |
|---|---|---|
| 13th layer Protective layer | Lime-processed gelatin | 1000 |
| | Matting agent (silica) | 100 |
| | Surfactant (8) | 100 |
| | Surfactant (9) | 300 |
| | Water-soluble polymer (10) | 20 |
| 12th layer Intermediate layer | Lime-processed gelatin | 500 |
| | Surfactant (9) | 15 |
| | Zinc hydroxide | 3400 |
| | Water-soluble polymer (10) | 30 |
| 11th layer Yellow color forming layer (high sensitive layer) | Lime-processed gelatin | 560 |
| | Light-sensitive silver halide emulsifying agent (1) | 507 |
| | Sensitizing dye (12) | 1.08 |
| | Yellow dye forming coupler (3) | 93 |
| | Developing agent (4) | 104 |
| | Anti-fogging agent (5) | 0.8 |
| | Organic solvent having a high boiling point (6) | 156 |
| | Surfactant (7) | 48 |
| | Water-soluble polymer (10) | 48 |
| 10th layer Yellow color forming layer (low sensitive layer) | Lime-processed gelatin | 835 |
| | Light-sensitive silver halide emulsifying agent (2) | 233 |
| | Light-sensitive silver halide emulsifying agent (3) | 233 |
| | Sensitizing dye (12) | 2.02 |
| | Yellow dye forming coupler (3) | 286 |
| | Developing agent (4) | 319 |
| | Anti-fogging agent (5) | 0.8 |
| | Organic solvent having a high boiling point (6) | 476 |
| | Surfactant (7) | 48 |
| | Water-soluble polymer (10) | 48 |
| 9th layer Intermediate layer | Lime-processed gelatin | 1000 |
| | Leuco dye Y | 250 |
| | Surfactant (9) | 8 |
| Yellow filter layer | Water-soluble polymer (10) | 5 |
| | Hardener (11) | 65 |
| | Color developer | 1500 |
| 8th layer Magenta color forming layer (high sensitive layer) | Lime-processed gelatin | 362 |
| | Light-sensitive silver halide emulsifying agent (4) | 552 |
| | Sensitizing dye (13) | 1.02 |
| | Sensitizing dye (14) | 0.21 |
| | Sensitizing dye (15) | 0.08 |
| | Magenta dye forming coupler (2) | 42 |
| | Developing agent (4) | 36 |
| | Anti-fogging agent (5) | 0.06 |
| | Organic solvent having a high boiling point (6) | 47 |
| | Surfactant (7) | 33 |
| | Water-soluble polymer (10) | 14 |
| 7th layer Magenta color forming layer (medium sensitive layer) | Lime-processed gelatin | 158 |
| | Light-sensitive silver halide emulsifying agent (5) | 231 |
| | Sensitizing dye (13) | 0.71 |
| | Sensitizing dye (14) | 0.15 |
| | Sensitizing dye (15) | 0.06 |
| | Magenta dye forming coupler (2) | 46 |
| | Developing agent (4) | 41 |
| | Anti-fogging agent (5) | 0.06 |
| | Organic solvent having a high boiling point (6) | 52 |
| | Surfactant (7) | 33 |
| | Water-soluble polymer (10) | 14 |
| 6th layer Magenta color forming layer (low sensitive layer) | Lime-processed gelatin | 441 |
| | Light-sensitive silver halide emulsifying agent (6) | 420 |
| | Sensitizing dye (13) | 0.90 |
| | Sensitizing dye (14) | 0.19 |
| | Sensitizing dye (15) | 0.07 |
| | Magenta dye forming coupler (2) | 238 |
| | Developing agent (4) | 177 |
| | Anti-fogging agent (5) | 0.06 |
| | Organic solvent having a high boiling point (6) | 265 |

TABLE 3-continued

| Constituent layer | Added substance | Amount added (mg/m$^{2}$) |
|---|---|---|
| | Surfactant (7) | 33 |
| | Water-soluble polymer (10) | 14 |
| 5th layer Intermediate layer | Lime-processed gelatin | 1000 |
| | Surfactant (9) | 8 |
| | Zinc hydroxide | 1200 |
| | Water-soluble polymer (10) | 5 |
| 4th layer Cyan color forming layer (high sensitive layer) | Lime-processed gelatin | 778 |
| | Light-sensitive silver halide emulsifying agent (7) | 1058 |
| | Sensitizing dye (16) | 1.44 |
| | Sensitizing dye (17) | 0.07 |
| | Sensitizing dye (18) | 2.09 |
| | Cyan dye forming coupler (3) | 68 |
| | Developing agent (4) | 85 |
| | Developing agent (5) | 42 |
| | Anti-fogging agent (5) | 0.12 |
| | Organic solvent having a high boiling point (6) | 61 |
| | Surfactant (7) | 24 |
| | Water-soluble polymer (10) | 10 |
| 3rd layer Cyan color forming layer (medium sensitive layer) | Lime-processed gelatin | 345 |
| | Light-sensitive silver halide emulsifying agent (8) | 267 |
| | Sensitizing dye (16) | 1.70 |
| | Sensitizing dye (17) | 0.08 |
| | Sensitizing dye (18) | 2.46 |
| | Cyan dye forming coupler (3) | 45 |
| | Developing agent (4) | 19 |
| | Developing agent (5) | 9 |
| | Anti-fogging agent (5) | 0.12 |
| | Organic solvent having a high boiling point (6) | 45 |
| | Surfactant (7) | 24 |
| | Water-soluble polymer (10) | 10 |
| 2nd layer Cyan color forming layer (low sensitive layer) | Lime-processed gelatin | 514 |
| | Light-sensitive silver halide emulsifying agent (9) | 456 |
| | Sensitizing dye (16) | 0.67 |
| | Sensitizing dye (17) | 0.08 |
| | Sensitizing dye (18) | 2.46 |
| | Cyan dye forming coupler (3) | 45 |
| | Developing agent (4) | 19 |
| | Developing agent (5) | 9 |
| | Anti-fogging agent (5) | 0.12 |
| | Organic solvent having a high boiling point (6) | 239 |
| | Surfactant (7) | 24 |
| | Water-soluble polymer (10) | 10 |
| 1st layer Anti-halation layer | Lime-processed gelatin | 1000 |
| | Leuco dye B | 221 |
| | Leuco dye M | 28 |
| | Color developer | 740 |
| | Oil (1) | 491 |
| | Surfactant (7) | 46 |
| | 92 $\mu$m PEN support | |

Further, processing elements R-1 each having the content shown in the following Table 4 or 5 were prepared.

TABLE 4

Structure of Processing element R-1

| Layer structure | Composition | Amount added (mg/m$^{2}$) |
|---|---|---|
| 4th layer Protective layer | Acid-processed gelatin | 220 |
| | Water-soluble polymer (19) | 60 |
| | Water-soluble polymer (20) | 200 |
| | Additive (21) | 20 |
| | Potassium nitrate | 12 |
| | Matting agent (22) | 10 |
| | Surfactant (9) | 7 |
| | Surfactant (23) | 7 |

TABLE 4-continued

Structure of Processing element R-1

| Layer structure | Composition | Amount added ($mg/m^2$) |
|---|---|---|
| | Surfactant (24) | 10 |
| 3rd layer | Lime-processed gelatin | 240 |
| Intermediate layer | Water-soluble polymer (20) | 24 |
| | Hardener (25) | 360 |
| | Surfactant (7) | 9 |
| 2nd layer | Lime-processed gelatin | 4800 |
| Base generating layer | Water-soluble polymer (26) | 1400 |
| | Guanidine picolinate | 5820 |
| | Potassium quinolinate | 450 |
| | Sodium quinolinate | 360 |
| | Surfactant (7) | 48 |
| 1st layer | Lime-processed gelatin | 280 |
| Subbing layer | Water-soluble polymer (20) | 12 |
| | Surfactant (9) | 14 |
| | Hardener (25) | 370 |
| | Supporting substrate A (63 μm) | |

TABLE 5

Structure of Support A

| Layer name | Composition | Weight ($mg/m^2$) |
|---|---|---|
| Front surface subbing layer | Lime-processed gelatin | 100 |
| Polymer layer | Polyethylene terephthalate | 62500 |
| Back surface subbing layer | Polymer (methyl methacrylate-styrene-2-ethylhexyl acrylate-methacrylic acid copolymer) | 1000 |
| | PMMA latex | 120 |

Surfactant (8)

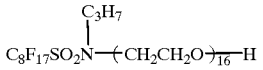

Surfactant (9)

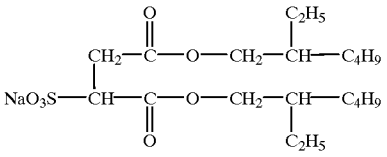

Water-soluble polymer (10)

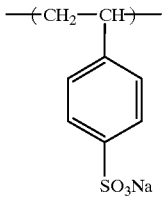

Hardener (11)

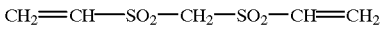

The light-sensitive element 101 prepared was cut into APS format, perforated, loaded in an APS camera, and people and a Macbeth chart were photographed.

Water (40° C., 15 $cc/m^2$) (corresponding to 45% of the maximum swelling) was applied to the photographed light-sensitive element 101, and the element was superposed on a processing element R-1, and was heated from the back side of the light-sensitive element by a heat drum at 83° C. for 20 seconds. The processing element R-1 was peeled from the light-sensitive element 101, the light-sensitive element was dried, the resulting negative image on the light-sensitive element was read by a digital image reading apparatus Frontier SP-1000 (manufactured by Fuji Photo Film Co., Ltd.), the image processing was carried out at a work station, then was outputted to a heat development printer (PICTROGRAPHY 4000, manufactured by Fuji Photo Film Co., Ltd.) to obtain a print having excellent granularity and sharpness each equivalent to a conventional photograph.

Example 1

(Preparation of the processing Sheet for inhibiting the dye forming reaction)

A dye forming reaction inhibiting-process sheet S-1 as shown in Table 6 was prepared. Further, a dye forming reaction inhibiting-process sheet S-2 was prepared in the same manner, except that 3 $g/m^2$ Of the dye forming reaction inhibiting agent (1) of the dye forming reaction inhibiting-process sheet S-1 was changed to 4.5 $g/m^2$of a dye forming reaction inhibiting agent (2).

TABLE 6

S-1 structure of dye forming reaction inhibiting sheet

| Layer name | Composition | Amount coated ($mg/m^2$) |
|---|---|---|
| Protective layer | Acid-processed gelatin | 220 |
| | κ carageenan | 60 |
| | Sumika Gel L-5H | 200 |
| Intermediate layer | Lime-processed gelatin | 240 |
| | Surfactant (7) | 10 |
| Dye forming reaction inhibiting layer | Lime-processed gelatin | 2400 |
| | Dexstran | 1200 |
| | Dye forming reaction inhibiting agent (1) | |
| | Formalin sulfite adduct | 3000 |
| | Surfactant (7) | 48 |
| Subbing layer | Lime-processed gelatin | 280 |
| | Surfactant (9) | 24 |
| | Hardener (26) | 46 |
| | PET support A (thickness 63 μm) | |

Dye forming reaction inhibiting agent (1)
Formalin-sulfurous acid adduct

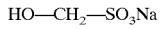

Dye forming reaction inhibiting agent (2)
2-bis(1,2,4-triazole-1-ylmethyl) piperazine
Hardener (26)

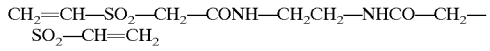

The light-sensitive element 101 prepared in Production Example 1 was cut into APS format, perforated, loaded in an APS camera, and people and a Macbeth chart were photographed.

Water (40° C., 15 $cc/m^2$) (corresponding to 45% of the maximum swelling) was applied to the photographed light-sensitive element, and the light-sensitive element was superposed on a processing element R-1, and was heated from the back side of the light-sensitive element by a heat drum at 83° C. for 20 seconds. The processing element R-1 was peeled from the light-sensitive element 101, to give a negative image on the light-sensitive element. Water (40° C., 15 $cc/m^2$) (corresponding to 45% of the maximum swelling) was again applied to the heat-processed light-sensitive element, and the element was superposed on the dye forming reaction inhibiting-process sheet S-1, and was heated from the back side of the light-sensitive element by a heat drum at 83° C. for 30 seconds. The dye forming reaction inhibiting-process sheet S-1 was peeled from the light-sensitive element 101, to give a negative image on the light-sensitive element which had no difference from that before processing with the processing sheet S-1. The processed negative image obtained by processing with the dye forming reaction inhibiting process sheet S-1 is called a light-sensitive element 101B1, that processed with S-2 is called a light-sensitive element 101B2, and the processed negative sensitive material obtained in Production Example 1 is called a light-sensitive element 101A.

The light-sensitive elements 101A, 101B1 and 101B2 were preserved for 1 week under conditions of a temperature of 60° C. and a relative humidity of 70%, then, on the Macbeth chart image formed on the light-sensitive element, gray density at the minimum density part of the gray step was measured. The results are shown in Table 7.

TABLE 7

The minimum density of an image of a Macbeth chart of the light-sensitive element of directly after processing and after 1 week heating

| | Directly after processing | After storage for 1 week (60° C., relative humidity 70%) |
|---|---|---|
| 101A | 0.84 | 1.51 |
| 101B1 | 0.83 | 0.95 |
| 101B2 | 0.83 | 0.92 |

As understood from Table 7, on the light-sensitive element 101A, the density in the minimum density part increased markedly, however, on the light-sensitive elements 101B1 and 101B2, the density in the minimum density part only slightly increased.

The image on the light-sensitive element which had been preserved for 1 week under the above-described conditions was read by a digital image reading apparatus Frontier SP-1000 (manufactured by Fuji Photo Film Co., Ltd.), the image processing was carried out at work station, then was outputted to a heat development printer (PICTROGRAPHY 4000, manufactured by Fuji Photo Film Co., Ltd.). In the light-sensitive element 101A, the granularity and saturation had deteriorated further than those of the image read directly after the processing, however, in the light-sensitive elements 101B1 and 101B2, the granularity and saturation were not deteriorated so much, and a print having excellent granularity and sharpness equivalent to a conventional photograph was obtained.

Example 2

The light-sensitive element 101 prepared in Production Example 1 was cut into APS format, perforated, loaded in an APS camera, and people and a Macbeth chart were photographed.

Water (40° C., 15 cc/m$^2$) (corresponding to 45% of the maximum swelling) was applied to the photographed light-sensitive element, and the element was superposed on a processing element R-1, and was heated from the back side of the light-sensitive element by a heat drum at 83° C. for 20 seconds. The processing element R-1 was peeled from the light-sensitive element 101, to give a negative image on the light-sensitive element. The heat developed light-sensitive element was immersed in a dye forming reaction inhibiting agent-processed bath (38° C.) described below for 1 minute, and dried. This processed negative light-sensitive element obtained in Example 2 is called a light-sensitive element 101C.

(Composition of dye forming reaction inhibiting processing bath)

| | |
|---|---|
| Sodium p-toluenesulfonate | 0.03 g |
| Polyoxyethylene-p-mononoylphenl ether (average polymerization degree 10) | 0.2 g |
| Disodium ethylenediamine tetraacetate | 0.05 g |
| 2,4-triazol | 1.3 g |
| 2-bis(1,2,4-triazole-1-ylmethyl)piperadine | 0.75 g |

To the above-described composition was added 1.0 liter of water to prepare a dye forming reaction inhibiting bath. The pH value was 8.5.

The light-sensitive elements 101A and 101C were preserved for 1 week under conditions of a temperature of 60° C. and a relative humidity of 70%, then on the photographed Macbeth chart image formed on the light-sensitive element, gray density at the minimum density part of the gray step was measured. The results are shown in the following Table 8.

TABLE 8

The minimum density of an image of a Macbeth chart of the light-sensitive element of directly after processing and after 1 week heating

| | Directly after processing | After storage for 1 week (60° C., relative humidity 70%) |
|---|---|---|
| 101A | 0.84 | 1.51 |
| 101C | 0.85 | 0.9 |

On the light-sensitive element 101A, the density in the minimum density part increased makedly, however, on the light-sensitive elements 101C, the density in the minimum density part only slightly increased.

The image on the light-sensitive element which had been preserved for 1 week under the above-described conditions was read by a digital image reading apparatus Frontier SP-1000 (manufactured by Fuji Photo Film Co., Ltd.), the image processing was carried out at work station, then was outputted to a heat development printer (PICTROGRAPHY 4000, manufactured by Fuji Photo Film Co., Ltd.). In the light-sensitive element 101A, the granularity and saturation were more deteriorated than those of the image read directly after the processing, however, in the light-sensitive elements 101C, neither granularity nor saturation was deteriorated, and a print having excellent granularity and sharpness equivalent to a conventional photograph was obtained.

Example 3

(Preparation of fixing processing sheet)

A fixing processing sheet F-1 and a fixing processing sheet F-2 containing a dye forming reaction inhibiting agent shown in Table 9 and Table 10 respectively were prepared.

TABLE 9

Structure of fixing processing sheet F-1

| Layer structure | Additives | Amount coated (mg/m$^2$) |
|---|---|---|
| 4th layer | Acid-processed gelatin | 220 |
| Protective layer | Water-soluble polymer (19) | 60 |
| | Water-soluble polymer (20) | 200 |
| | Additive (21) | 20 |
| | Potassium nitrate | 12 |
| | Matting agent (22) | 10 |

TABLE 9-continued

Structure of fixing processing sheet F-1

| Layer structure | Additives | Amount coated (mg/m$^2$) |
|---|---|---|
| | Surfactant (9) | 7 |
| | Surfactant (23) | 7 |
| | Surfactant (24) | 10 |
| | Hardener (26) | 124 |
| 3rd layer | Lime-processed gelatin | 240 |
| Intermediate layer | Water-soluble polymer (20) | 24 |
| | Surfactant (7) | 9 |
| 2nd layer | Lime-processed gelatin | 4800 |
| Base generating | Water-soluble polymer (26) | 1400 |
| layer | Surfactant (7) | 48 |
| | Additive A | 2800 |
| | Additive B | 1400 |
| 1st layer | Lime-processed gelatin | 280 |
| Subbing layer | Water-soluble polymer (20) | 12 |
| | Surfactant (9) | 14 |
| | Suppor A (63 μm) | |

TABLE 10

Structure of fixing processing sheet F-2

| Layer structure | Additives | Amount added (mg/m$^2$) |
|---|---|---|
| 4th layer | Acid-processed gelatin | 220 |
| Protective layer | Water-soluble polymer (19) | 60 |
| | Water-soluble polymer (20) | 200 |
| | Additive (21) | 20 |
| | Potassium nitrate | 12 |
| | Matting agent (22) | 10 |
| | Surfactant (9) | 7 |
| | Surfactant (23) | 7 |
| | Surfactant (24) | 10 |
| | Hardener (26) | 128 |
| 3rd layer | Lime-processed gelatin | 240 |
| Intermediate | Water-soluble polymer (20) | 24 |
| layer | Surfactant (7) | 9 |
| 2nd layer | Lime-processed gelatin | 4800 |
| Base generating | Water-soluble polymer (26) | 1400 |
| layer | Surfactant (7) | 48 |
| | Additive A | 2800 |
| | Additive B | 1400 |
| | Dye forming reaction inhibitor (2) | 1240 |
| 1st layer | Lime-processed gelatin | 280 |
| Subbing layer | Water-soluble polymer (20) | 12 |
| | Surfactant (9) | 14 |
| | Support A (63 μm) | |

Water-soluble polymer (19) κ-carageenan

Water-soluble polymer (20) Sumikagel L-5H (manufactured by Sumitomo Chemical Co., Ltd.)

Additive (21)

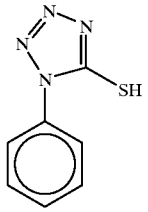

Mat agent (22) SYLOID 79 (manufactured by Fuji Devison Corp.)

Surfactant (23)

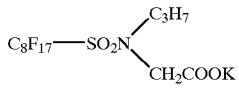

Surfactant (24)

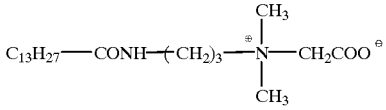

Hardener (25)

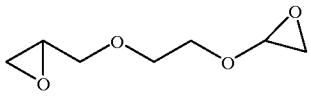

Water-soluble polymer (26)

Dextran (molecular weight 70000)

Additive A

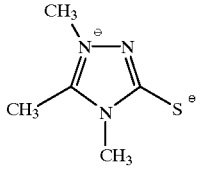

Additive B

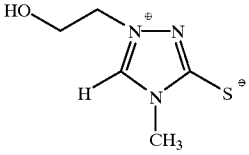

The light-sensitive element 101 prepared in Production Example 1 was cut into APS format, perforated, loaded in an APS camera, and people and a Macbeth chart were photographed.

Water was applied to the photographed light-sensitive element, the element was superposed on a processing element R-1, and heated for 20 seconds and developed to give a negative image on the light-sensitive element in the same manner as in Production Example 1. Water (40° C., 10 cc/m$^2$) (corresponding to 30% of the maximum swelling) was again given to the photographed light-sensitive element using a method in which water is sprayed by a water spraying apparatus which has a plurality of nozzles which are arranged in a straight line along a direction perpendicular to the transporting direction of the light-sensitive element or processing element sheet, so that the nozzles eject spray water, and also has an actuator which deflects the above-described nozzles toward the light-sensitive element or the processing element on the transporting path, then this element was superposed on a fixing processing sheet F-1, and was heated from the back side of the light-sensitive element by a heat drum at 75° C. for 30 seconds. The processed negative sensitive material obtained by processing with the fixing processing sheet F-1 is called a light-sensitive element 101D1, that processed with F-2 is called a light-sensitive element 101D2. When processed with any of the processing sheets, turbidity due to silver halide on the light-sensitive element 101 was decreased, and the dye image on the light-sensitive element 101 exhibited change from that before processing with the fixing processing sheet F-1 or F-2.

The light-sensitive elements 101A, 101D1 and 101D2 were preserved for 1 week under conditions of a temperature of 60° C. and a relative humidity of 70%, then, on a Macbeth chart image formed on the light-sensitive element, the gray density at the minimum density part of the gray step part was measured. The results are shown in Table 11.

TABLE 11

| The minimum density of an image of a Macbeth chart of the light-sensitive element of directly after processing and after 1 week heating | | |
|---|---|---|
| | Directly after processing | After storage for 1 week (60° C., relative humidity 70%) |
| 101A | 0.84 | 1.51 |
| 101D1 | 0.53 | 0.61 |
| 101D2 | 0.43 | 0.49 |

As understood from Table 11, on the light-sensitive element 101A, the density in the minimum density increased markedly, however, on the light-sensitive elements 101D1 and 101D2, the density in the minimum density only slightly increased.

The image on the light-sensitive element which had been preserved for 1 week under the above-described conditions was read by a digital image reading apparatus Frontier SP-1000 (manufactured by Fuji Photo Film Co., Ltd.), the image processing was carried out at a work station, then was outputted to a heat development printer (PICTROGRAPHY 4000, manufactured by Fuji Photo Film Co., Ltd.). In the light-sensitive element 101D1, the granularity and saturation were more deteriorated than those of the image read directly after the processing, however, in the light-sensitive elements 101D2, the granularity and saturation were not deteriorated so much, and a print having excellent granularity and sharpness equivalent to a conventional photograph was obtained.

Example 4

(Preparation of bleach-fixing processing sheet)

A bleach-fixing process sheet shown in Table 12 was prepared.

TABLE 12

| Structure of bleach-fixing process sheet | | |
|---|---|---|
| Layer structure | Additives | Amount added ($mg/m^2$) |
| 4th layer | Acid-processed gelatin | 220 |
| Protective layer | Water-soluble polymer (19) | 60 |
| | Water-soluble polymer (20) | 200 |
| | Additive (21) | 20 |
| | Potassium nitrate | 12 |
| | Matting agent (22) | 10 |
| | Surfactant (9) | 7 |
| | Surfactant (23) | 7 |
| | Surfactant (24) | 10 |
| | Hardener (26) | 128 |
| 3rd layer | Lime-processed gelatin | 240 |
| Intermediate | Water-soluble polymer (20) | 24 |
| layer | Surfactant (7) | 9 |
| 2nd layer | Lime-processed gelatin | 4800 |
| Base generating | Water-soluble polymer (26) | 1400 |
| layer | Surfactant (7) | 48 |
| | Additive A | 1400 |
| | Additive B | 700 |
| | Additive C | 2226 |
| 1st layer | Lime-processed gelatin | 280 |
| Subbing layer | Water-soluble polymer (20) | 12 |
| | Surfactant (9) | 14 |
| Support A (63 μm) | | |
| Additive C | | |
| $(HOCH_2CH_2)_3N^{\oplus}$ $H{\bullet}Fe^{3+}{\bullet}$ | | |

TABLE 12-continued

| Structure of bleach-fixing process sheet | | |
|---|---|---|
| Layer structure | Additives | Amount added ($mg/m^2$) |
| | 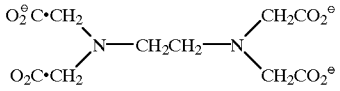 | |

Water (40° C., 10 $cc/m^2$) (corresponding to 30% of the maximum swelling) was again applied to the heat developed photosensitive member 101 after the photographs had been taken in the same manner as in Production Example 1, using a method in which water is sprayed by a water spraying apparatus which has a plurality of nozzles which are arranged in a straight line along a direction perpendicular to the transporting direction of the light-sensitive element or processing element, so that the nozzles eject water, and also has an actuator which deflects the above-described nozzles toward the light-sensitive element or the processing element on the transporting path. This element was then superposed on a bleach-fixing process sheet, and was heated from the back side of the light-sensitive element by a heat drum at 75° C. for 30 seconds. When the bleach-fixing process sheet was peeled off, a light-sensitive element on which developed silver and remaining silver halide were partially removed was obtained (this processed light-sensitive element is called light-sensitive element 101E1). Another light-sensitive element 101 which had been subjected to the heat developing process, was processed with the above-described bleach-fixing process sheet, and directly after peeling off of the bleach-fixing process sheet before the light-sensitive element was dried, was superposed on the dye forming reaction inhibiting process sheet S-2 prepared in Example 1, and was heated from the back side of the light-sensitive element by a heat drum at 80° C. for 15 seconds. This processed negative sensitive element obtained by processing with the dye forming reaction inhibiting process sheet S-2 is called a processed light-sensitive element 101E2.

The light-sensitive elements 101E1 and 101E2 were preserved for 1 week under conditions of a temperature of 60° C. and a relative humidity of 70%, then on a Macbeth chart image formed on the light-sensitive element, gray density at the minimum density part of a gray step part was measured. The results are shown in Table 13.

TABLE 13

| The minimum density of an image of a Macbeth chart of the light-sensitive element of directly after processing and after 1 week heating | | |
|---|---|---|
| | Directly after processing | After storage for 1 week (60° C., relative humidity 70%) |
| 101E1 | 0.62 | 1.32 |
| 101E2 | 0.73 | 0.79 |

As understood from Table 13, on the light-sensitive element 101E1, the density in the minimum density remarkably increased, however, on the light-sensitive element 101E2, the density in the minimum density only slightly increased.

The image on the light-sensitive element which had been preserved for 1 week under the aforementioned conditions was read by a digital image reading apparatus Frontier SP-1000 (manufactured by Fuji Photo Film Co., Ltd.), the image processing was carried out at a work station, then was outputted to a heat developing printer (PICTROGRAPHY 4000, manufactured by Fuji Photo Film Co., Ltd.). In the light-sensitive element 101E1, the granularity and saturation were more deteriorated than those of the image read directly after the process, however, in the light-sensitive elements 101E2, the granularity and saturation were not deteriorated so much, and a print having excellent granularity and sharpness equivalent to a conventional photograph was obtained.

Example 5

A heat developed light-sensitive element which had been photographed prepared in the same manner as in Production Example 1 was immersed in a bleaching bath, a bleach-fixing bath and an alkaline bath each having the following composition. The processing time and temperature are shown below. On the light-sensitive element after the processing, a light-sensitive element on which developed silver and remaining silver halide had been removed (this processed light-sensitive element is called a light-sensitive element 101F1.) was obtained. Another sheet of the light-sensitive element 101F1 was prepared, and immersed in the dye forming reaction inhibiting agent processing bath (38° C.) for one minute prepared in Example 2, and dried (this processed light-sensitive element is called a light-sensitive element 101F2.).

(bleach-fixing processing time)

| | | |
|---|---|---|
| bleaching bath | 50 second | 38.0° C. |
| bleach-fixing bath | 50 second | 38.0° C. |
| water-washing bath | 30 second | 38.0° C. |
| alkaline bath | 20 second | 38.0° C. |
| dye forming reaction inhibiting agent processing bath (only 101F2) | 1 minute | 38.0° C. |

Bleaching bath (composition of bleaching solution)

| | |
|---|---|
| 3-diaminopropane tetraacetic acid Fe (II) ammonium monohydrate | 130 g |
| Ammonium bromide | 70 g |
| Ammonium nitrate | 14 g |
| Hydroxyacetic acid | 25 g |
| Acetic acid | 40 g |

To the above-described composition was added 1.0 liter of water, and the pH value was controlled with ammonia water to 4.4 to give a bleaching solution.

Bleach-fixing bath

15/85 mixture of the above-described bleaching solution and a fixing solution described below (fixing solution)

| | |
|---|---|
| ammonium sulfite | 19 g |
| ammonium thiosulfate (700 g/liter) | 280 g |
| imidazole | 19 g |
| ethylenediaminetetraacetic acid | 15 g |

To the above-described composition was added 1.0 liter of water, and the pH value was controlled with ammonia water to 7.4 to give a bleach-fixing solution.

| | |
|---|---|
| guanidine carbonate | 50 g |
| ethylenediaminetetraacetic acid | 15 g |

(alkaline bath)

To the above-described composition was added 1.0 liter of water, and the pH value was controlled with 1N aqueous NaOH solution to 10.2 to give an alkaline solution.

The light-sensitive elements 101F1 and 101F2 were preserved for 1 week under conditions of a temperature of 60° C. and a relative humidity of 70%, then on a Macbeth chart image formed on the light-sensitive element, the gray density at the minimum density part of the gray step was measured. The results are shown in Table 14.

TABLE 14

The minimum density of an image of a Macbeth chart of the light-sensitive element of directly after processing and after 1 week heating

| | Directly after processing | After storage for 1 week (60° C., relative humidity 70%) |
|---|---|---|
| 101F1 | 0.42 | 1.32 |
| 101F2 | 0.43 | 0.46 |

As understood from Table 14, on the light-sensitive element 101F1, the density in the minimum density part increased markedly, however, on the light-sensitive elements 101F2, the density in the minimum density only slightly increased.

The image on the light-sensitive element which had been preserved for 1 week under the above-described conditions was read by a digital image reading apparatus Frontier SP-1000 (manufactured by Fuji Photo Film Co., Ltd.), the image processing was carried out at a work station, then was outputted to a heat developing printer (PICTROGRAPHY 4000, manufactured by Fuji Photo Film Co., Ltd.). In the light-sensitive element lOlFl, the granularity and saturation were more deteriorated than those of the image read directly after the processing, however, in the light-sensitive elements 101F2, the granularity and saturation were not deteriorated so much, and a print having excellent granularity and sharpness equivalent to a conventional photograph was obtained.

Example 6

The processed light-sensitive elements 101F1 and 101F2 prepared in the same manner as in Example 5 were read and outputted by the NSE330 unit of a heat developing printer (PICTROSTAT 330, manufactured by Fuji Photo Film Co., Ltd.). From the processed light-sensitive elements 101F1 and 101F2, a print having excellent granularity and sharpness equivalent to a conventional photograph was obtained. The light-sensitive elements 101F1 and 101F2 were preserved for 1 week under conditions of a temperature of 60° C. and a relative humidity of 70%, to prepare similar prints. In the light-sensitive element 101F1, the granularity and saturation were more deteriorated than those of the image read directly after the processing , however, in the light-sensitive elements 101F2, the granularity and saturation were not degraded so much, and a print having excellent granularity and sharpness equivalent to after process was obtained.

What is claimed is:

1. An image forming method comprising the steps of:

imagewise exposing a light-sensitive element having on a transparent support at least three light-sensitive layers, which each comprise a light-sensitive tabular grain silver halide emulsion, a color developing agent, a coupler and a binder, and which have their sensitivities in different wavelength regions, the absorption wavelength region of each dye formed by reaction of the coupler with the oxidized product of the color developing agent being different from each other;

providing said light-sensitive element or a processing element with water in an amount corresponding to the amount of from 0.1 to 1 times the amount required for maximally swelling the total coated layers of said photosensitive element and said processing element excluding a back layer, wherein said processing element comprises on a support a processing layer containing at least a base and/or base precursor;

superposing said light-sensitive element on said processing element such that the light-sensitive layer faces the processing layer;

heat-developing the elements to a temperature of from 60° C. to 100° C. for a time of from 5 seconds to 60 seconds to form an image based on at least three color non-diffusible dyes on said photosensitive element; and forming a color image in a separate recording material based on the image information obtained in the heat-developed photosensitive element, wherein, the method further comprises using means of inhibiting a dye-forming reaction after heat development.

2. The image forming method according to claim 1, wherein means of inhibiting a dye-forming reaction after heat development is conducted by removing the unreacted coupler and/or the unreacted color developing agent from the heat-developed photosensitive element.

3. The image forming method according to claim 2, wherein said means of inhibiting a dye-forming reaction after heat development is conducted by contacting a processing sheet for inhibiting dye forming reaction containing a compound capable of inhibiting the dye forming reaction with the heat-developed light-sensitive element so that the compound is allowed to act on the heat-developed light-sensitive element.

4. The image forming method according to claim 2, wherein means of inhibiting a dye-forming reaction after heat development is conducted by immersing the heat-developed light-sensitive element in a processing solution for inhibiting the dye forming reaction containing a compound capable of inhibiting the dye forming reaction so that the compound is allowed to act on the heat-developed light-sensitive element.

5. The image forming method according to claim 1, wherein means of inhibiting a dye-forming reaction after heat development is conducted by neutralizing an alkaline which promotes the dye forming reaction.

6. The image forming method according to claim 5, wherein means of inhibiting a dye-forming reaction after heat development is conducted by contacting a processing sheet for inhibiting dye forming reaction containing a compound capable of inhibiting the dye forming reaction with the heat-developed light-sensitive element so that the compound is allowed to act on the heat-developed light-sensitive element.

7. The image forming method according to claim 5, wherein means of inhibiting a dye-forming reaction after heat development is conducted by immersing the heat-developed light-sensitive element in a processing solution for inhibiting the dye forming reaction containing a compound capable of inhibiting the dye forming reaction so that the compound is allowed to act on the heat-developed light-sensitive element.

8. The image forming method according to claim 1, wherein means of inhibiting a dye-forming reaction after heat development is conducted by contacting the heat-developed light-sensitive element with a compound capable of inhibiting the dye forming reaction or a precursor thereof.

9. The image forming method according to claim 8, wherein means of inhibiting a dye-forming reaction after heat development is a compound capable of reacting with the coupler at the coupling position and inactivating a dye forming reaction activity of the coupler.

10. The image forming method according to claim 8, wherein means of inhibiting a dye-forming reaction after heat development is a compound capable of reacting with the color developing agent to inactivate a developing activity or coupling activity of the color developing agent.

11. The image forming method according to claim 8, wherein means of inhibiting a dye-forming reaction after heat development is a compound selected from the group consisting of N-methylol compounds, hexamethylenetetramine adducts and sulfite adducts of aldehydes.

12. The image forming method according to claim 8, wherein means of inhibiting a dye-forming reaction after heat development is a compound selected from the group consisting of a nucleophilic reaction reagent, an acid precursor which releases an acid upon heating and an electrophilic compound which reacts with a base upon heating.

13. The image forming method according to claim 8, wherein means of inhibiting a dye-forming reaction after heat development is conducted by contacting a processing sheet for inhibiting dye forming reaction containing a compound capable of inhibiting the dye forming reaction with the heat-developed light-sensitive element so that the compound is allowed to act on the heat-developed light-sensitive element.

14. The image forming method according to claim 8, wherein means of inhibiting a dye-forming reaction after heat development is conducted by immersing the heat-developed light-sensitive element in a processing solution for inhibiting the dye forming reaction containing a compound capable of inhibiting the dye forming reaction so that the compound is allowed to act on the heat-developed light-sensitive element.

15. The image forming method according to claim 1, wherein means of inhibiting a dye-forming reaction after heat development is conducted by contacting a processing sheet for inhibiting dye forming reaction containing a compound capable of inhibiting the dye forming reaction with the heat-developed light-sensitive element so that the compound is allowed to act on the heat-developed light-sensitive element.

16. The image forming method according to claim 1, wherein means of inhibiting a dye-forming reaction after heat development is conducted by immersing the heat-developed light-sensitive element in a processing solution for inhibiting the dye forming reaction containing a compound capable of inhibiting the dye forming reaction so that the compound is allowed to act on the heat-developed light-sensitive element.

17. The image forming method according to claim 1, wherein the color developing agent is at least one compound selected from compounds represented by the following formulas (1) to (5):

(1)

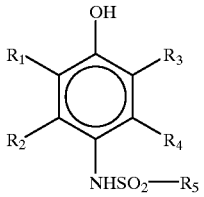

(2)

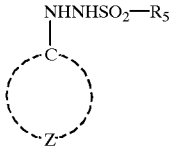

(3)

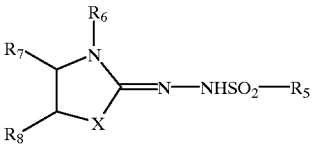

(4)

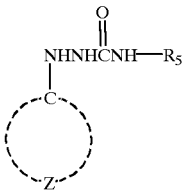

-continued (5)

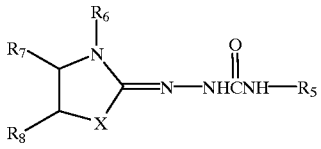

wherein each of $R_1$ to R4 represents a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents a substituted or unsubstituted alkyl group, aryl group or heterocyclic group; Z represents an atomic group forming an aromatic ring (including a heteroaromatic ring), and when Z is a benzene ring, the total value of Hammett's constants (σ) of substituents thereof is not less than 1; $R_6$ is a substituted or unsubstituted alkyl group; X is selected from the group consisting of an oxygen atom, a sulfur atom, a selenium atom or an alkyl-substituted or aryl-substituted tertiary nitrogen atom; $R_7$ and $R_8$ are selected from the group consisting of a hydrogen atom or a substituent, and $R_7$ and $R_8$ may bond to each other to form a double bond or a ring.

* * * * *